US011786764B2

(12) United States Patent
Lang

(10) Patent No.: US 11,786,764 B2
(45) Date of Patent: Oct. 17, 2023

(54) PERSONAL PROTECTIVE EQUIPMENT SYSTEM FOR SAFE AIR, TRAIN OR BUS TRAVEL PROTECTING AGAINST INFECTIOUS AGENTS INCLUDING NOVEL CORONAVIRUS—COVID-19

(71) Applicant: Noah Lang, Franconia, NH (US)

(72) Inventor: Noah Lang, Franconia, NH (US)

( * ) Notice: Subject to any disclaimer, the term of this patent is extended or adjusted under 35 U.S.C. 154(b) by 282 days.

(21) Appl. No.: 17/334,963

(22) Filed: May 31, 2021

(65) Prior Publication Data

US 2022/0008756 A1 Jan. 13, 2022

Related U.S. Application Data

(63) Continuation of application No. 16/933,935, filed on Jul. 20, 2020, now abandoned.

(60) Provisional application No. 63/050,851, filed on Jul. 12, 2020, provisional application No. 63/045,149, filed on Jun. 28, 2020, provisional application No. 62/705,092, filed on Jun. 10, 2020.

(51) Int. Cl.

| | |
|---|---|
| ***A62B 23/02*** | (2006.01) |
| ***A62B 7/10*** | (2006.01) |
| ***A41D 13/11*** | (2006.01) |
| ***A62B 18/02*** | (2006.01) |
| ***A62B 9/02*** | (2006.01) |
| ***A62B 18/00*** | (2006.01) |

(52) U.S. Cl.

CPC ..... *A62B 7/10* (2013.01); *A41D 13/11* (2013.01); *A62B 9/02* (2013.01); *A62B 18/006* (2013.01); *A62B 18/025* (2013.01); *A62B 23/02* (2013.01)

(58) Field of Classification Search

CPC ..... A61M 16/105; A62B 7/10; A62B 7/12; A62B 7/14; A62B 23/00; A62B 23/02; A62B 23/025

See application file for complete search history.

(56) References Cited

U.S. PATENT DOCUMENTS

| | | | | |
|---|---|---|---|---|
| 3,971,373 A | | 7/1976 | Braun | |
| 4,215,682 A | | 8/1980 | Kubik et al. | |
| 4,433,684 A | * | 2/1984 | Sarnoff | A61M 15/00 128/203.29 |
| 4,536,440 A | | 8/1985 | Berg | |
| 4,601,287 A | | 7/1986 | Royce, Jr. | |
| 4,651,278 A | * | 3/1987 | Herzog | G06F 3/1206 358/1.18 |
| 4,674,492 A | * | 6/1987 | Niemeyer | A62B 9/006 128/206.17 |
| 4,793,342 A | * | 12/1988 | Haber | A62B 17/04 128/205.24 |
| 4,807,619 A | | 2/1989 | Dyrud | |
| 4,850,347 A | | 7/1989 | Skov | |
| 4,856,509 A | | 8/1989 | Emelson | |
| 5,307,796 A | | 5/1994 | Kronzer et al. | |

(Continued)

FOREIGN PATENT DOCUMENTS

| | | |
|---|---|---|
| CA | 2941626 | 9/2015 |
| WO | 95/07175 | 3/1995 |

(Continued)

*Primary Examiner* — Michael J Tsai

(57) ABSTRACT

Aspects of the invention relate to personal protection systems against COVID-19 including face masks and methods, systems or devices of managing, regulating and/or filtering airflow during travel on an aircraft, train, or bus.

4 Claims, 32 Drawing Sheets

(56) References Cited

U.S. PATENT DOCUMENTS

| | | | | |
|---|---|---|---|---|
| 5,318,019 | A * | 6/1994 | Celaya | A62B 7/02 128/205.12 |
| 5,709,204 | A * | 1/1998 | Lester | A62B 7/10 128/203.29 |
| 5,715,814 | A | 2/1998 | Ebers | |
| 5,720,280 | A * | 2/1998 | Elstran | A62B 7/02 128/206.28 |
| 6,196,223 | B1 | 3/2001 | Belfer | |
| 6,197,709 | B1 | 3/2001 | Tsai et al. | |
| 6,214,094 | B1 * | 4/2001 | Rousseau | B03C 3/28 55/DIG. 35 |
| 6,341,606 | B1 | 1/2002 | Bordewick | |
| 6,460,539 | B1 | 8/2002 | Japuntich | |
| 6,536,428 | B1 | 3/2003 | Smith | |
| 6,581,594 | B1 | 6/2003 | Drew | |
| 6,637,434 | B2 | 10/2003 | Noble | |
| 8,722,963 | B2 | 5/2014 | Kanya et al. | |
| 9,878,120 | B2 | 1/2018 | White | |
| 10,335,569 | B2 | 7/2019 | Beard et al. | |
| 2005/0079379 | A1 | 4/2005 | Wadsworth et al. | |
| 2007/0095348 | A1 * | 5/2007 | Fisher | A61M 16/06 128/207.11 |
| 2012/0186282 | A1 * | 7/2012 | Army | B64D 13/00 62/93 |
| 2016/0367842 | A1 | 12/2016 | Koehler | |
| 2019/0374736 | A1 | 12/2019 | Huddart et al. | |
| 2020/0297962 | A1 * | 9/2020 | Teng | A61M 16/0875 |

FOREIGN PATENT DOCUMENTS

| | | |
|---|---|---|
| WO | 2000/050121 | 8/2000 |
| WO | 2000/076568 | 12/2000 |
| WO | 2019/222668 A1 | 11/2019 |

* cited by examiner

PERSONAL PROTECTIVE EQUIPMENT SYSTEM FOR SAFE AIR, TRAIN OR BUS TRAVEL PROTECTING AGAINST INFECTIOUS AGENTS INCLUDING NOVEL CORONAVIRUS—COVID-19

RELATED APPLICATIONS

This application is a continuation patent application of U.S. application Ser. No. 16/933,935, filed Jul. 20, 2020, which claims the benefit of and the priority to U.S. Provisional Patent Application Ser. No. 62/705,092, filed Jun. 10, 2020, U.S. Provisional Patent Application Ser. No. 63/045,149, filed Jun. 28, 2020 and U.S. Provisional Patent Application Ser. No. 63/050,851, filed Jul. 12, 2020, the content of each of which is incorporated herein by reference in its entirety.

TECHNICAL FIELD

Aspects of the invention relate to personal protection systems including face masks and methods, systems of devices of managing or regulating airflow during travel on an aircraft.

BACKGROUND

Current personal protection equipment, e.g. breathable face masks, offer only partial protection from infectious agents such as bacteria or viruses. Thus, a limited quantity of airborne particles may still be inhaled during air travel, in particular when seated next to another passenger infected with an airborne agent, e.g. novel coronavirus COVID-19.

SUMMARY

Personal protection systems for providing filtered air to a person are provided. In some embodiments the system for providing filtered air to a person comprises a face mask, two or more connectors comprising a first connector configured to be connected to an air vent, and a second connector configured to integrated or connected to the face mask, a tube, and a valve, wherein the face mask comprises at least one of a filtering barrier, a filtering portion, a particulate filtering portion, a particulate filtering facepiece, a particulate filtering facepiece respirator, or a mechanical filter respirator configured to allow breathing through the face mask and configured for filtering air, wherein the tube is configured to be connected to the first connector and to the second connector, wherein the tube and the connectors are configured to deliver air from the air vent to at least one of a nose or mouth of the person, wherein the valve is configured to block air flow through the second connector when the tube is not connected to the second connector.

In some embodiments, the filtering barrier, filtering portion, particulate filtering portion, particulate filtering facepiece, particulate filtering facepiece respirator, or mechanical filter respirator is configured to filter particles and droplets comprising COVID-19.

In some embodiments, the system is configured to allow a greater volume of air per unit time delivered through the air vent, tube and the two or more connectors than the volume of air per unit time delivered through the filtering barrier, filtering portion, particulate filtering portion, particulate filtering facepiece, particulate filtering facepiece respirator, or mechanical filter respirator of the face mask when the tube is connected to the air vent and the two or more connectors.

In some embodiments, the system is configured to allow a lower airflow resistance of the air vent, tube and the two or more connectors than the airflow resistance of the filtering barrier, filtering portion, particulate filtering portion, particulate filtering facepiece, particulate filtering facepiece respirator, or mechanical filter respirator of the face mask.

In some embodiments, the tube and the two or more connectors are configured to deliver a tidal volume of air to the face mask.

In some embodiments, the tube and the two or more connectors are configured to deliver a volume that is greater than a tidal volume of air to the face mask.

In some embodiments, the tube and the two or more connectors are configured to deliver a portion of a tidal volume of air to the face mask.

In some embodiments, the portion of the tidal volume is at least one of 50% of the tidal volume, 60% of the tidal volume, 70% of the tidal volume, 80% of the tidal volume, 90% of the tidal volume, or 95% of the tidal volume.

In some embodiments, the airflow resistance of the tube and the two or more connectors is less than the airflow resistance of the at least one filtering barrier, filtering portion, particulate filtering portion, particulate filtering facepiece, particulate filtering facepiece respirator, or mechanical filter respirator of the face mask.

In some embodiments, the system is configured so that an inspiratory force required for breathing from the tube and the two or more connectors is less than the inspiratory force required for breathing through the at least one filtering barrier, filtering portion, particulate filtering portion, particulate filtering facepiece, particulate filtering facepiece respirator, or mechanical filter respirator of the face mask.

In some embodiments, the system is configured to adjust the airflow from the air vent responsive to aircraft cabin air pressure.

In some embodiments, the air delivered from the air vent through the tube is filtered air. In some embodiments, the air is filtered by an aircraft ventilation system, a train ventilation system, or a bus ventilation system.

In some embodiments, the face mask is configured to filter inhaled air using the at least one filtering barrier, filtering portion, particulate filtering portion, particulate filtering facepiece, particulate filtering facepiece respirator, or mechanical filter respirator.

In some embodiments, the face mask is configured to filter inhaled air using the at least one filtering barrier, filtering portion, particulate filtering portion, particulate filtering facepiece, particulate filtering facepiece respirator, or mechanical filter respirator, when the tube is not connected to the second connector.

In some embodiments, the valve is configured to block air flow from the second connector when the tube is not connected to the second connector and to allow air to flow when the tube is connected to the second connector.

In some embodiments, the system further comprises a third connector.

In some embodiments, the tube is configured to deliver contained airflow from the air vent to the face mask.

In some embodiments, the air vent is an air vent in a plane, a train, or a bus.

In some embodiments, the face mask comprises a peripheral portion configured to conform to the face of the person, the peripheral portion comprising a seal configured to provide a substantially airtight seal.

In some embodiments, the system for providing filtered air to a person comprises a face mask, a connector integrated or connected to the face mask, a tube, and a valve, wherein the face mask comprises at least one of a filtering barrier, a filtering portion, a particulate filtering portion, a particulate filtering facepiece, a particulate filtering facepiece respirator, or a mechanical filter respirator configured to allow breathing through the face mask and configured for filtering air, wherein the tube is configured to be connected to an air vent, wherein the tube is configured to be connected to the connector integrated or connected to the face mask, wherein the tube and the connector are configured to deliver air from the air vent to at least one of a nose or mouth of the person, wherein the valve is configured to block air flow through the connector when the tube is not connected to the connector and to allow air to flow when the tube is connected to the connector.

In some embodiments, the filtering barrier, filtering portion, particulate filtering portion, particulate filtering facepiece, particulate filtering facepiece respirator, or mechanical filter respirator is configured to filter particles and droplets comprising COVID-19.

In some embodiments, the system is configured to allow a greater volume of air per unit time delivered through the air vent, tube and the connector than the volume of air per unit time delivered through the filtering barrier, filtering portion, particulate filtering portion, particulate filtering facepiece, particulate filtering facepiece respirator, or mechanical filter respirator of the face mask when the tube is connected to the air vent and the connector.

In some embodiments, the system is configured to allow a lower airflow resistance of the air vent, tube and the connector than the airflow resistance of the filtering barrier, filtering portion, particulate filtering portion, particulate filtering facepiece, particulate filtering facepiece respirator, or mechanical filter respirator of the face mask.

In some embodiments, the tube and the connector are configured to deliver a tidal volume of air to the face mask.

In some embodiments, the tube and the connector are configured to deliver a volume that is greater than a tidal volume of air to the face mask.

In some embodiments, the tube and the connector are configured to deliver a portion of a tidal volume of air to the face mask.

In some embodiments, the portion of the tidal volume is at least one of 50% of the tidal volume, 60% of the tidal volume, 70% of the tidal volume, 80% of the tidal volume, 90% of the tidal volume, or 95% of the tidal volume.

In some embodiments, the airflow resistance of the tube and the connector is less than the airflow resistance of the at least one filtering barrier, filtering portion, particulate filtering portion, particulate filtering facepiece, particulate filtering facepiece respirator, or mechanical filter respirator of the face mask.

In some embodiments, the system is configured so that an inspiratory force required for breathing from the tube and the connector is less than the inspiratory force required for breathing through the at least one filtering barrier, filtering portion, particulate filtering portion, particulate filtering facepiece, particulate filtering facepiece respirator, or mechanical filter respirator of the face mask.

In some embodiments, the system is configured to adjust the airflow from the air vent responsive to aircraft cabin air pressure.

In some embodiments, the air delivered from the air vent through the tube is filtered air. In some embodiments, the air is filtered by an aircraft ventilation system.

In some embodiments, the face mask is configured to filter inhaled air using the at least one filtering barrier, filtering portion, particulate filtering portion, particulate filtering facepiece, particulate filtering facepiece respirator, or mechanical filter respirator.

In some embodiments, the face mask is configured to filter inhaled air using the at least one filtering barrier, filtering portion, particulate filtering portion, particulate filtering facepiece, particulate filtering facepiece respirator, or mechanical filter respirator, when the tube is not connected to the connector.

In some embodiments, the system further comprises a second connector.

In some embodiments, the tube is configured to deliver contained airflow from the air vent to the face mask.

In some embodiments, the air vent is an air vent in a plane, a train, or a bus.

In some embodiments, the face mask comprises a peripheral portion configured to conform to the face of the person, the peripheral portion comprising a seal configured to provide a substantially airtight seal.

In some embodiments, the mask is disposable.

In some embodiments, a system is provided, the system comprising a disposable mask configured to cover the nose and mouth of a person, the mask comprising a breathable portion, wherein the breathable portion comprises a mechanical filter respirator or an air filter, a non-breathable portion, wherein the non-breathable portion comprises a connecting mechanism for a tube, wherein the tube is configured to deliver an airflow, wherein the connecting mechanism comprises a valve, wherein the valve is configured to block the air flow through the connecting mechanism when the tube is not connected to the connecting mechanism, and wherein the inspiratory force breathing the airflow delivered by the tube is less than the inspiratory force breathing through the mechanical filter respirator or the air filter when the tube is connected.

In some embodiments, the filtering barrier, filtering portion, particulate filtering portion, particulate filtering facepiece, particulate filtering facepiece respirator, or mechanical filter respirator is configured to filter particles and droplets comprising COVID-19.

In some embodiments, the system is configured to allow a greater volume of air per unit time delivered through the air vent, tube and the connecting mechanism than the volume of air per unit time delivered through the filtering barrier, filtering portion, particulate filtering portion, particulate filtering facepiece, particulate filtering facepiece respirator, or mechanical filter respirator of the face mask when the tube is connected to the air vent and the connector.

In some embodiments, the system is configured to allow a lower airflow resistance of the air vent, tube and the connecting mechanism than the airflow resistance of the filtering barrier, filtering portion, particulate filtering portion, particulate filtering facepiece, particulate filtering facepiece respirator, or mechanical filter respirator of the face mask.

In some embodiments, the tube and the connecting mechanism are configured to deliver a tidal volume of air to the face mask.

In some embodiments, the tube and the connecting mechanism are configured to deliver a volume that is greater than a tidal volume of air to the face mask.

In some embodiments, the tube and the connecting mechanism are configured to deliver a portion of a tidal volume of air to the face mask.

In some embodiments, the portion of the tidal volume is at least one of 50% of the tidal volume, 60% of the tidal volume, 70% of the tidal volume, 80% of the tidal volume, 90% of the tidal volume, or 95% of the tidal volume.

In some embodiments, the airflow resistance of the tube and the connecting mechanism is less than the airflow resistance of the at least one filtering barrier, filtering portion, particulate filtering portion, particulate filtering facepiece, particulate filtering facepiece respirator, or mechanical filter respirator of the face mask.

In some embodiments, the system is configured so that an inspiratory force required for breathing from the tube and the connecting mechanism is less than the inspiratory force required for breathing through the at least one filtering barrier, filtering portion, particulate filtering portion, particulate filtering facepiece, particulate filtering facepiece respirator, or mechanical filter respirator of the face mask.

In some embodiments, the system is configured to adjust the airflow from the air vent responsive to aircraft cabin air pressure.

In some embodiments, the air delivered from the air vent through the tube is filtered air. In some embodiments, the air is filtered by an aircraft ventilation system.

In some embodiments, the face mask is configured to filter inhaled air using the at least one filtering barrier, filtering portion, particulate filtering portion, particulate filtering facepiece, particulate filtering facepiece respirator, or mechanical filter respirator.

In some embodiments, the face mask is configured to filter inhaled air using the at least one filtering barrier, filtering portion, particulate filtering portion, particulate filtering facepiece, particulate filtering facepiece respirator, or mechanical filter respirator, when the tube is not connected to the connecting mechanism.

In some embodiments, the tube is configured to deliver contained airflow from the air vent to the face mask.

In some embodiments, the air vent is an air vent in a plane, a train, or a bus.

In some embodiments, the face mask comprises a peripheral portion configured to conform to the face of the person, the peripheral portion comprising a seal configured to provide a substantially airtight seal.

DETAILED DESCRIPTION

Figure 1:
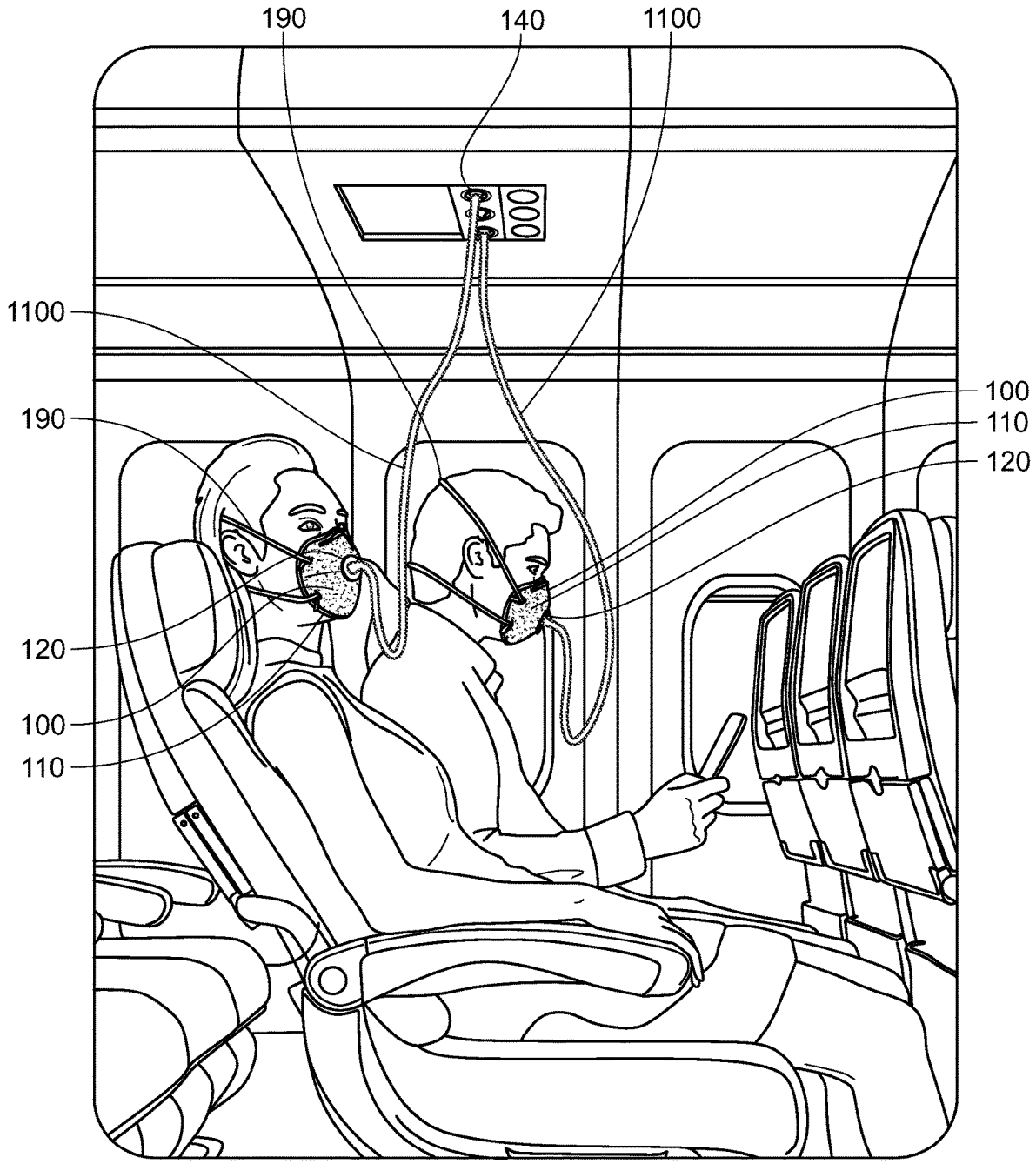
FIG. 1 is an illustrative, non-limiting example of face masks worn by airplane passengers comprising a mechanical respirator portion, a connector or connecting piece, a tube for contained air supply connecting to an air vent according to some embodiments.
Figure 2:
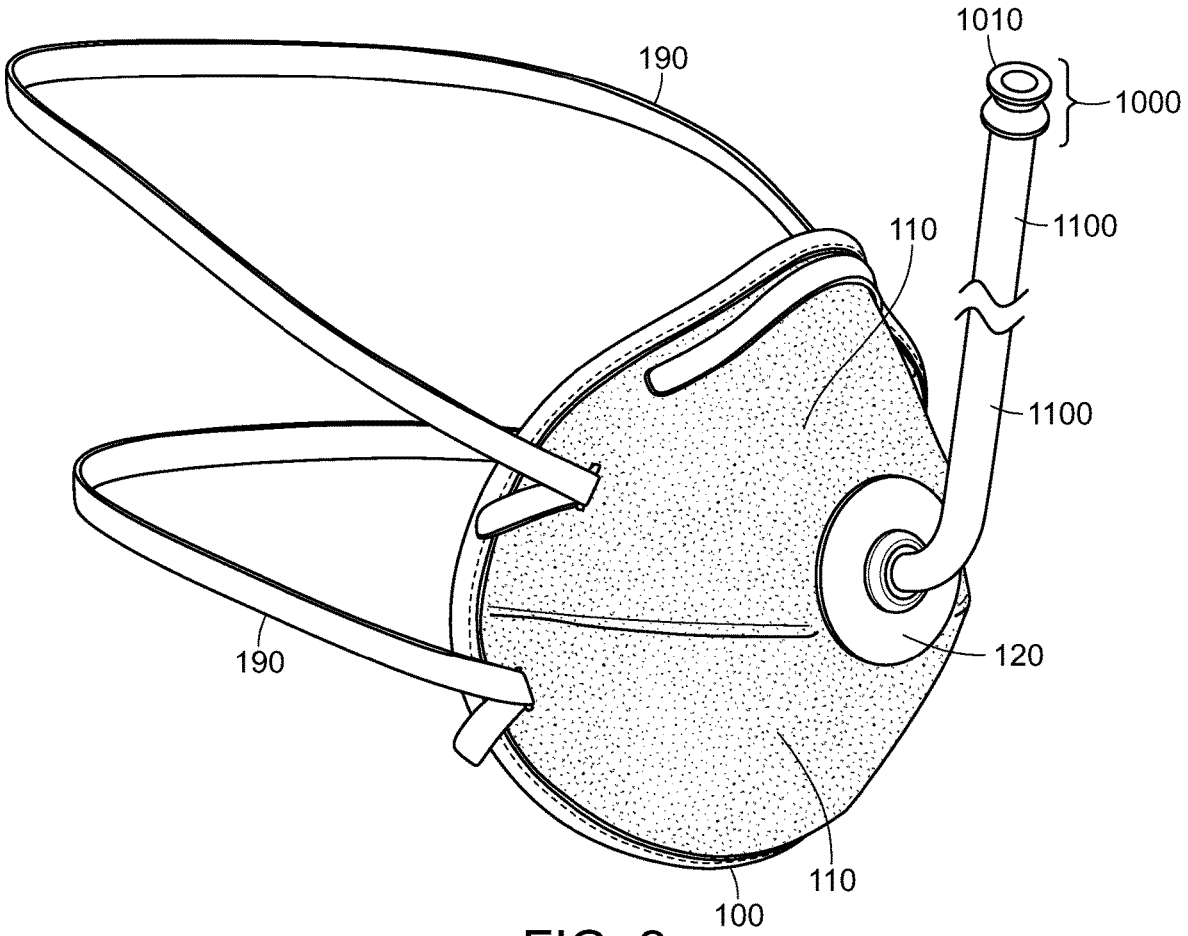
FIG. 2 is an illustrative, non-limiting example of a face mask comprising a mechanical respirator portion, a connector or connecting piece, a tube for contained air supply connecting to an air vent according to some embodiments.

In some embodiments, an airline passenger can wear personal protection equipment (PPE) during air travel, e.g. when boarding an aircraft and while on the aircraft (FIGS. 1 and 2.). The PPE can comprise a face mask 100. The face mask can be a surgical mask style face mask, for example, with 1, 2, 3, 4, 5 or more layers of a filtering material. The face mask can include a respirator portion. The face mask can include a particulate filtering portion, particulate filtering facepiece, particulate filtering facepiece respirator, mechanical filter respirator 110. The particulate filtering portion, particulate filtering facepiece, or particulate filtering facepiece respirator 110 can, for example, meet the standards of the U.S. National Institute for Occupational Safety and Health (NIOSH), for example, respirator classes N95, R95, P95, N99, R99, P99, N100, R100, P100, HE. The particulate filtering portion, particulate filtering facepiece, or particulate filtering facepiece respirator 110 can, for example, meet the standards of the European Union, e.g. FFP2 or FFP3, or the People's Republic of China, e.g. KN95.

A particulate, as used throughout the application, can comprise an aerosol, for example an aerosol containing droplets generated by and/or exhaled by a passenger. Droplets can contain pathogens, for example bacteria, viruses, and/or prions. Viruses can include, for example, influenza or corona viruses, e.g. novel coronal virus. Aerosols and/or droplets can comprise any airborne pathogen, e.g. anthrax, Ebola virus, Marburg virus, Lyssa virus etc.

In any of the embodiments through the specification, a face mask, a filter, e.g. an air filter, a filtering portion, a particulate filtering portion, a particulate filtering facepiece, a particulate filtering facepiece respirator, or a mechanical filter respirator can be worn by a healthy, e.g. uninfected passenger. In any of the embodiments through the specification, a face mask, a filter, e.g. an air filter, a filtering portion, a particulate filtering portion, a particulate filtering facepiece, a particulate filtering facepiece respirator, or a mechanical filter respirator can be worn by a passenger infected with a pathogen, including but not limited to novel coronavirus, not displaying symptoms, e.g. asymptomatic. In any of the embodiments through the specification, a face mask, a filter, e.g. an air filter, a filtering portion, a particulate filtering portion, a particulate filtering facepiece, a particulate filtering facepiece respirator, or a mechanical filter respirator can be worn by a passenger infected with a pathogen, e.g. novel coronavirus, displaying symptoms, e.g. a symptomatic passenger, for example with a fever, a runny nose, and/or a cough. In any of the embodiments through the specification, a face mask, a filter, e.g. an air filter, a filtering portion, a particulate filtering portion, a particulate filtering facepiece, a particulate filtering facepiece respirator, or a mechanical filter respirator can be can be configured to prevent the spread, e.g. the exhalation, of an airborne pathogen by an infected passenger. In any of the embodiments through the specification, a face mask, a filter, e.g. an air filter, a filtering portion, a particulate filtering portion, a particulate filtering facepiece, a particulate filtering facepiece respirator, or a mechanical filter respirator can be can be configured to prevent or reduce the inhalation of an airborne pathogen by an uninfected passenger.

As used herein, "tidal volume" (TV) refers to the volume of air moved into or out of the lungs during normal breathing at rest, e.g. while sitting in an aircraft. Tidal volume is the volume of air inhaled or exhaled in a single breath while at rest (FIG. 3B).

As used herein, "total lung capacity" (TLC) refers to the volume in the lungs at maximal inflation. It is the sum of vital capacity and residual volume (FIG. 3A).

Figure 3A:
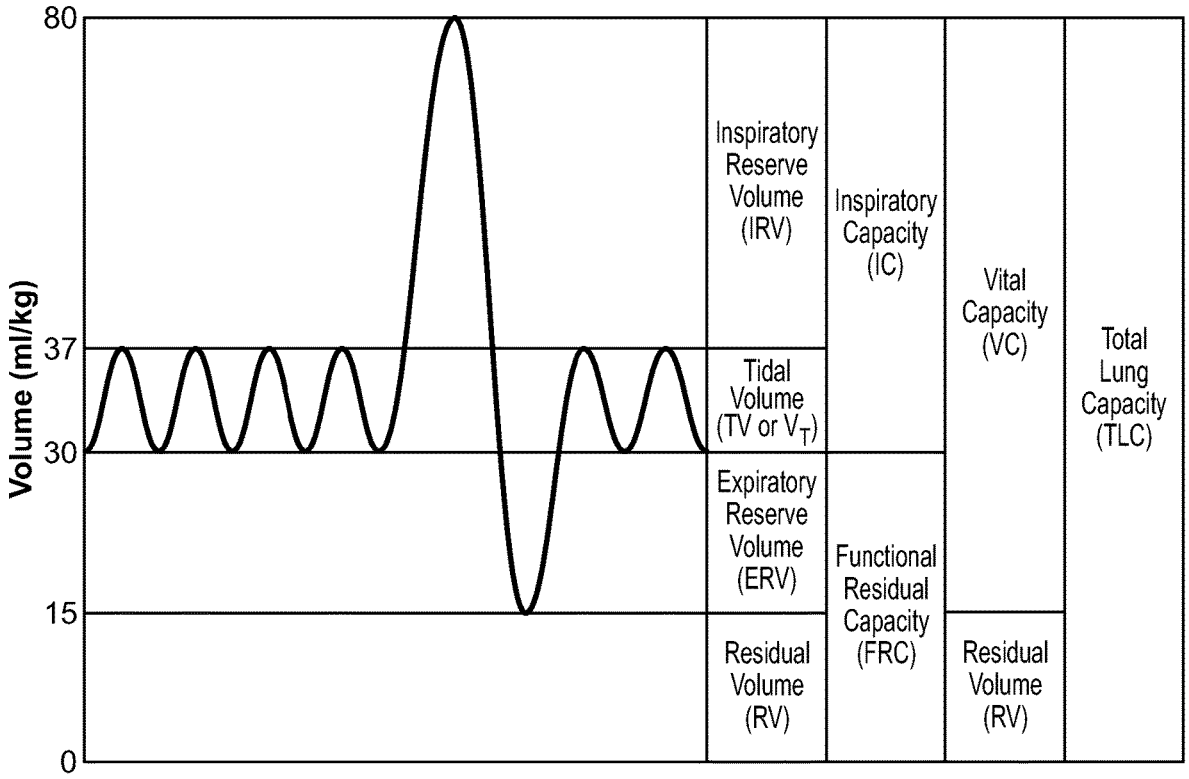
FIGS. 3A-3B are illustrative examples of pulmonary volumes, for example during inspiration or expiration, as well as tidal volume, airflow, and alveolar pressure during inspiration or expiration.
Figure 3B:
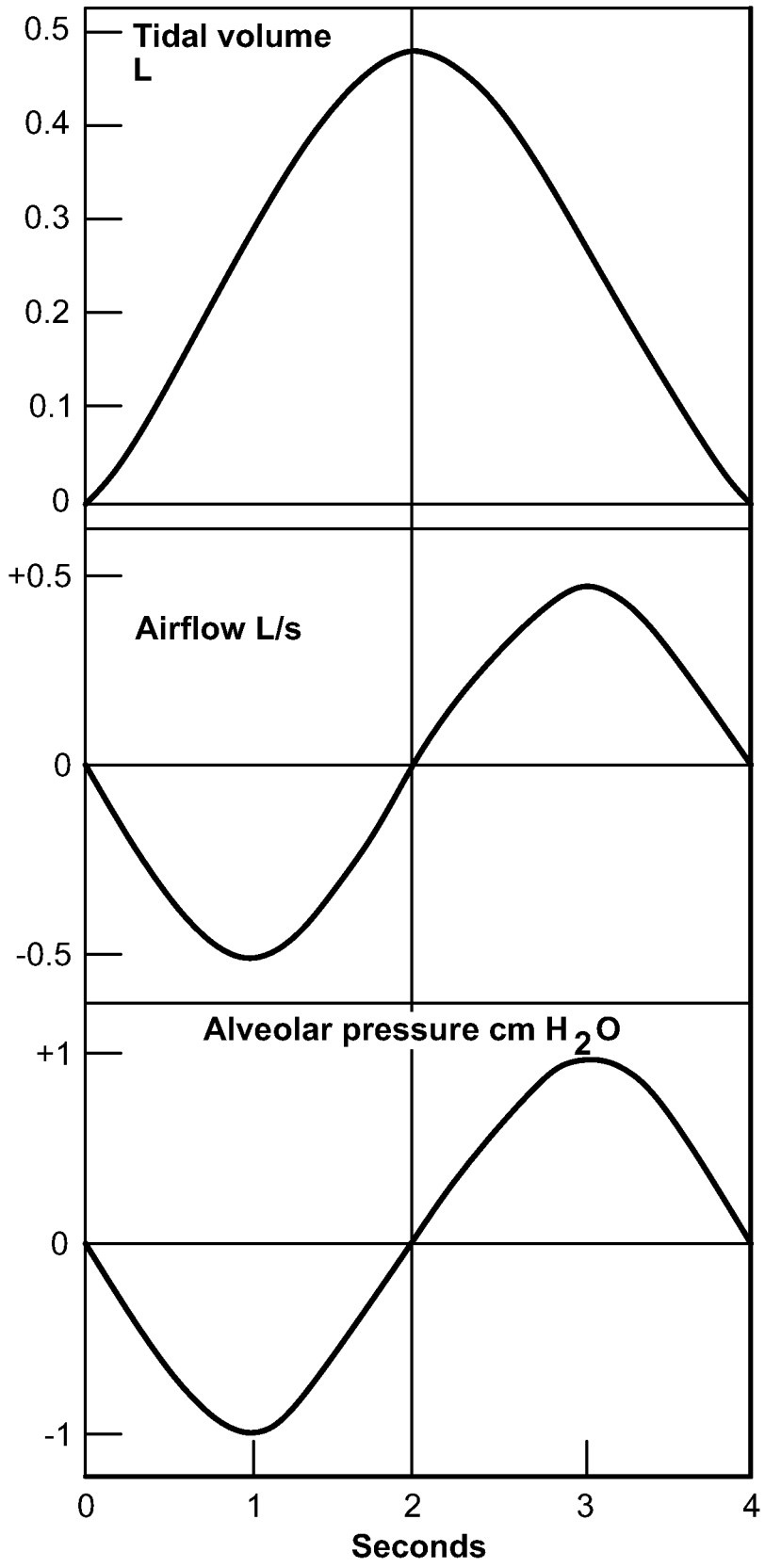

As used herein, "residual volume" (RV) refers to the volume of air remaining in the lungs after maximal exhalation (FIG. 3A).

As used herein, "vital capacity" (VC) refers to the greatest volume of air that can be exhaled from the lungs after the maximum inspiration or inhalation, i.e. after taking the deepest possible breath (FIG. 3A). Vital capacity (VC) is the volume of air exhaled after the deepest inhalation (FIG. 3A).

As used herein "expiratory reserve volume" (ERV) refers to the maximal volume of air that can be exhaled from an end-expiratory position (FIG. 3A).

As used herein "inspiratory reserve volume" (IRV) refers to the maximal volume of air that can be inhaled from an end-inspiratory position (FIG. 3A).

As used herein "Inspiratory capacity" (IC) refers to the sum of inspiratory reserve volume and tidal volume (FIG. 3).

As used herein "Inspiratory vital capacity" (IVC) refers to the maximum volume of air inhaled from the point of maximum expiration (FIG. 3A).

As used herein "Functional residual capacity" (FRC) refers to the volume in the lungs at the end-expiratory position (FIG. 3A).

As used herein "Actual volume" (AV) of the lung refers to the volume of air in the lung plus the conducting airway, e.g. trachea and bronchi.

As used herein "Forced vital capacity" (FRC) refers to the determination of the vital capacity based on a maximally forced expiratory effort.

As used herein "FEV1" refers to the volume of air that has been exhaled at the end of the first second of forced exhalation.

As used herein "FEVt" refers to the volume of air that has been exhaled under forced exhalation at the end of seconds t.

As used herein "Forced inspiratory flow" (FIF) refers to a measurement of the forced inspiratory curve. Maximum inspiratory flow is denoted as FIFmax.

As used herein "Peek expiratory flow" (PEF) refers to the highest forced expiratory flow, for example measured with a peak flow meter.

As used herein "Maximum voluntary ventilation" (MVV) refers to the volume of air expired in a specified period during repetitive maximal effort.

The inspiratory force or the negative inspiratory force is a measurement of respiratory muscle strength or respiratory muscle force exerted.

The inspiratory force can be the force required to breathe air, e.g. through a face mask, a mechanical filter respirator, an air filter, a contained air flow, or combinations thereof.

Respiratory muscle strength can also be assessed by measuring the maximal inspiratory pressure (MIP), and the maximal expiratory pressure (MEP). The MIP can reflect the strength of the diaphragm and other inspiratory muscles, while the MEP can reflect the strength of the abdominal muscles and other expiratory muscles. An alternative test of inspiratory muscle strength can be the maximal sniff nasal inspiratory pressure (SNIP). MIP, MEP, and SNIP can optionally be assessed while the user is breathing through a face mask, particulate filtering portion, particulate filtering facepiece, particulate filtering facepiece respirator, mechanical filter respirator, an air filter, or breathing in contained airflow, e.g. from a tube connected to an air vent or aircraft ventilation system.

Airflow resistance can be the resistance of air going through a material or, for example, a tube; it can, for example, be expressed by the ratio of pressure gradient in a material to airflow linear velocity in steady airflow conditions. Air flow resistance can also be defined as the ratio of static gas pressure between both sides of material to the airflow speed.

Tidal volume, inspiratory capacity and any of the foregoing pulmonary related volumes can vary based on passenger size, weight, gender, race, and/or underlying medical conditions. Tidal volume, inspiratory capacity and any of the foregoing pulmonary related volumes as used throughout the specification can be selected for minimum and/or maximum values, median values, average values, ranges, or any other statistical metric or parameter for or describing or encompassing or accommodating different passenger size, weight, gender, race, and/or underlying medical conditions.

Efficiency can be the efficiency of a mechanical filter respirator 110 or an air filter 600 in removing particles, e.g. droplets, bacteria, viruses, prions. It can be the no. or percentage of particles removed, e.g. 99%, 95%, 90%, 85% etc.

Flow resistivity can be defined as the airflow resistance within unit of thickness. It can reflect the air permeability, e.g. of a mechanical filter respirator or an air filter.

Leak can be the number of particles or percentage of particles that can get around a face seal. Penetration can be the number or percentage of particles that get through or penetrate a face mask, portions of a face mask, a mechanical barrier, a filtering barrier, a chemical barrier, a chemical absorbent, a mechanical filter respirator, an air filter.

Contained air flow can be air flow delivered through a tube, e.g. from an air vent. Contained air flow can be filtered, e.g. using an aircraft filtering unit, e.g. a HEPA filtering unit. Contained air flow can be mechanically or chemically filtered. Contained air flow can be purified or cleaned, e.g. using UV light sources, as described in the specification, including UVC, far UVC light, ultrasound etc.

Some embodiments relate to a system for providing filtered air to a person, the system comprising a face mask, a first connector or connecting piece configured to be connected or attached to an air vent, a second connector or connecting piece configured to integrated, connected or attached to the face mask, a tube, and a valve, wherein the face mask comprises at least one of a filtering barrier, a filtering portion, a particulate filtering portion, a particulate filtering facepiece, a particulate filtering facepiece respirator, or a mechanical filter respirator configured to allow breathing through the face mask and configured for filtering air, wherein the tube is configured to be connected to the first connector or connecting piece connected or attached to the air vent and the second connector or connecting piece integrated, connected or attached to the face mask, wherein the tube is configured to deliver air from the air vent to at least one of a nose or mouth of the person, wherein the valve is configured to block air flow from the second connector or connecting piece when the tube is not connected to the second connector or connecting piece, for example to facilitate breathing through the at least one of a filtering barrier, a filtering portion, a particulate filtering portion, a particulate filtering facepiece, a particulate filtering facepiece respirator, or a mechanical filter respirator.

In some embodiments, a system for providing filtered air to a person is provided, the system comprising a face mask, a connector or connecting piece integrated, connected or attached to the face mask, a tube, and a valve, wherein the face mask comprises at least one of a filtering barrier, a filtering portion, a particulate filtering portion, a particulate filtering facepiece, a particulate filtering facepiece respirator, or a mechanical filter respirator configured to allow breathing through the face mask and configured for filtering air, wherein the tube is configured to be connected to an air vent, wherein the tube is configured to be connected to the connector or connecting piece integrated, connected or attached to the face mask, wherein the tube is configured to deliver air from the air vent to at least one of a nose or mouth of the person (through the connector or connecting piece), wherein the valve is configured to block air flow from the connector or connecting piece when the tube is not connected to the connector or connecting piece, for example to facilitate breathing through the at least one of a filtering barrier, a filtering portion, a particulate filtering portion, a particulate filtering facepiece, a particulate filtering facepiece respirator, or a mechanical filter respirator.

In some embodiments, the volume or air per unit time delivered through the air vent, tube and connector can be greater than the volume per unit time delivered through the filtering barrier, filtering portion, particulate filtering portion, particulate filtering facepiece, particulate filtering facepiece respirator, or mechanical filter respirator of the face mask when the tube is connected to the air vent and the connector.

In some embodiments, the airflow resistance of the air vent, tube and connector can be less than the airflow resistance of the filtering barrier, filtering portion, particulate filtering portion, particulate filtering facepiece, particulate filtering facepiece respirator, or mechanical filter respirator of the face mask.

In some embodiments, the tube can deliver a tidal volume of air to the face mask. In some embodiments, the tube can deliver more than a tidal volume of air to the face mask. In some embodiments, the tube can deliver a portion of a tidal volume of air to the face mask. In some embodiments, the portion of the tidal volume can be at least one of 50% of the tidal volume, 60% of the tidal volume, 70% of the tidal volume, 80% of the tidal volume, 90% of the tidal volume, or 95% of the tidal volume.

In some embodiments, the airflow resistance of the connector or connecting piece and the tube can less than the airflow resistance of the at least one filtering barrier, filtering portion, particulate filtering portion, particulate filtering facepiece, particulate filtering facepiece respirator, or mechanical filter respirator of the face mask.

In some embodiments, an inspiratory force required for breathing from the connector or connecting piece and the tube can be less than the inspiratory force required for breathing through the at least one filtering barrier, filtering portion, particulate filtering portion, particulate filtering facepiece, particulate filtering facepiece respirator, or mechanical filter respirator of the face mask.

In some embodiments, the airflow from the air vent can be adjusted responsive to cabin air pressure.

In some embodiments, the air delivered from the air vent through the tube can filtered air. In some embodiments, the air can be filtered by the aircraft ventilation system. In some embodiments, the face mask can be configured to filter inhaled air using the at least one filtering barrier, filtering portion, particulate filtering portion, particulate filtering facepiece, particulate filtering facepiece respirator, or mechanical filter respirator. In some embodiments, the face mask can be configured to filter inhaled air using the at least one filtering barrier, filtering portion, particulate filtering portion, particulate filtering facepiece, particulate filtering facepiece respirator, or mechanical filter respirator, when the tube is not connected to the connector or connecting piece integrated, connected or attached to the face mask.

In some embodiments, the tube can be connected to an air vent using a second connector or connecting piece integrated into or attached to the air vent.

In some embodiments, the tube can deliver contained airflow from the air vent to the face mask.

In some embodiments, the air vent can be an air vent in a plane, a train, or a bus.

Straps or Tightening Members, Deformable Members

In some embodiments, the face mask can have one or more attached or integrated straps or tightening members 190. The straps or tightening members 190 can, for example, be elastic. The straps or tightening members 190 can extend behind the ears and, optionally, wrap around the ears to, e.g. in a U-shaped fashion or form with two attachments or origins on the face mask on each side, i.e. for the left ear and the right ear. Alternatively, the straps or tightening members 190 can extend behind the head, for example to the area of the occiput and/or the area of the neck. The straps or tightening members 190 can be made of cloth or plastic or any other suitable material known in the art. The straps or tightening members 190 can be configured so that they can be tied, for example in a knot or a loop.

The face mask can optionally comprise one or more deformable members 195, e.g. a metal or plastic strip, which can be configured so that the wearer of the face mask can form and/or deform the deformable member to achieve an optimal congruency and/or fit between the face mask, or at least a portion of the face mask, e.g. a nasal area portion, and the face of the user, or at least a portion of the face of the user, e.g. a nasal area.

Face Mask with Adhesive

Figure 4:
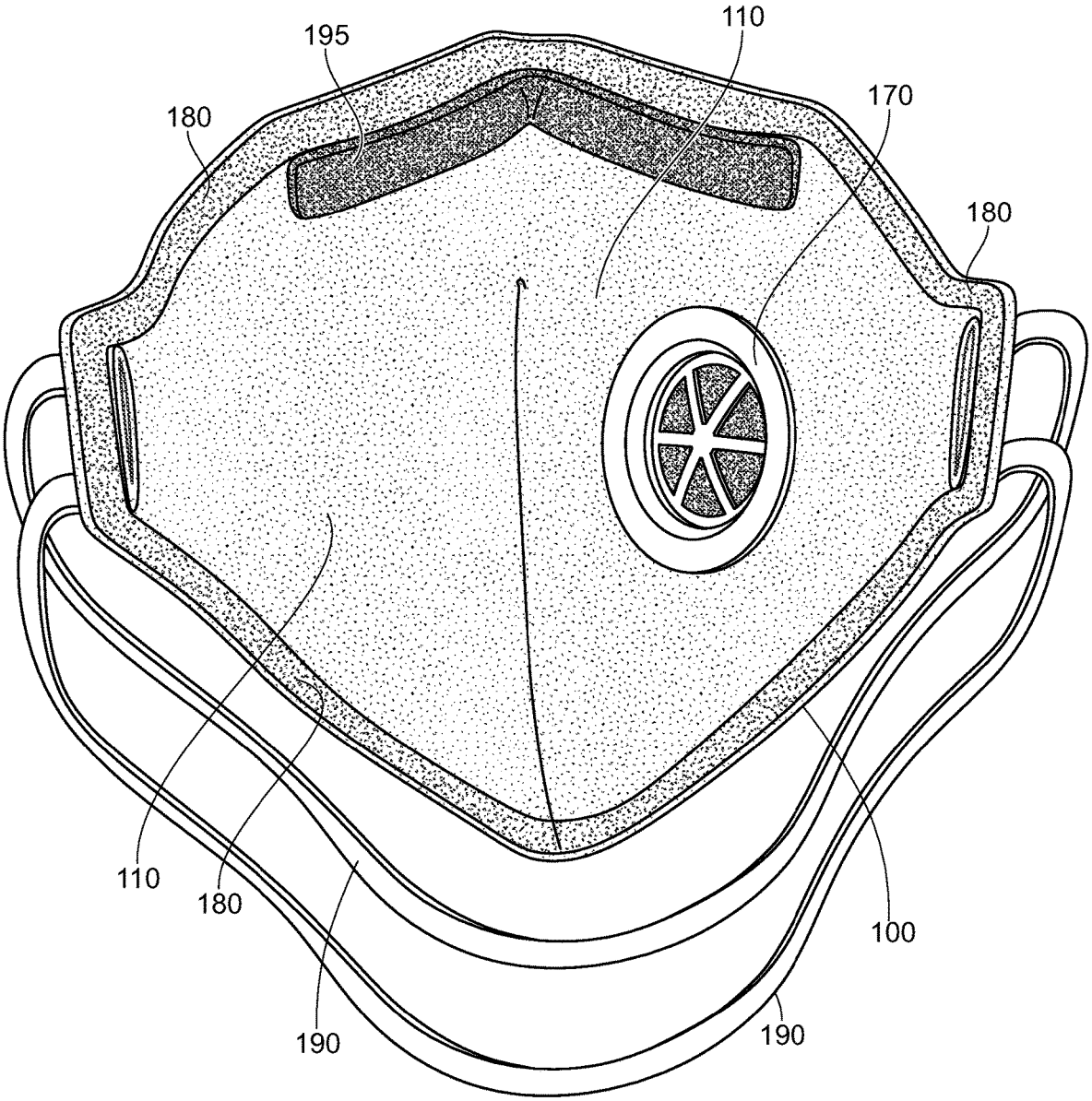
FIG. 4 is an illustrative, non-limiting example of a face mask comprising an adhesive, according to some embodiments.

In some embodiments, the periphery or the margin or at least portions of the periphery or the margin of the face mask 100 can include an adhesive 180 on the face facing portion or side of the face mask 100 (FIG. 4). The adhesive 180 can be located along the entire periphery or the margin of the face mask. The adhesive can be located along a portion of the periphery or the margin of the face mask. In this manner, the fit between the face mask and the user's face can be improved or can be made more tight or less accessible for air to enter or exit at the periphery or margin of the mask, e.g. during inhalation or exhalation or inspiration or expiration of the user of the mask. An adhesive can also be advantageous when the user is planning to sleep, for example during airplane travel. An adhesive 180 can help ensure that the face mask remains in place, for example when the user turns his or her head inadvertently with at least portions of the face mask touching or pushing against the seat, a pillow or a head cushion. In some embodiments, the user can wear a face mask that is adhesive free while he or she is awake. The user can switch to a face mask with adhesive 180 along at least a portion of or the entire periphery or margin of the face mask, when he or she decides to rest or sleep. Biocompatible adhesives, medical grade adhesives, and/or medical grade pressure sensitive adhesives (PSA) can be used. The tests for biocompatibility are, for example, described in the ISO 10993 standard, Biological Evaluation of Medical Devices. Cytotoxicity and MEM elution to ISO 10993-5 are in vitro tests, which can assess the toxic effects of adhesives on cells. Adhesives can, for example, comprise synthetic rubber adhesives, acrylate adhesives, silicon adhesives, silicon based adhesives, soft silicon gel adhesives, Adhesives can have a backing, e.g. a tape, woven or non-woven backing, a backing composed of polyesters, foams and polymeric films, such as polyurethane, polyethylene and polyester. The backing can be attached to or integrated into the face mask or at least a portion of the face mask, e.g. the periphery of the face mask.

Valves

Figure 5:
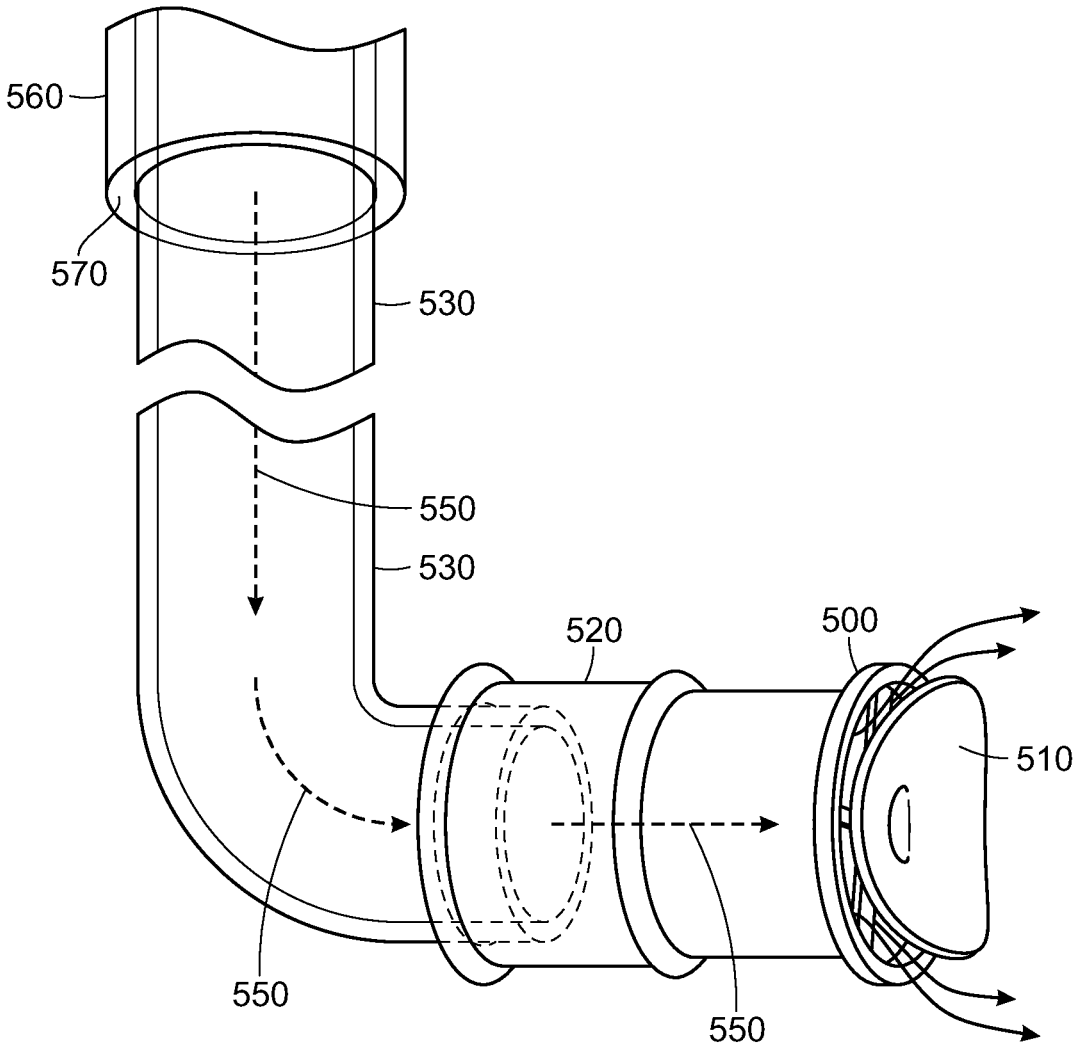
FIG. 5 is an illustrative, non-limiting example of a valve integrated or attached to a face mask, a connector, a connector piece, a tube according to some embodiments.

In some embodiments, the face mask 100 can comprise one or more valves or valve like mechanisms 170 (FIGS. 4 and 5). The valves can be configured to facilitate exhalation/expiration or inhalation/inspiration. For example, a valve can be configured to facilitate airflow for exhalation/expiration or inhalation/inspiration of the user. The valve can be configured to close with exhalation/expiration or inhalation/inspiration of the user. The valve can be configured to facilitate inspiration/inhalation while closing with expiration/exhalation, e.g. closing off exhalation into a tube, connector, connecting piece of reservoir. The valve can be configured to facilitate expiration/exhalation while closing off inspiration/inhalation. For example, a valve can be a disc type valve, butterfly valve, a ball type valve, a self closing type valve (e.g. FIG. 5), or any other type of valve known in the art (FIGS. 4 and 5). Any valve like mechanism known in the art can be used. FIG. 5 is an example of a flap valve 500, with a flap 510 that can close, for example with inspiration or expiration. The flap valve 500 can comprise a connecting piece 520 or can be included in a connector or connecting piece that is part of a face mask. The connecting piece 520 can also connect to a tube 530, e.g. transporting contained air flow 550, for example from an air vent 560. The tube can be connected to, placed over, or placed inside the air vent housing 570.

Figure 13A:
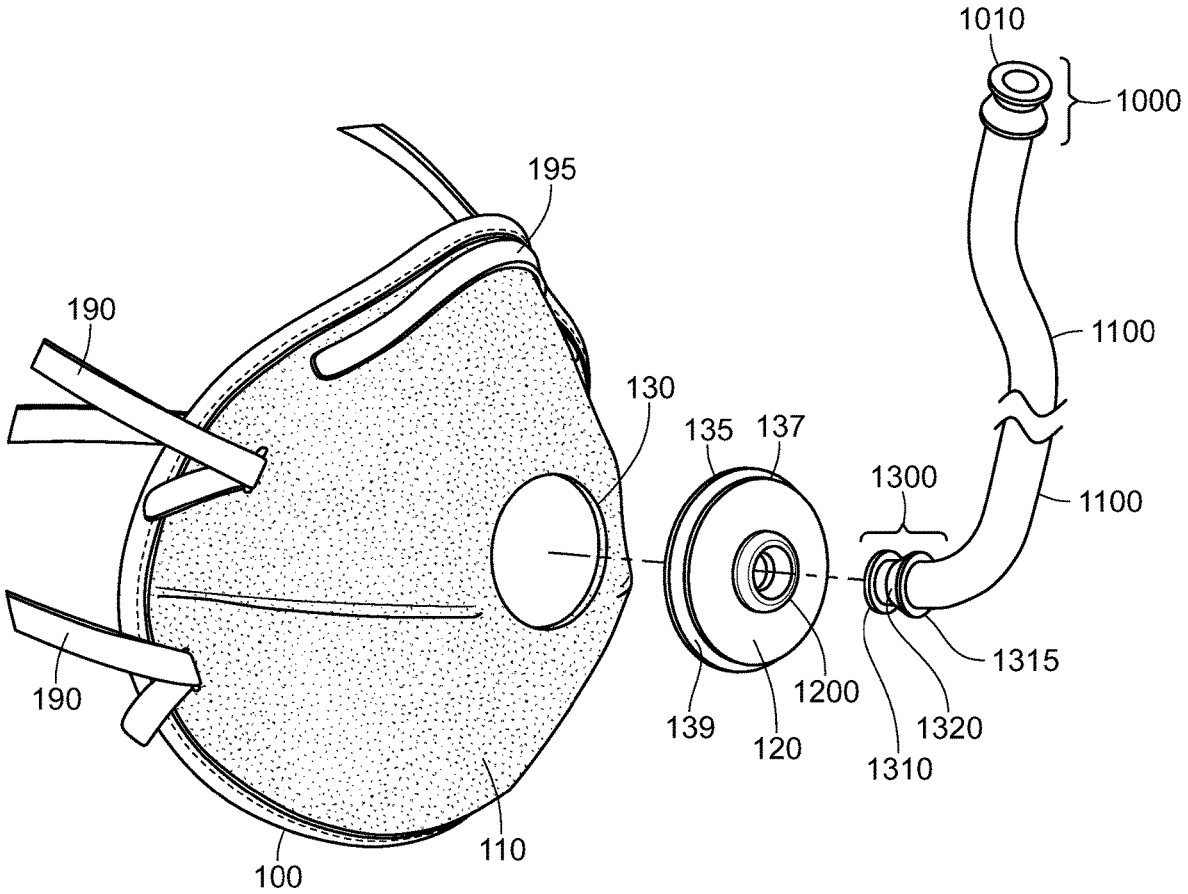
FIGS. 13A-13D are illustrative, non-limiting examples of components of a face mask with one or more connectors, connecting pieces, connector portions, or connector mechanisms for connecting, attaching, inserting or accepting a tube, optionally connected or attached to an air vent, supplying filtered air supply from the air vent, according to some embodiments. In some embodiments, the connectors, connecting pieces, connector portions, or connector mechanisms can comprise valves or valve mechanisms as well as gaskets.
Figure 13B:
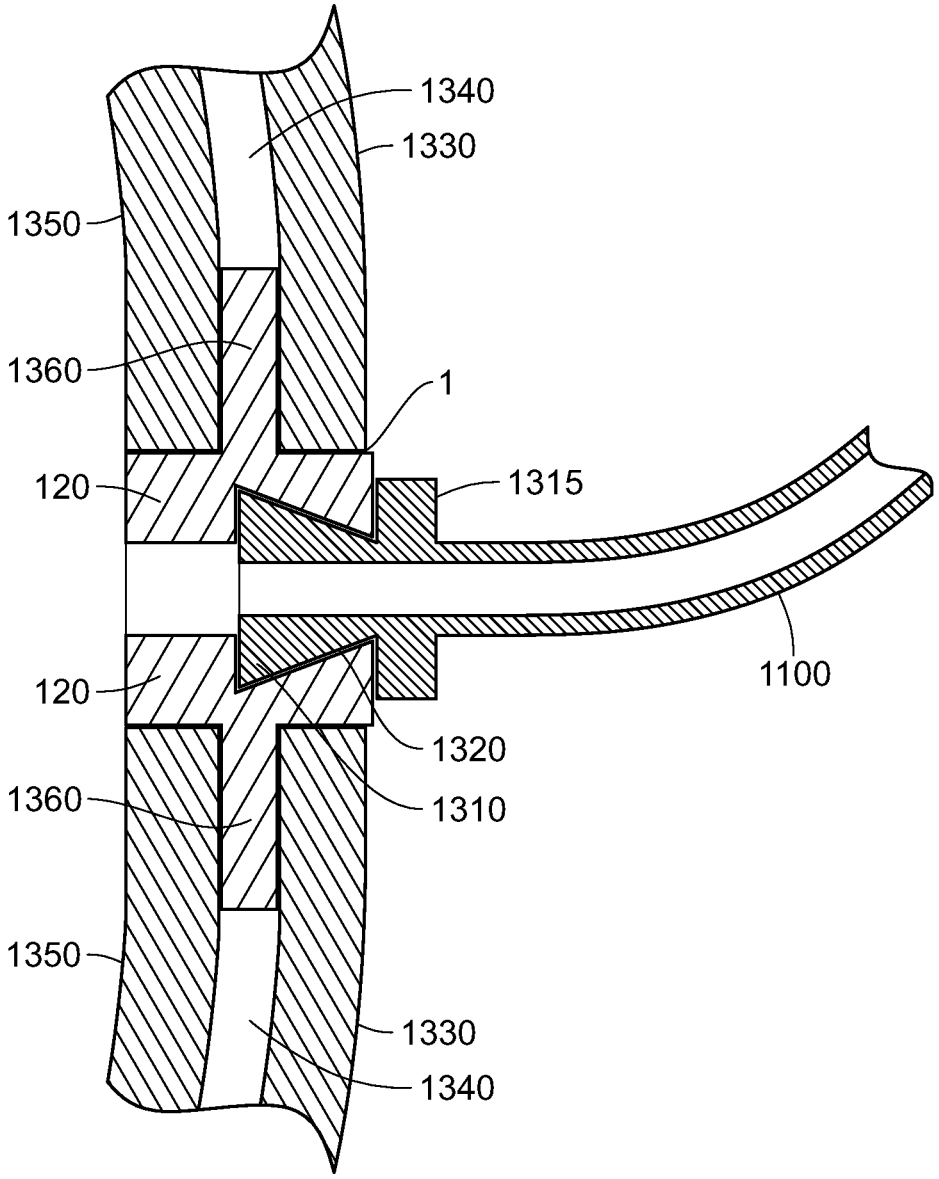
Figure 13C:
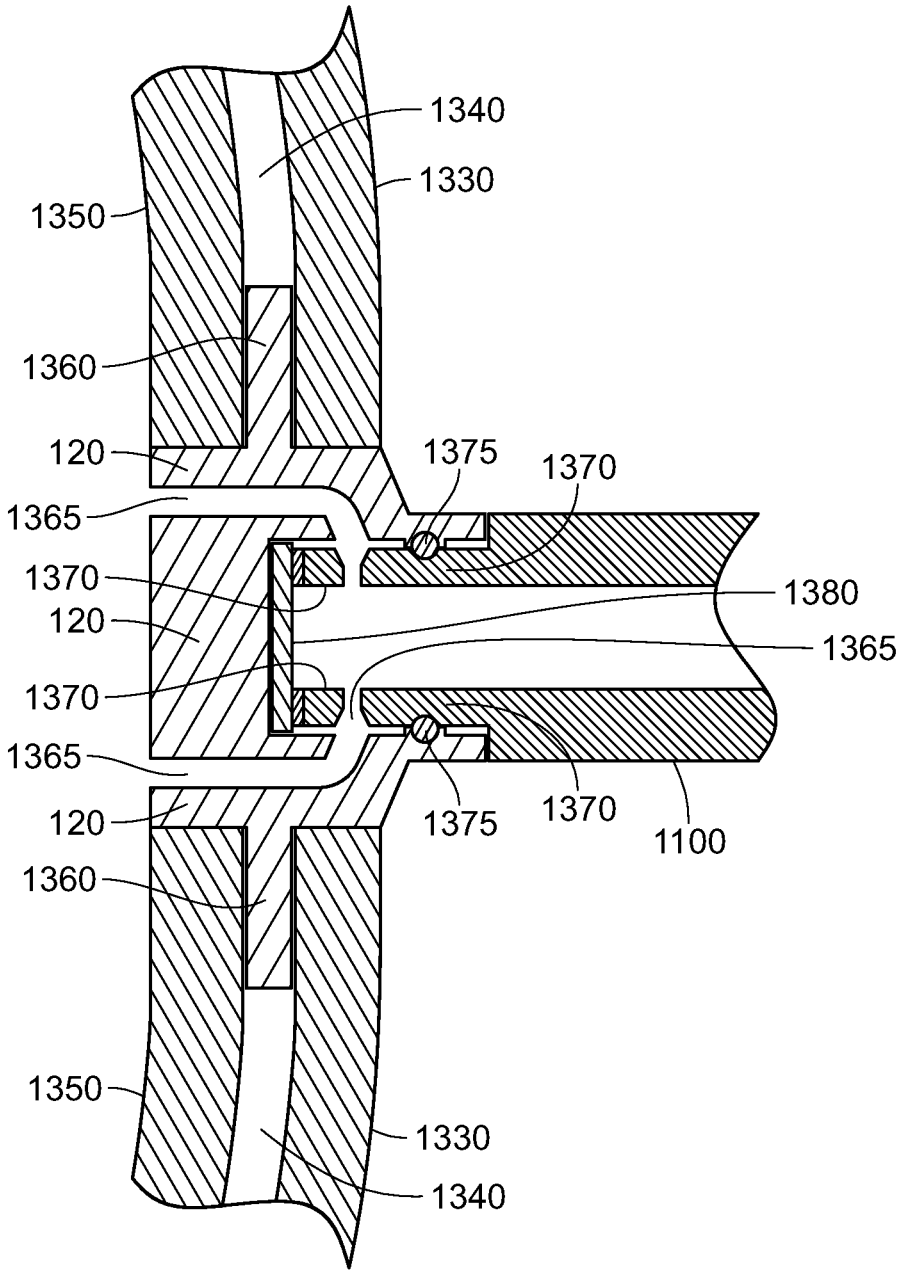
Figure 13D:
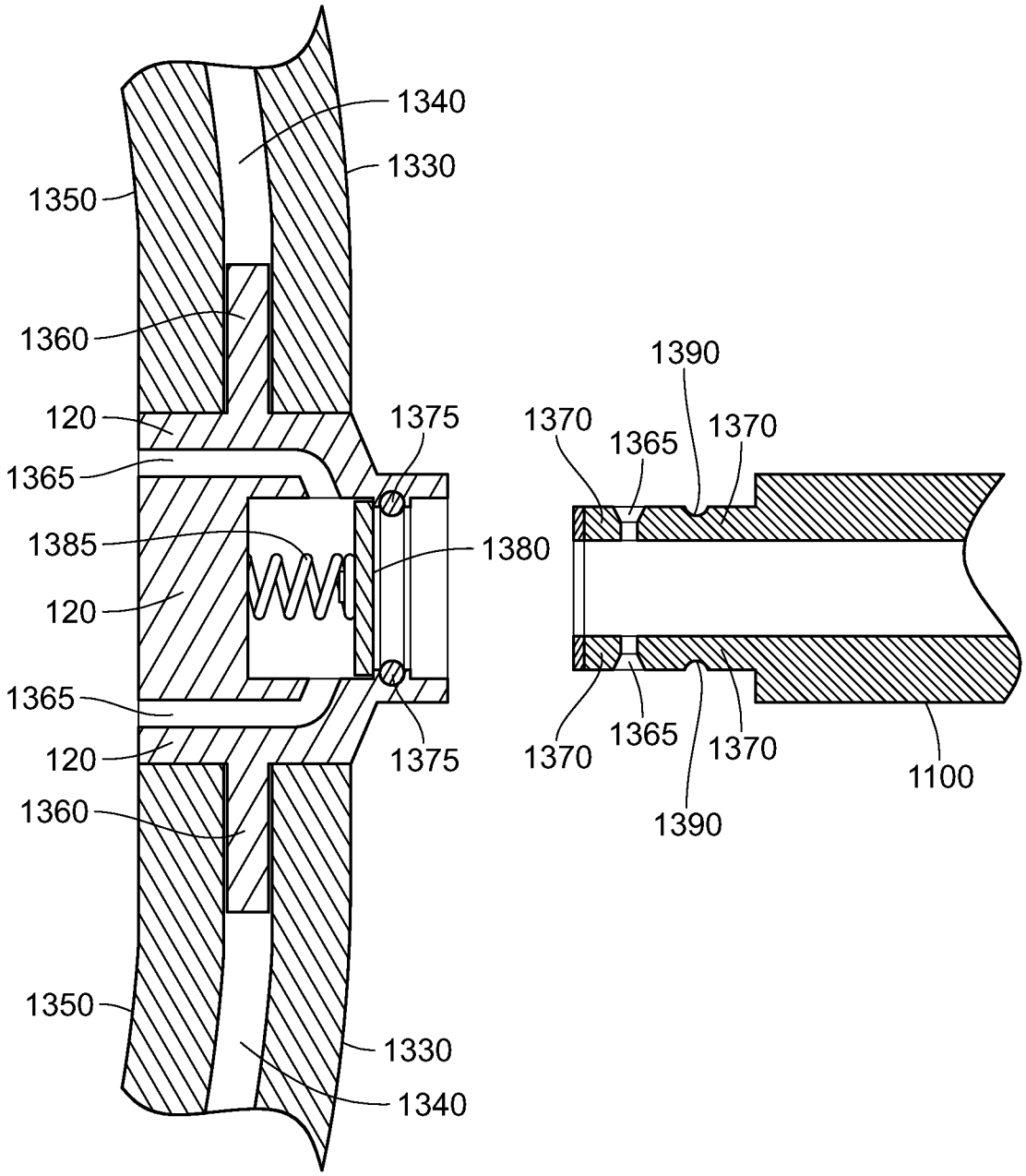

In some embodiments, as shown, in a non-limiting, illustrative example, in FIGS. 13C-13D, a valve or valve mechanism 1380 can, for example, be spring loaded 1385, with optional gaskets 1375 to maintain an air seal when a tube 1100 with (a first) connector portion or connecting piece 1370, optionally tapered or with smaller outer diameter than the tube 1100, is not inserted into (a second) connector or connecting piece 120 in the face mask. When the tube 1100 with (a first) connector portion or connecting piece 1370 is inserted into the connector or connecting piece 120 of the face mask, the tube 1100 and/or the (first) connector portion or connecting piece 1370 can mechanically move, adjust or activate the valve or valve mechanism 1380, e.g. by depressing the spring loaded mechanism 1385, and, for example, align airflow openings or vents 1365 in the tube and (second) connector or connecting piece 120 to facilitate airflow from the tube 1100 inside the mask. In some embodiments, optional gaskets 1375 can assist in holding the tube 1100 and/or (first) connector or connecting piece 1370 in place by expanding, for example, into recesses 1390 in the tube 1100 and/or (first) connector or connecting piece 1370. Alternatively, the gasket(s) can be mounted onto or integrated into the (first) connector or connecting piece 1370 or the tube 1100, with the recess(es) for example integrated into the (second) connector or connecting piece 120 of the face mask. Thus, a valve can be configured to block air flow from a connector 120 in the face mask when the tube is not connected to the second connector. A valve can be configured to allow air to flow when the tube is connected to the connector 120 in the face mask.

In some embodiments, the face mask can comprise one or more valves or valve like mechanisms configured to facilitate inhalation or inspiration. For example, a valve can be configured to facilitate airflow for inhalation or inspiration of the user. The valve can be configured to close upon exhalation or expiration of the user. For example, a valve can be a disc type valve, butterfly type, a ball type valve, a flap type valve, a self closing type valve, or any other type of valve known in the art. Any valve like mechanism known in the art can be used. A valve configured to facilitate inhalation or inspiration can, for example, be integrated in a connector for a tube or a tube delivering contained airflow for inspiration; the valve can be configured to close upon expiration/exhalation, e.g. through a disc, butterfly, ball, flap like self closing mechanism.

A valve can be configured to open or close upon mechanical insertion or placement of a tube and/or a connecting piece and/or a connector into or over or attaching to a tube and/or connecting piece and/or a connector, e.g. at an air vent or a mask. For example, a valve can be configured so that a tube and/or a connecting piece and/or a connector, e.g. cone shaped or threaded (optionally with a threaded counterpart), can move the valve into an open or a closed position upon insertion or placement, e.g. with the tip of the tube and/or connecting piece and/or connector moving one or more valve leaflets and/or valve components and/or valve portions. In this and other embodiments, the valve can optionally return to its original position (e.g. a closed or an open position), when the tube and/or connecting piece and/or connector is removed.

In some embodiments, the face mask can comprise one or more valves or valve like mechanisms configured to facilitate exhalation or expiration. For example, a valve can be configured to facilitate airflow for exhalation or expiration of the user. The valve can be configured to close upon inhalation or inspiration of the user. For example, a valve can be a disc type valve, butterfly type, a ball type valve, a flap type valve, a self closing type valve, or any other type of valve known in the art. Any valve like mechanism known in the art can be used. A valve configured to facilitate exhalation or expiration can, for example, be integrated into a mechanical filter respirator and/or an air filter portion of a face mask; the valve can be configured to close upon inspiration/inhalation, e.g. through a disc, butterfly, ball, flap like self closing mechanism.

A valve can be configured to be activated, e.g. opened or closed, upon insertion of a male piece into a female receiver, receiver piece or receiving portion. For example, the male piece can push a flap, ball, or butterfly component of a valve into an open position or a closed position. An example of a valve activated upon insertion of a male piece into a female receiver can be a Luer activated valve. An example of a Luer activated valve are select valves offered by NP Medical, Inc., Clinton, MA A valve configured for activation upon insertion of a male piece, e.g. a Luer activated or similar valve can, for example, be included or integrated in a connector piece integrated into a face mask, where the connector piece is designed to facilitate connecting a tube with contained air supply or airflow, e.g. from an air vent of the aircraft. Upon insertion of a male piece, e.g. connected to the tube, the valve configured for activation upon insertion of a male piece, e.g. a Luer activated valve in the connector piece can open, allowing for the air flow from the tube to enter into the mask. Upon disconnecting the male piece, the valve, e.g. a Luer activated valve can, for example, close, thereby blocking entry of air through the connector piece and/or valve.

A valve can be configured to be activated, e.g. opened or closed, upon placement of a female piece over a male piece. For example, the female piece and/or male piece can push a flap, ball, or butterfly component of a valve into an open position or a closed position. An example of a valve activated upon placement of a female piece over a male piece can be a Luer activated valve. An example of a Luer activated valve are select valves offered by NP Medical, Inc., Clinton, MA A valve configured for activation upon placement of a female piece, e.g. a Luer activated or similar valve can, for example, be included or integrated in a connector piece integrated into a face mask, where the connector piece is designed to facilitate connecting a tube with contained air supply or airflow, e.g. from an air vent of the aircraft, or it can be included or integrated in a tube, e.g. a tube with a connector system to be placed over an air vent or to be connected to a connector piece of a face mask. Upon placement of a female piece, e.g. connected to the tube and/or the face mask and/or a connector integrated or attached to the face mask and/or a connector integrated or attached to an air vent, the valve configured for activation upon placement of the female piece and/or male piece, e.g. a Luer activated valve in the connector piece, can open, allowing for the air flow from the tube to enter into the mask. Upon disconnecting the female piece and/or the male piece, the valve, e.g. a Luer activated valve can, for example, close, thereby blocking entry of air through the at least one of a valve, connector piece(s), tube, and/or face mask.

Air Supply Through Mechanical Filter Respirator or Air Filter

In some embodiments, the face mask can comprise a filter respirator, e.g. a mechanical filter respirator (MFR) or a chemical filter respirator, for example in a particulate filtering portion, particulate filtering facepiece, or particulate filtering facepiece respirator. A mechanical filter respirator can have a filtering function, which can provide protection against particulates, e.g. airborne pathogens, for example in droplets, including bacteria, viruses, or prions. Thus, the face mask can include the function of a mechanical filter respirator. At least a portion of the face mask, e.g. 10%, 20%, 30%, 40%, 50%, 60%, 70%, 80%, 90%, 95%, 98%, 99%, 100%, or any other percentage of the breathable portion of the face mask or the surface area of the face mask can comprise a mechanical filter respirator. The entire face mask can include a mechanical filter respirator. The entire face mask can comprise a mechanical filter respirator, e.g. by using a mesh like structure or a layered structure for filtering.

A mechanical filter respirator (MFR) or air filter (AF) can utilize different principles of air filtration, which can comprise, for example, direct impaction, sieving, interception, diffusion, and/or electrostatic attraction. With direct impact, for example, large contaminants such as dust, mold, large droplets can collide with a fiber or filter element and stick to it. With sieving, for example, the air stream can carry a particle or droplet between two fibers or filter elements, but the distance between the two fibers or filter elements can be smaller than the diameter of the particle or droplet and the particle or droplet becomes ensnared between the two fibers or filter elements. With interception, for example, the airflow can be rerouted between fibers or filter elements and, through inertia or a slow done in airflow, particles or droplets can settle or stick to the fibers or filter elements. With diffusion, for example, smaller particles or droplets can move less controlled and can hit and/or stick to the fibers or filter elements. Particles and/or droplets can also be filtered out and/or retained in a mechanical filter respirator or air filter using electrostatic attraction.

Optionally, mechanical filter respirators or air filters can comprise one or more chemical substances, e.g. in a powder or particles interspersed in a mesh. The chemical substances can be inert for humans, but can have antiviral or antibacterial properties. Optionally, mechanical filter respirators or air filters can comprise one or more nanoparticles of various metals and metal oxides like zinc oxide nanoparticles (ZnONPs), cuprous oxide nanoparticles (CuONPs), silver nanoparticles (AgNPs), nanosized copper iodide particles (CuINPs), gold nanoparticles on silica nanoparticles (Au—SiO2NPs) and also some quaternary ammonium cations (QUATs), to inactivate viruses, e.g. novel coronavirus.

The face mask can be disposable. The face masks can be re-useable. At least portion of the face masks or the particulate filtering portion, particulate filtering facepiece, or particulate filtering facepiece respirator can be washable. The entire face masks or the particulate filtering portion, particulate filtering facepiece, or particulate filtering facepiece respirator can be washable.

The face mask or the particulate filtering portion, particulate filtering facepiece, or particulate filtering facepiece respirator can comprise a fiber mesh, e.g. a mesh of synthetic polymer fibers, for example nonwoven polypropylene fabric. The mesh of nonwoven polypropylene fabric can be manufactured by processes known in the art, e.g. melt blowing. The mesh of synthetic fibers can include solid particles, for example arranged in a three-dimensional array. The solid particles can be uniformly dispersed and physically held in the mesh or web of fibers. U.S. Pat. No. 3,971,373 provides a description of exemplary fiber meshes, synthetic fiber meshes, melt blowing processes, and/or solid particles included and, optionally, uniformly dispersed throughout the mesh, and is hereby incorporated by reference in its entirety. The solid particles can be, for example, one or more nanoparticles of various metals and metal oxides like zinc oxide nanoparticles (ZnONPs), cuprous oxide nanoparticles (CuONPs), silver nanoparticles (AgNPs), nanosized copper iodide particles (CuINPs), gold nanoparticles on silica nanoparticles (Au—SiO2NPs) and also some quaternary ammonium cations (QUATs), to inactivate viruses, e.g. novel coronavirus. Optionally, solid particles can also be non-uniformly dispersed through the mesh or the particulate filtering portion, particulate filtering facepiece, or particulate filtering facepiece respirator.

In some embodiments, a face mask, a filter, e.g. an air filter, a filtering portion, a particulate filtering portion, a particulate filtering facepiece, a particulate filtering facepiece respirator, or a mechanical filter respirator can comprise at least one filter media, filter portion, filtering barrier, and/or material that is electrostatically charged, for example as described in U.S. Pat. Nos. 4,375,718; 4,588,537; 5,401,446; or 5,686,050 which are hereby incorporated by reference in their entireties. Latex-bonded, dry-laid and/or wet-laid nonwoven or woven materials with optional fiber contents, e.g. viscose, rayon, pulp, or blends of cellulose and/or synthetic fibers, can be utilized, e.g. for the outer and inner facings and/or for the filter media and/or one or more layers and/or filtering barriers.

In some embodiments, the face mask, the filter, e.g. an air filter, a filtering portion, a particulate filtering portion, a particulate filtering facepiece, a particulate filtering facepiece respirator, or a mechanical filter respirator can be composed of a single or multiple layers and/or filtering barriers, e.g. 2, 3, 4, 5, 6, or more layers and/or filtering barriers. For example, a face mask, a filter, e.g. an air filter, a filtering portion, a particulate filtering portion, a particulate filtering facepiece, a particulate filtering facepiece respirator, or a mechanical filter respirator can comprise three layers, e.g. with an outer layer of spunbond polypropylene, a center of electrostatically charged meltblown polypropylene, and a body-side layer of spunbound polypropylene or other material. Face masks, e.g. surgical face masks, N95 masks, a filtering portion, a particulate filtering portion, a particulate filtering facepiece, a particulate filtering facepiece respirator, or a mechanical filter respirator and its/their different components, filtering layers and/or filtering barriers and/or laminates can be bonded together or not bonded together or a combination thereof (e.g. when multiple filtering layers or filtering barriers or materials are used); they can, for example, be bonded together on the edges of the face mask, e.g. surgical face masks, N95 masks, a filtering portion, a particulate filtering portion, a particulate filtering facepiece, a particulate filtering facepiece respirator, or a mechanical filter respirator, e.g. an outer edge or an edge facing a (first) connector and/or connecting piece, e.g. for/to a second connector and/or connecting piece and/or a tube. Bonding can be performed using any technique known in the art, e.g. using sewing, pressure, heat, melting, thermal treatment, adhesives, and/or ultrasonic bonding.

In some embodiments, a face mask, e.g. a surgical face mask, N95 mask, a filtering portion, a particulate filtering portion, a particulate filtering facepiece, a particulate filtering facepiece respirator, or a mechanical filter respirator and its/their different components, layers and/or filtering barriers and/or laminates can be bonded together in at least a portion of the face mask, the filtering portion, the particulate filtering portion, the particulate filtering facepiece, the particulate filtering facepiece respirator, or the mechanical filter respirator and its/their different components, layers and/or filtering barriers and/or laminates, e.g. they can be "spot welded" or spot fused or spot connected, for example using thermal treatment or ultrasonic bonding, and/or locally applied adhesives and/or sewing and/or stitching.

In some embodiments, a connector or connecting piece, e.g. a first or second connector or connecting piece, for example for connecting a tube to a face mask, can be attached to or integrated into a face mask, e.g. a surgical face mask, N95 mask, N99 mask, or a filtering portion, a particulate filtering portion, a particulate filtering facepiece, a particulate filtering facepiece respirator, or a mechanical filter respirator and its/their different components, filtering layers and/or filtering barriers and/or laminates of a face mask. For example, the connector, connecting piece, connector portion, or connector mechanism 120 can have one or more extenders or members 1360 for attaching or integrating it into the face mask 100 (FIG. 13B). In some embodiments, an extender or member 1360 of the connector, connecting piece, connector portion, or connector mechanism can be interposed between two layers 1330 1350 of the face mask 100, e.g. layers of a filtering portion, a particulate filtering portion, a particulate filtering facepiece, a particulate filtering facepiece respirator, or a mechanical filter respirator and its/their different components, filtering layers and/or filtering barriers, thereby securing and/or attaching the connector, connecting piece, connector portion, or connector mechanism to the face mask 100. One or more optional middle or additional layers 1340 can terminate near the extender or member 1360. In another embodiment, the connector, connecting piece, connector portion, or connector mechanism can comprise two or more rims, extenders or members 135 137 (FIG. 13A), for example extending over an outside facing edge of an opening in the face mask and an inside facing edge of the opening in the face mask, thereby securing and/or attaching the connector or connecting piece to the face mask. The connector, connecting piece, connector portion, or connector mechanism can be attached to or integrated into the face mask, e.g. surgical face mask, N95 mask, N99 mask, or the filtering portion, particulate filtering portion, particulate filtering facepiece, particulate filtering facepiece respirator, or mechanical filter respirator and its/their different components, filtering layers and/or filtering barriers and/or laminates of the face mask using adhesive, thermal bonding or treatment, ultrasonic bonding or treatment or any other techniques known in the art for bonding a connector or connecting piece to a face mask. The connector, connecting piece, connector portion, or connector mechanism and/or a tube configured for attachment to the connector, connecting piece, connector portion, or connector mechanism of the face mask can comprise one or more valves, for example a valve that opens with inspiration and closes with expiration, e.g. blocking expiration into the connector or connecting piece and/or tube.

For example, the connector, connector mechanism, connector portion of connector piece 120 can be configured to fit into and fill and/or extend over an opening 130 of the face mask (FIG. 13A), e.g. in the center portion of the face mask. For example, the connector, connector mechanism, connector portion or connector piece 120 can have at least one or more rims, extenders, or members 135 137 with dimensions, a radius or diameter larger than the opening 130 of the face mask and at least one portion 139 with dimensions, a radius or diameter smaller than or similar to that of the opening 130 of the face mask; in this manner, the edge of the opening 130 of the face mask can be placed facing the at least one portion 139 with dimensions, a radius or diameter smaller than the opening 130 of the face mask, with the one or more rims 135, 137 extending over the opening 130 of the face mask, e.g. on an external facing and a face facing side of the face mask 100.

Filtering layers and/or filtering barriers and/or laminates of a face mask, e.g. a surgical face mask, N95 mask, a filtering portion, a particulate filtering portion, a particulate filtering facepiece, a particulate filtering facepiece respirator, or a mechanical filter respirator can be thermally fused together to produce a pre-formed cup or face shaped mask or respirator, which, for example, can conform or be held firmly, yet comfortably against the assigned facial area, e.g. the nose, nostrils, mouth, portions of the checks, and/or chin mouth to ensure that no or minimal leakage occurs where the edges of the surgical face mask, N95 mask, filtering portion, particulate filtering portion, particulate filtering facepiece, particulate filtering facepiece respirator, or a mechanical filter respirator contact the passenger's face. 3-D shapes of a face mask, e.g. a surgical face mask, N95 mask, a filtering portion, a particulate filtering portion, a particulate filtering facepiece, a particulate filtering facepiece respirator, or a mechanical filter respirator can be generated or produced with use of a mold, e.g. using a stamping like process, and/or by thermally and/or ultrasonically or otherwise seaming and bonding the structural elements together. The pre-formed cup or face-shaped mask or respirator or portions thereof can optionally be adjustable or bendable (e.g. with use of integrated or attached plastic or metal elements that can be deformable) to enhance or improve the conformity and/or the fit to the user's face. The pre-formed cup or face shaped mask or 3D shape of a face mask can be configured so that a seal between the periphery and/or the margin of the mask can be 100%, 99%, 98%, 95%, 90%, 85%, 80%, 70%, 60% or 50% or any other percentage air tight, wherein the percentage can be the percentage of air (e.g. volume of air) inhaled through the filtering portion, particulate filtering portion, particulate filtering facepiece, particulate filtering facepiece respirator, or a mechanical filter respirator or an air filter and/or a tube providing contained airflow from an air vent and connected to a connector integrated and/or attached to a face mask, with the difference to 100% being the leakage of air. The pre-formed cup or face shaped mask or 3D shape of a face mask can be configured to optimize the fit to the face and to minimize any leakage.

In some embodiments, the periphery or the margin of the face mask 100 can include an adhesive 180 on the face facing portion or side of the face mask 100 (FIG. 4).

In another embodiment, a non-air-leaking rubbery or spongy layer or interface can be attached to or integrated into the edges of the mask to achieve a comfortable fit and/or to reduce possible leakage.

One or more odor absorbing components can be incorporated into the face mask, the filtering portion, the particulate filtering portion, the particulate filtering facepiece, the particulate filtering facepiece respirator, or the mechanical filter respirator and its/their different components, filtering layers and/or filtering barriers and/or laminates, for example at select locations within the cross-section or across at least a portion of or the entire face mask, the filtering portion, the particulate filtering portion, the particulate filtering facepiece, the particulate filtering facepiece respirator, or the mechanical filter respirator and its/their different components, filtering layers and/or filtering barriers and/or laminates to provide additional comfort. For example, an odor absorbing component can be a carbon based material, e.g. an activated carbon.

One or more odor generating components can be incorporated into the face mask, the filtering portion, the particulate filtering portion, the particulate filtering facepiece, the particulate filtering facepiece respirator, or the mechanical filter respirator and its/their different components, filtering layers and/or filtering barriers and/or laminates, for example at select locations within the cross-section or across at least a portion of or the entire face mask, the filtering portion, the particulate filtering portion, the particulate filtering facepiece, the particulate filtering facepiece respirator, or the mechanical filter respirator and its/their different components, filtering layers and/or filtering barriers and/or laminates to provide additional comfort. The odor can be, for example, perfume based, oil based, e.g. sandal wood oil, or based on any other chemical product, fragrance or substance that can generate an odor, e.g. menthol.

The face mask or the particulate filtering portion, particulate filtering facepiece, or particulate filtering facepiece respirator can comprise meltblown fibers and staple fibers, as described, for example, in U.S. Pat. No. 6,197,709, which is hereby incorporated in its entirety. For example, by using a composite web comprising melt-blowage fibers intermingled with staple fibers the bulk can be increased and the density decreased. The concentration of injected fibers can optionally be controlled to vary as desired across the thickness of a composite web or to vary in different sections and/or portions of a composite web and/or a face mask. As described in U.S. Pat. No. 6,197,709, which is hereby incorporated in its entirety, a depth filter can have a coarser, more open side facing an aerosol to be filtered, e.g. air containing an infectious agent such as novel coronavirus. The larger droplets can be trapped in the larger pores and openings in the webs, where there is more space to hold these large droplets, without notably restricting air flow through the filter and thereby increasing the pressure drop. The aerosol containing the finer droplets, e.g. with viral load, can then travel through the more dense side of the filter, where there can be more of the fine or very fine meltblown fibers to capture the finer or smaller droplets on the greater fiber surface area. Since most of the larger droplets can be removed in the less dense side of the filter, it can require more time for particulate matter to close up the pores on the dense side. Thus, a filter with a gradient going in the direction of coarse (less dense) to finer (more dense) can filter an aerosol containing a mixture of coarse and fine particulates and/or droplets, and still filter the very fine particulate matter and/or droplets to an extremely high degree of efficiency with accompanying low pressure drop and high filter life.

In any of the embodiments through the specification, a face mask, a filter, e.g. an air filter, a filtering portion, a particulate filtering portion, a particulate filtering facepiece, a particulate filtering facepiece respirator, or a mechanical filter respirator can comprise or utilize at least one of a textile, e.g. a knitted or woven textile, a meltblown barrier, an electrostatic barrier, or any barrier known in the art and/or described in the specification, including for example barriers described in U.S. Pat. Nos. 3,971,373; 4,215,682; 4,375,718; 4,536,440; 4,588,537; 4,807,619; 4,850,347; 4,856,509; 5,307,796; 5,401,446; 5,686,050; 6,197,709; United States Patent Application 2005/007937A1, and International application PCT/US2019/032935, which are hereby incorporated in their entireties. In any of the embodiments through the specification, a face mask, a filter, e.g. an air filter, a filtering portion, a particulate filtering portion, a particulate filtering facepiece, a particulate filtering facepiece respirator, or a mechanical filter respirator can comprise or utilize one or more barriers or layers. The one or more barriers or layers can be the same or different, for example with regard to chemical composition, mesh composition, mesh density, mesh structure, fiber composition, fiber density, fiber structure, porosity, thickness, airflow resistance, inspiratory force required, or any other compositional, physical or breathing related attributes.

In some embodiments, barriers can also include, for example, microporous and monolithic breathable films. Non-limiting examples of microporous films include Celgard 2400 polypropylene (PP) film (Celgard, Charlotte, NC); microporous polyethylene films, microporous polytetrafluoroethylene (PTFE), Gore-Tex (R) films and other types of microporous films known in the art. Breathable monolithic films can absorb moisture away from the face and results in evaporative cooling when the moisture is absorbed through the monolithic film, evaporating into the surrounding air. Thermoplastic polyurethane resins can be used. Microporous films can serve as barriers to aerosols in that small tortuous pore channels through the film can be too small for aerosols, e.g. with droplets containing novel coronavirus, can pass through the film.

The particulate filtering portion, particulate filtering facepiece, or particulate filtering facepiece respirator can comprise the entire face mask. The particulate filtering portion, particulate filtering facepiece, or particulate filtering facepiece respirator can comprise only a portion of the face mask, e.g. 10%, 20%, 30%, 40%, 50%, 60%, 70%, 80%, 90%, 95%, 98%, 99%, 100%, or any other percentage. The mechanical respirator, including the particulate filtering facepiece, or particulate filtering facepiece respirator can comprise a high efficiency particulate air filter (HEPA).

Figure 6:
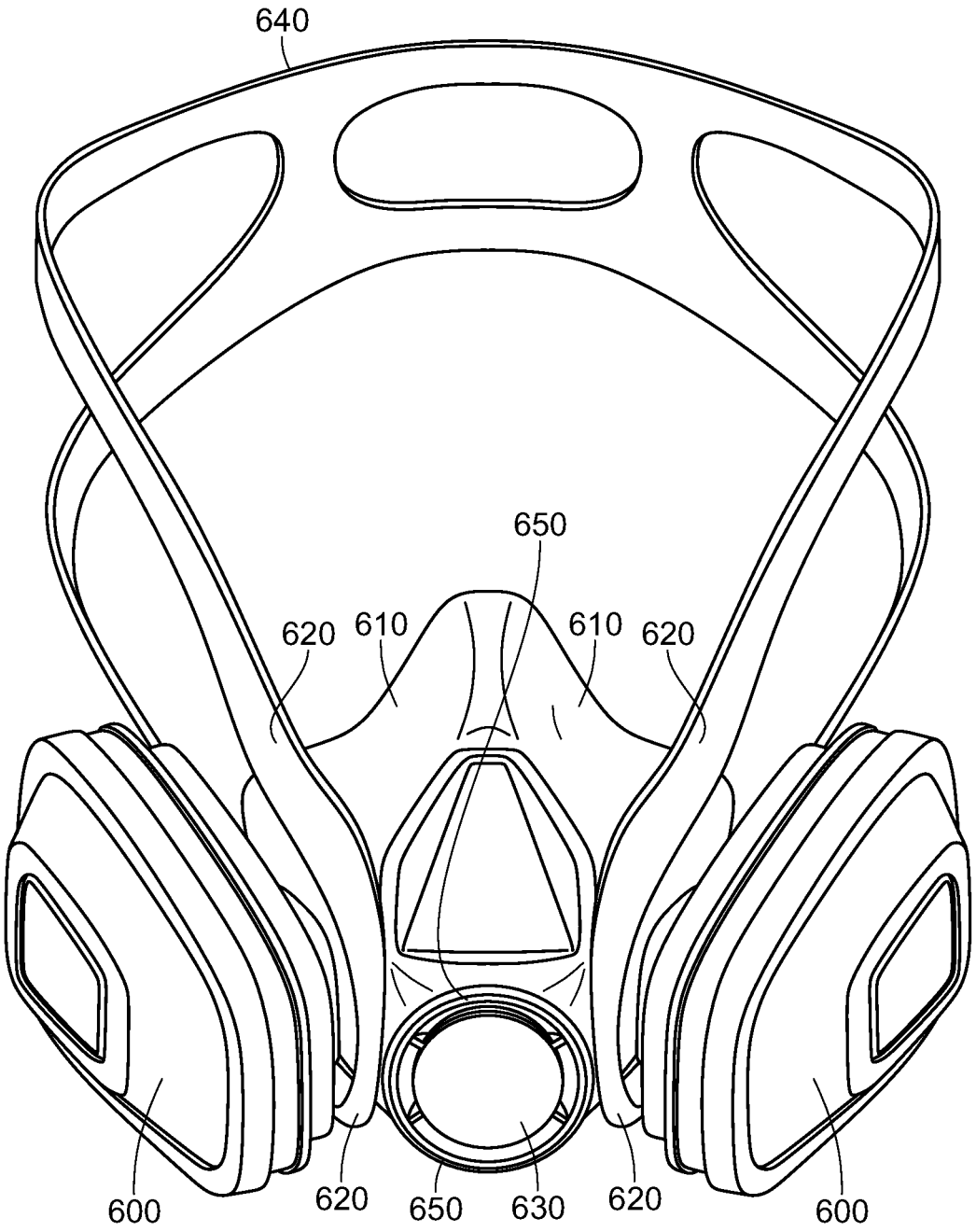
FIG. 6 is an illustrative, non-limiting example with a frontal view of a face mask with one or more air filters according to some embodiments.

In some embodiments, the face mask can be comprised of non-breathable material, e.g. plastic or silicone, e.g. with one or more integrated or attached air filters. FIG. 6 is an illustrative, non-limiting example with a frontal view of a face mask with one or more air filters 600, a non-breathable mask portion 610 covering in this example the nose, nostrils and, optionally, the mouth, one or more attachment means 620 for attaching the one or more air filters 600, a connector or connecting piece or connecting mechanism 630 for connecting, for example, a tube (not shown in this example) carrying contained air flow, e.g. from an air vent (not shown), a portion 650 integrating or connecting the connector or connecting piece 630 to the non-breathable mask portion 610, and one or more straps or tightening members 640. The air filters can be connected to the face masks, for example through a screw in mechanism, e.g. using a thread. The air filters can be connected to the face mask through any other mechanism known in the art for locking them into a connecting piece, e.g. a dovetail type mechanism, Luer lock like mechanism etc. The air filters can comprise any air filter design or type known in the art, for example, a mesh like air filter. The mesh like air filter can be comprised of a type of woven material, e.g. a cloth like material, optionally in multiple layers. The air filter can comprise a fiber mesh, e.g. a mesh of synthetic polymer fibers, for example nonwoven polypropylene fabric. The mesh of nonwoven polypropylene fabric can be manufactured by processes known in the art, e.g. melt blowing. The mesh of synthetic fibers can include solid particles, for example arranged in a three-dimensional array. The solid particles can be uniformly or non-uniformly dispersed and physically held in the mesh or web of fibers. U.S. Pat. No. 3,971,373 provides a description of exemplary fiber meshes, synthetic fiber meshes, melt blowing processes, and/or solid particles included and, optionally, uniformly (or, in some embodiments, non-uniformly) dispersed throughout the mesh, and is hereby incorporated by reference in its entirety. The solid particles can be, for example, one or more nanoparticles of various metals and metal oxides like zinc oxide nanoparticles (ZnONPs), cuprous oxide nanoparticles (CuONPs), silver nanoparticles (AgNPs), nanosized copper iodide particles (CuINPs), gold nanoparticles on silica nanoparticles (Au—SiO2NPs) or select quaternary ammonium cations (QUATs), to inactivate viruses, e.g. novel coronavirus. Optionally, solid particles can also be non-uniformly dispersed through the mesh or the particulate filtering portion of the air filter. The air filter can be a high efficiency particulate air filter (HEPA).

In some embodiments, the air supply for the user can be, at least in part or entirely, through the mechanical filter respirator, for example in a particulate filtering portion, particulate filtering facepiece, or particulate filtering facepiece respirator 110, and/or through an integrated or attached air filter 600. For example, the face mask can be configured so that the user can inhale air through the mechanical filter respirator 110, for example in a particulate filtering portion, particulate filtering facepiece, or particulate filtering facepiece respirator 110, and/or through an integrated or attached air filter 600, when he or she needs to get up from his or her seat in the aircraft, for example to use the restroom or other amenities or facilities on the plane. Similarly, the user can elect to use the face mask 100 and breathe through the mechanical filter respirator 110, for example in a particulate filtering portion, particulate filtering facepiece, or particulate filtering facepiece respirator 110, and/or through an integrated or attached air filter 600, when he or she enters or exits the aircraft.

Aircraft Ventilation System

The aircraft ventilation system (FIGS. 7 and 8) can comprise air supply to the cabin provided from compressor stages of one or more aircraft engines. Alternatively, one or more separate or dedicated electric compressors can be used to provide the air supply and move the air. The air supply provided from compressor stages of one or more aircraft engines can be at high pressure and temperature (for example, ranging from 120° C. to 300° C., e.g. depending on the stage of flight). The environmental system of the aircraft can cool and condition the air to levels suitable for passengers. The air supply system can optionally comprise one or more air filters or air filter systems 700. The air filter systems can be mechanical filter systems and/or chemical filter systems, for example comprising one or more nanoparticles of various metals and metal oxides like zinc oxide nanoparticles (ZnONPs), cuprous oxide nanoparticles (CuONPs), silver nanoparticles (AgNPs), nanosized copper iodide particles (CuINPs), gold nanoparticles on silica nanoparticles (Au—SiO2NPs) and also some quaternary ammonium cations (QUATs), to inactivate pathogens such as bacteria, viruses (e.g. novel coronavirus), prions. The air filter system (s) 700 can comprise one or more HEPA filters. The air supply system can comprise one or more UV light systems 800. The UV light system can comprise a UVA, UVB or UVC light source for killing bacteria, viruses, or prions. The UV light system can comprise one or more excimer lamps. The excimer lamps can comprise one or more excited dimers (excimers) that can emit light, e.g. at a defined wavelength and/or photon energy, when they transit from an excited state to a ground state. Representative, non-limiting excimers are, for example, KrBr, KrCL, NeF, $Ar_2$, $Kr_2$, $F_2$, ArBr, $Xe_2$, ArCl, Krl, ArF, KrF, Xel, $Cl_2$, XeBr, $Br_2$, XeCl, $I_2$, XeF. In one non-limiting embodiment, far UVC light, for example, with a wavelength between 207 and 222 nm, as emitted, for example, when using KrBr and/or KrCl excimers, can be used to inactivate bacteria or viruses. Other wavelengths can be used. The air supply system can comprise one or more ultrasound systems for killing bacteria, viruses, or prions. The air supply system can comprise one or more radiofrequency (RF) based systems for killing bacteria, viruses, or prions. Any of the foregoing systems and techniques can optionally combined. For example, the air supply system of the aircraft can include at least one of a HEPA filter, UV light system, ultrasound system, RF based system or combinations thereof for killing or inactivating bacteria, viruses, or prions. Any of the at least one of a HEPA filter, UV light system, ultrasound system, RF based system or combinations thereof can comprise an air intake 710 and an air outlet. The air can be distributed throughout the passenger cabin with use of ducts 720 running along the length of the aircraft, with outflow ducts 730 channeling air to the passengers through air vents and intake ducts 740 channeling air away from the passengers back to the aircraft ventilation filtering and, optionally, UV light, ultrasound, RF or other systems.

Figure 7:
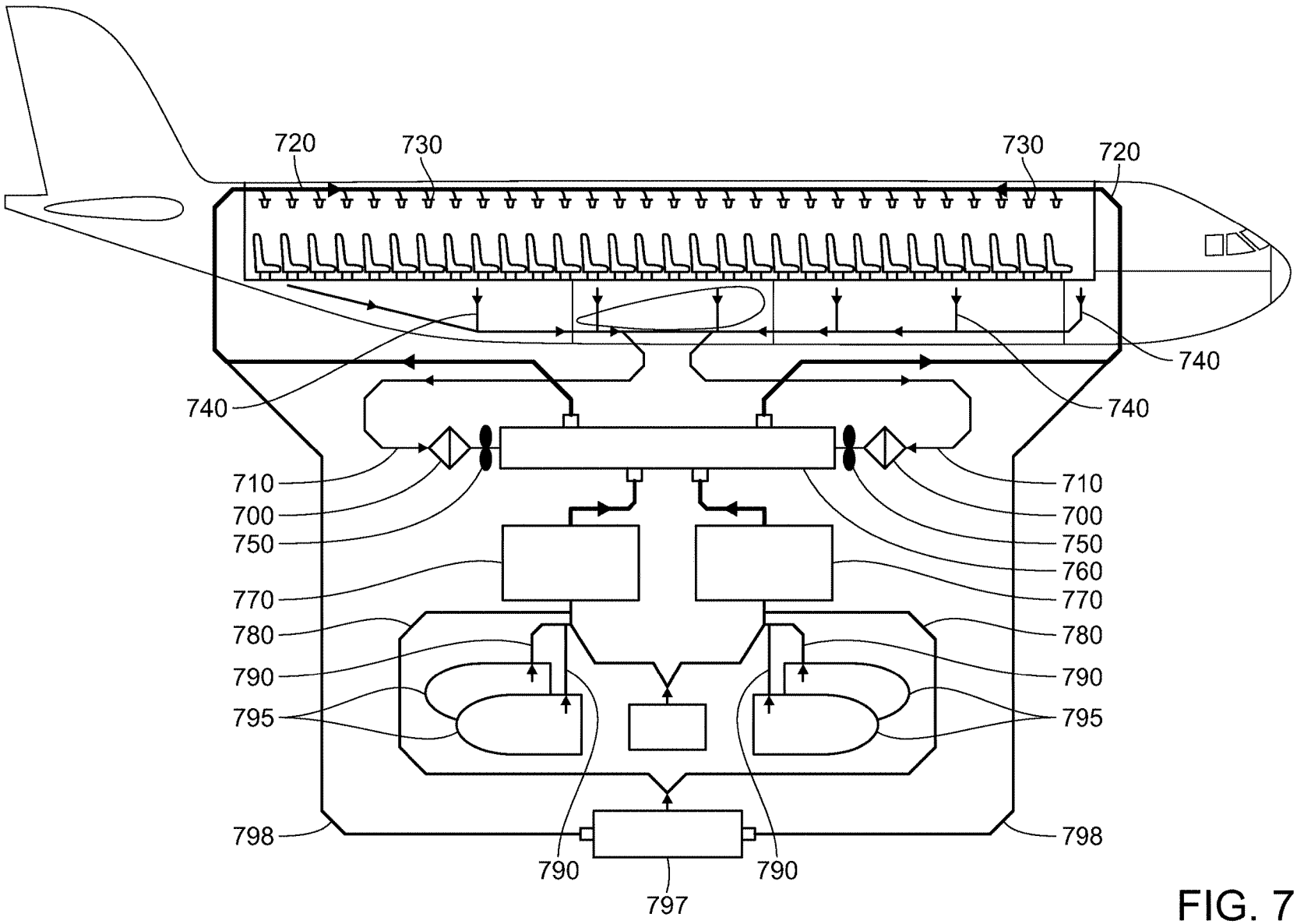
FIG. 7 is an illustrative, non-limiting example of an aircraft ventilation system, including an air filter system according to some embodiments.
Figure 8:
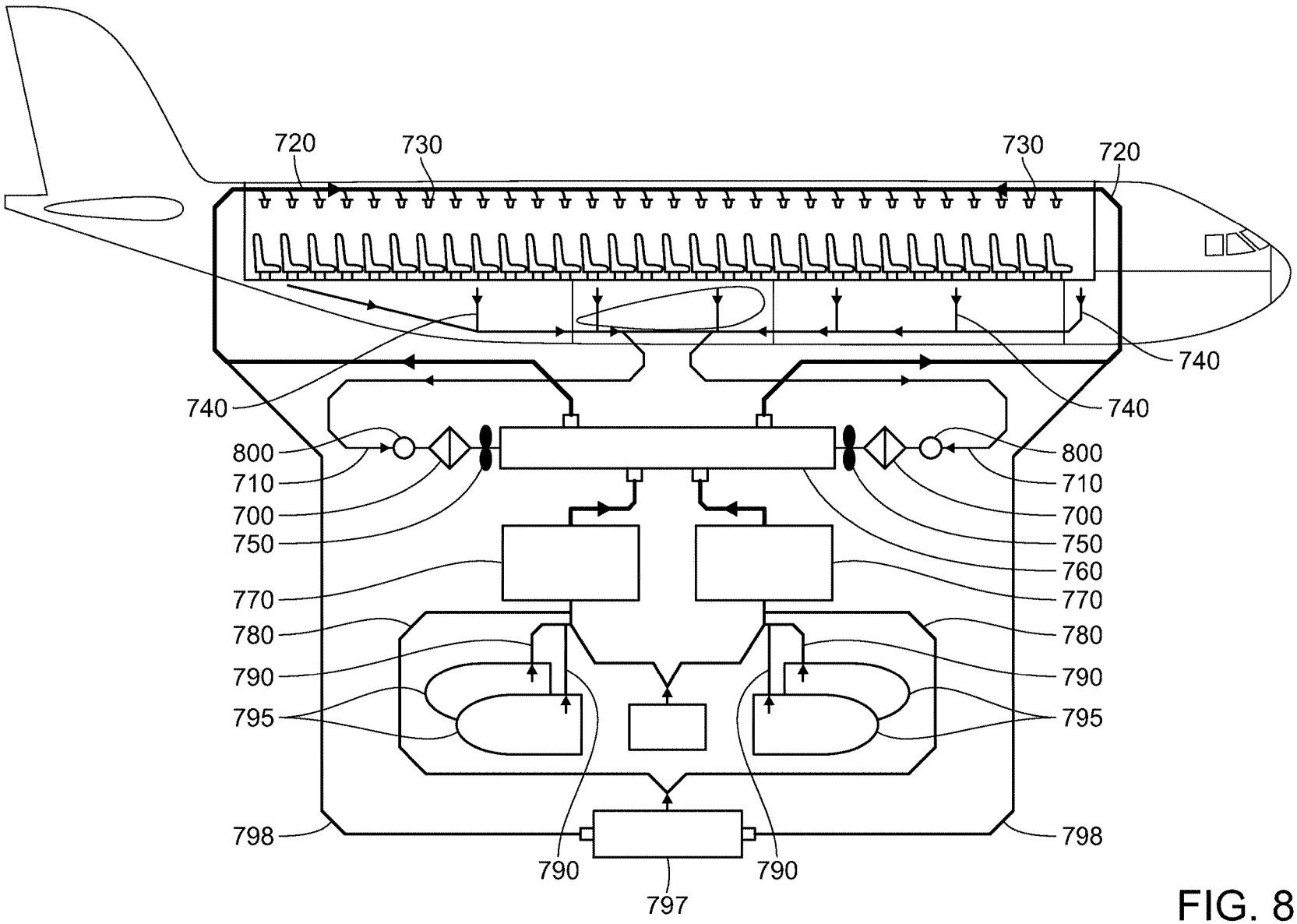
FIG. 8 is an illustrative, non-limiting example of an aircraft ventilation system, including an air filter system and a UV light (e.g. UVC) system, ultrasound system, RF based system or combinations thereof for killing or inactivating bacteria, viruses, or prions according to some embodiments.

The air ventilation system, shown in an illustrative, non-limiting way in FIGS. 7 and 8, can comprise ducts 720 distributing the air through the passenger cabin, intake ducts 740 channeling air away from the passengers, an air intake 710 for a filtering unit or air filter system 700 and/or a UV light (e.g. UVC) unit 800, ultrasound system, RF based system or combinations thereof for killing or inactivating bacteria, viruses, or prions, a fan or fan system 750, e.g. a cabin recirculating fan, an air mixing unit 760, one or more air conditioning units 770, ducts 790 channeling air to and/or from one or more aircraft engines 795 to the one or more air conditioning units 770, a hot air manifold 797 with ducts 780 running to or from the air conditioning unit(s) 770, and optional ducts connecting to the ducts 720 or duct system distributing the air through the passenger cabin. The air supply can be regulated using one or more computer processors. The one or more computer processors can control one or more airflow sensors and/or one or more air pressure sensors. The one or more computer processors can be configured to adjust at least one of airflow (e.g. in the air duct system, e.g. to or from the passenger(s), passenger cabin area, or exiting the air vents), air pressure (e.g. in the air duct system or exiting the air vents), cabin pressure, or combinations thereof. The one or more computer processors can be configured to control at least one of a HEPA filter, UV light system, ultrasound system, RF based system or combinations thereof for killing bacteria, viruses, or prions. The one or more computer processors can be configured to ensure that there is sufficient airflow and/or air pressure supplied to all face masks, as described in the subsequent embodiments.

Air Supply Through Contained Airflow and/or a Filtering Portion, a Particulate Filtering Portion, a Particulate Filtering Facepiece, a Particulate Filtering Facepiece Respirator, or a Mechanical Filter Respirator and Its/Their Different Components, Filtering Layers and/or Filtering Barriers and/or Laminates of a Face Mask and/or an Air Filter of a Face Mask In some embodiments, the face mask can be configured so that contained airflow or contained air supply is provided to the user. The contained airflow or contained air supply can be from the aircraft ventilation system. The contained airflow or contained air supply can optionally also be provided from the oxygen emergency system of the plane. In some embodiments, the aircraft oxygen emergency system can optionally be connected to the aircraft ventilation system, for example through one or more valves that can, for example, be mechanically or electrically or electromagnetically operated, e.g. using one or more computer processors. In this manner, the tube system attached or connected to the aircraft oxygen emergency system can be used to deliver a contained airflow to the passenger(s). In some embodiments, the contained airflow or contained air supply can be supplied through the air vent or air vents located above the passenger or passengers. A connector, connecting piece, connector portion, or connecting mechanism can be attached to or inserted into the air vent (see, for example, FIGS. 9A-12C). The connector, connecting piece, connector portion, or connecting mechanism can be attached or connected to a tube or can be an integral part of a tube.

Additional connectors, connecting pieces, connector portions, or connecting mechanisms can be used for connecting the tube. For example, a first connector, connecting piece, connector portion, or connecting mechanism can be attached over, attached to, or inserted into an air vent. The first connector, connecting piece, connector portion, or connecting mechanism can optionally be elastic or deformable and can configured for attachment over, attachment to, or insertion into the air vent with re-expansion or re-establishment to its original shape, e.g. snap-on or snap-in or pop-in style. The first connector, connecting piece, connector portion, or connecting mechanism can be connected to, attached to or integrated into or with to a tube like member, e.g. an intermediary tube element, optionally with an attached or integrated second connector, connecting piece, connector portion, or connecting mechanism, connected, integrated or attached to the opposite end of the tube like member or intermediary tube element. A tube 1100 can be connected to the second connector, connecting piece, connector portion, or connecting mechanism, for example using a threaded portion, a thread, a cone shaped portion, a dovetail like mechanism, a Luer lock like mechanism, or any other connecting mechanism described in the specification or known in the art. In this manner, the first connector, connecting piece, connector portion, or connecting mechanism and the tube like member or intermediary tube element, optionally with the second connector, connecting piece, connector portion, or connecting mechanism connected, integrated or attached to the opposite end of the tube like member or intermediary tube element, can remain attached over, attached to, or inserted into the air vent, e.g. for use by multiple passengers on subsequent flights. Each passenger, e.g. seated on the same seat on consecutive or subsequent flights, can then connect a tube 1100 of their personal protection system to the tube like member or intermediary tube element or the second connector, connecting piece, connector portion, or connecting mechanism connected, integrated or attached to the opposite end of the tube like member or intermediary tube element.

Connector Configured to Fit Over and/or Encase an Air Vent

The connector, connecting piece or connector portion 900 can be configured to fit over and/or to encase and/or to engulf an air vent 940, as shown in an illustrative, non-limiting manner in FIG. 9. The connector, connecting piece or connector portion 900 can be part of a tube 910. The tube 910 can optionally be elastic, non-elastic, deformable or non-deformable. The inner wall 920 of the tube 910, e.g. the portion of the inner wall touching and/or engulfing or encasing the outer portion, wall or rim 930 of the air vent 940, can optionally comprise an adhesive. The connector, connecting piece or connector portion 900 can comprise a deformable portion 950 to fit over and/or encase an air vent. The deformable portion 950 can have elastic properties. For example, the deformable and/or elastic portion 950 of the connector, connecting piece or connector portion 900 can be fitted over the air vent similar to how a latex or similar glove can be fitted over a finger. The deformable and/or elastic portion 950 of the connector, connecting piece or connector portion 900, configured to be fitted over and/or to encase and/or to engulf the air vent, can have a diameter or inner dimension and/or circumference that is the same or smaller than the outer dimensions and/or shape of at least a portion of the air vent over which it is to be fitted; in this manner, a air tight fit can be achieved between the elastic portion 950 of the connector, connecting piece, connector portion, or connector mechanism 900 and the air vent 940 and the connector, connecting piece, connector portion, or connector mechanism 900 can also be attached to the air vent 940, e.g. the wall or rim 930 of the air vent 940. In other embodiments, the elastic portion 950 of the connector, connecting piece, connector portion, or connector mechanism 900, configured to be fitted over and/or to encase and/or to engulf the air vent, can have a diameter or inner dimension and/or circumference that is the same or greater than the outer dimensions and/or shape of at least a portion of the air vent 940, e.g. the wall or rim 950, over which it is to be fitted; in this embodiment, for example, a hose clamp or an elastic ring, e.g. rubber or silicone based, or a zip tie can be used to tighten the connector over the air vent or air vent outlet. In any of the foregoing embodiments, the connector to the air vent can be a part of a tube, e.g. an integral part of a tube.

Connector Configured to Fit Inside an Air Vent

The connector, connecting piece, connector portion, or connector mechanism 1000 can be configured to fit into or inside an air vent (see, for example, FIGS. 10-12C). The connector can comprise a deformable portion to fit inside and/or into the opening of an air vent. The deformable portion can have elastic properties. The connector can comprise an extension, member, feature or portion 1010, e.g. a ring-, lip-, or extender-like structure, which can, optionally, be deformable and/or elastic. The extension, member, feature or portion 1010, e.g. a ring-, lip-, or extender-like structure can have an outer diameter and/or radius and/or dimension that can be greater than, the same, or smaller than that of an opening 1070 of or of the air vent. The extension, member, feature or portion 1010, e.g. a ring-, lip-, or extender-like structure can be deformable and/or elastic and can be deformed, e.g. squeezed, to allow passing it through the opening of the air vent. Once passed through the opening of the air vent 1070, the extension, member, feature or portion, e.g. a ring-, lip-, or extender-like structure, can expand and, by re-taking its natural form, can be self-seating, self-securing, and/or secured inside and/or against a wall portion of the air vent.

For example, the deformable or elastic portion of the connector, connector portion, connector piece, and/or connector mechanism 1000 can be squeezed inside the opening 1070 of the air vent and can expand into its normal, expanded dimensions and/or diameter once it has been passed through the opening of the air vent. At least a portion of the elastic portion of the connector, connector portion, connector piece, and/or connector mechanism 1000, configured to be fitted inside and/or into the opening of the air vent or the air vent, can have an outer diameter, radius, circumference and/or dimension and/or shape that is the same or smaller than an inner diameter, radius, circumference and/or dimension and/or shape of at least a portion of the air vent into which it is to be fitted. In another embodiment, at least a portion of the elastic portion of the connector, connector portion, connector piece, and/or connector mechanism 1000, configured to be fitted inside and/or into the opening of the air vent or the air vent, can have an outer diameter, radius, circumference and/or dimension and/or shape that is the same or greater than an inner diameter, radius, circumference and/or dimension and/or shape of at least a portion of the air vent into which it is to be fitted. In any of the foregoing embodiments, the connector, connector portion, connector piece, and/or connector mechanism 1000 to the air vent can be a part of a tube 1100, e.g. an integral part of a tube, which can optionally be fitted inside an opening of the air vent or inside the air vent. In any of the foregoing embodiments, the connector, connecting piece or connector portion 1000 to the air vent can be separate from the tube, e.g. connected to the tube using one or more optional tube portions or tube like elements 960 and/or a second tube 1100 facing connector, connector portion, connector piece, and/or connector mechanism 970 or 975.

FIGS. 10-13 show illustrative, non-limiting examples of a connector, connecting piece or connector portion 1000 with a cone shaped portion 1015, which includes at least one area or section with an outer diameter or shape of the cone shaped portion that is the same or smaller than an inner diameter or shape of a portion of an air vent, into which it is configured to be inserted. The air vent has not been modified: The adjustment ring 1030 for opening and closing the air supply, e.g. by moving a portion of the air vent up or down, closer or further away from cone 1050, is shown along with a movable and/or rotatable component 1020 of the air vent which is configured to be moveable and/or rotatable, for example in order change the direction of outward airflow. The base section 1040 of the air vent is attached to the ceiling 1060 and/or the undersurface of the baggage compartment 1060.

The connector, connecting piece or connector portion 1000 can comprise an extension, member, feature or portion 1010, e.g. a ring-, lip-, or extender-like structure, which can, optionally, be deformable and/or elastic. The outer dimensions or diameter or circumference of the extension, member, feature or portion 1010, e.g. a ring-, lip-, or extender-like structure, can be greater or larger than the dimensions or diameter or circumference of at least one opening 1070 of the air vent. The connector, connecting piece or connector portion 1000 including an extension, member, feature or portion 1010, e.g. a ring-, lip-, or extender-like structure, can be configured to be elastic and/or squeezable. The connector, connecting piece or connector portion 1000 including an extension, member, feature or portion 1010, e.g. a ring-, lip-, or extender-like structure, can be configured to return to their original shape and/or dimensions once an external force (e.g. a squeeze or pinch between two or more fingers) is released.

At least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be deformable and/or elastic and can be configured so that at least a portion of the connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be fitted inside or inserted into at least a portion of or an opening of an air vent.

At least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be deformable and/or elastic and can be configured so that the at least a portion of the connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be squeezed or deformed to allow for passing of the at least a portion of the connector, connecting piece or connector portion 1000, including an optional extension, member, feature or portion 1010, e.g. a ring-, lip-, or extender-like structure, and/or an optional cone shaped portion 1015 and/or at least a portion of a tube 1100 through an opening of an air vent, e.g. element 1070, (and/or a connector or connecting portion or connecting piece of a face mask).

At least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be deformable and/or elastic and can be configured so that the at least a portion of the connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be squeezed to allow for fitting inside or re-expansion inside or insertion into at least a portion of or an opening of an air vent.

At least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can be deformable and/or elastic and can be configured so that the at least a portion of the connector, connecting piece, connector portion, or connecting mechanism 1000, including an optional extension, member, feature or portion 1010, e.g. a ring-, lip-, or extender-like structure, and/or an optional cone shaped portion 1015 and/or at least a portion of a tube 1100 can be squeezed to allow for fitting inside or insertion into at least a portion of or an opening 1070 of an air vent and/or can be configured to allow for returning to its/their original shape and/or dimensions once an external force (e.g. a squeeze or pinch between two or more fingers or a forward, backward, downward or upward force and/or movement 1080) is released, e.g. after passing through an opening 1070 in an air vent, e.g. via re-expansion, re-expanding, or return to its original shape or near its original shape. In this exemplary manner, the at least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can re-expand an return to their original shape once seated inside at least a portion of an air vent, e.g. an opening 1070 of an air vent. At least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 can have a greater circumference and/or diameter and/or radius than at least one opening 1070 of the air vent, thereby securing or locking the at least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 in place inside the at least a portion of the air vent and/or the opening 1070 of the air vent.

The external force to deform the at least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 for fitting it/them inside at least a portion of an air vent or for passing it/them through an opening 1070 of an air vent can be a lateral force, e.g. created by a squeeze or pinch with two or more fingers, a forward force, a backward force, an upward force 1080, and/or a downward force created by pushing or moving the at least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 in the direction of a passage or an opening 1070 of an air vent, for a passage or through an opening 1070 of an air vent, or for fitting inside an air vent.

The external force to deform the at least a portion of a connector, connecting piece or connector portion 1000, including an optional extension, member, feature or portion 1010, e.g. a ring-, lip-, or extender-like structure, and/or an optional cone shaped portion 1015 and/or at least a portion of a tube 1100 for fitting it/them inside at least a portion of an air vent or for passing it/them through an opening 1070 of an air vent can be a lateral force, a side force, a forward force, a backward force, an upward force 1080, a downward force, or any combinations thereof. The force can be 0.1, 0.2, 0.3, 0.5, 1.0, 2.0, 3.0, 4.0, 5.0, 10.0, 15.0, 20.0, 25.0, 30.0 or any other force value, for example measured or expressed in Newtons or PSI.

The opening of the air vent can be an outer opening, e.g. at the external rim or perimeter of the air vent; the opening of the air vent can be an opening that can be part of an opening or closing mechanism of an air vent.

Figure 9A:
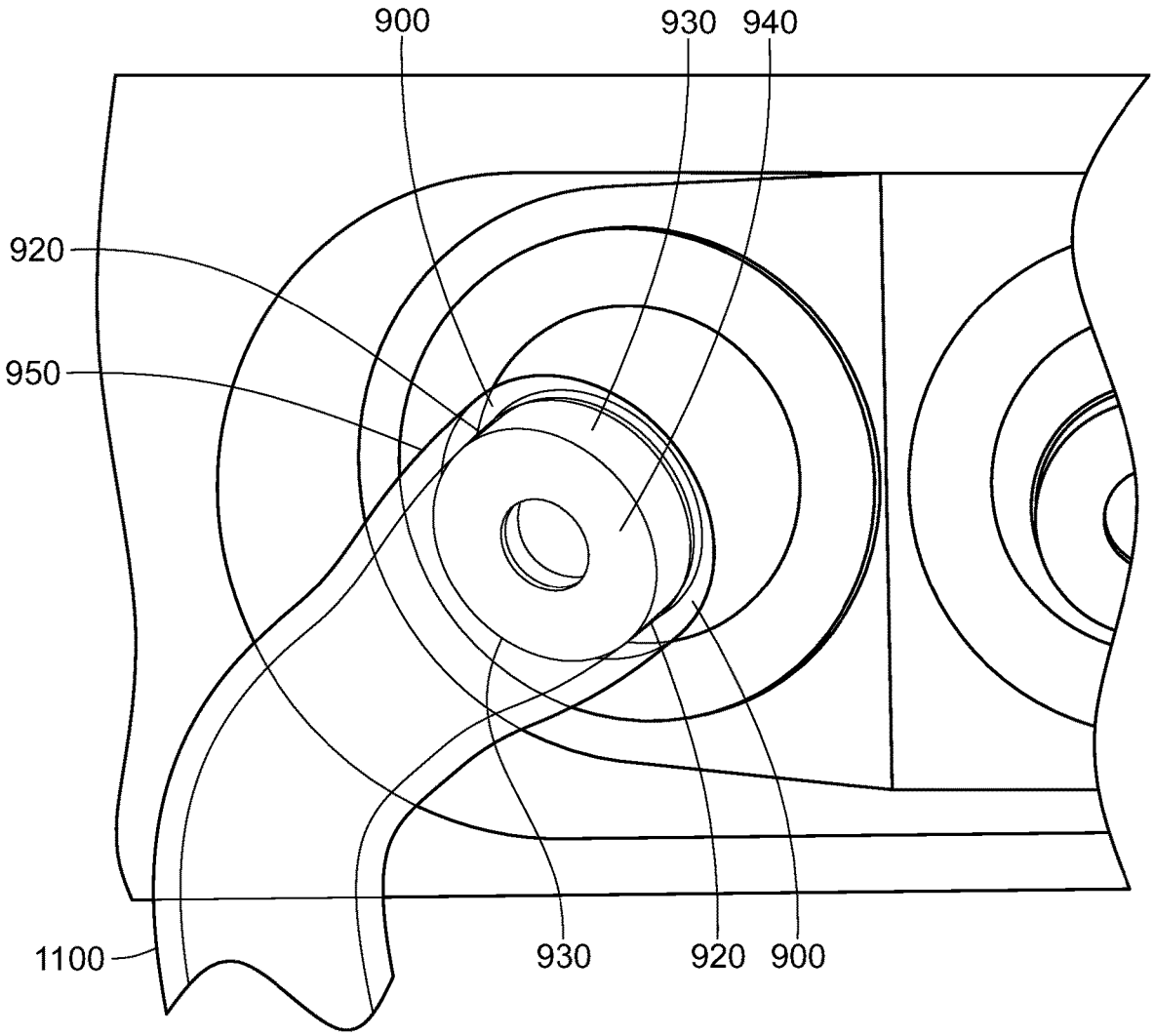
FIGS. 9A-9C are illustrative, non-limiting examples of one or more connectors, connecting pieces, connector portions, or connector mechanisms, attached or connected to a tube or an integral part of a tube, configured to fit over and/or to encase and/or to engulf an air vent, as well as optional cone shape or threaded connectors, connecting pieces, connector portions, or connector mechanisms to a tube, according to some embodiments.
Figure 9B:
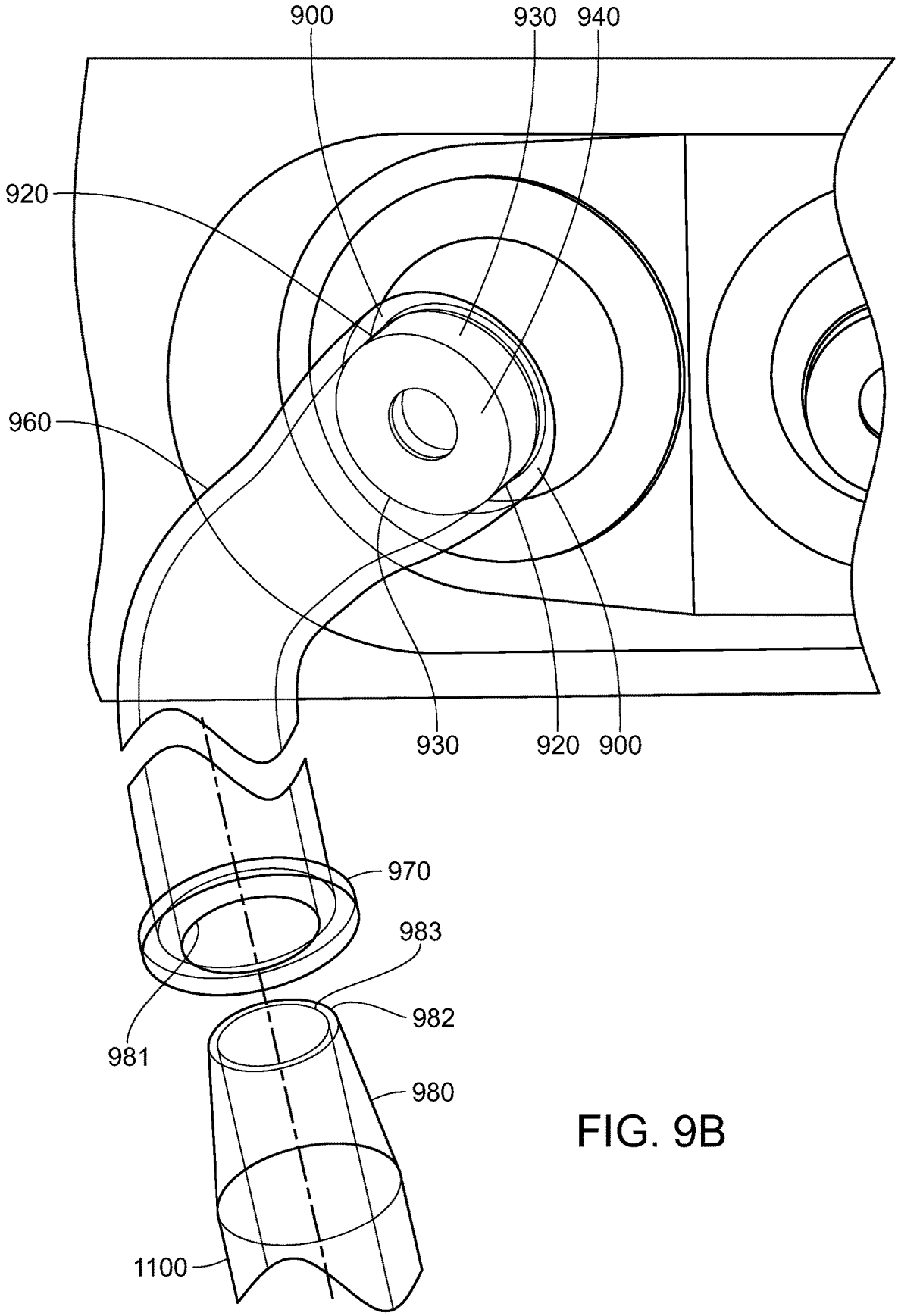
Figure 9C:
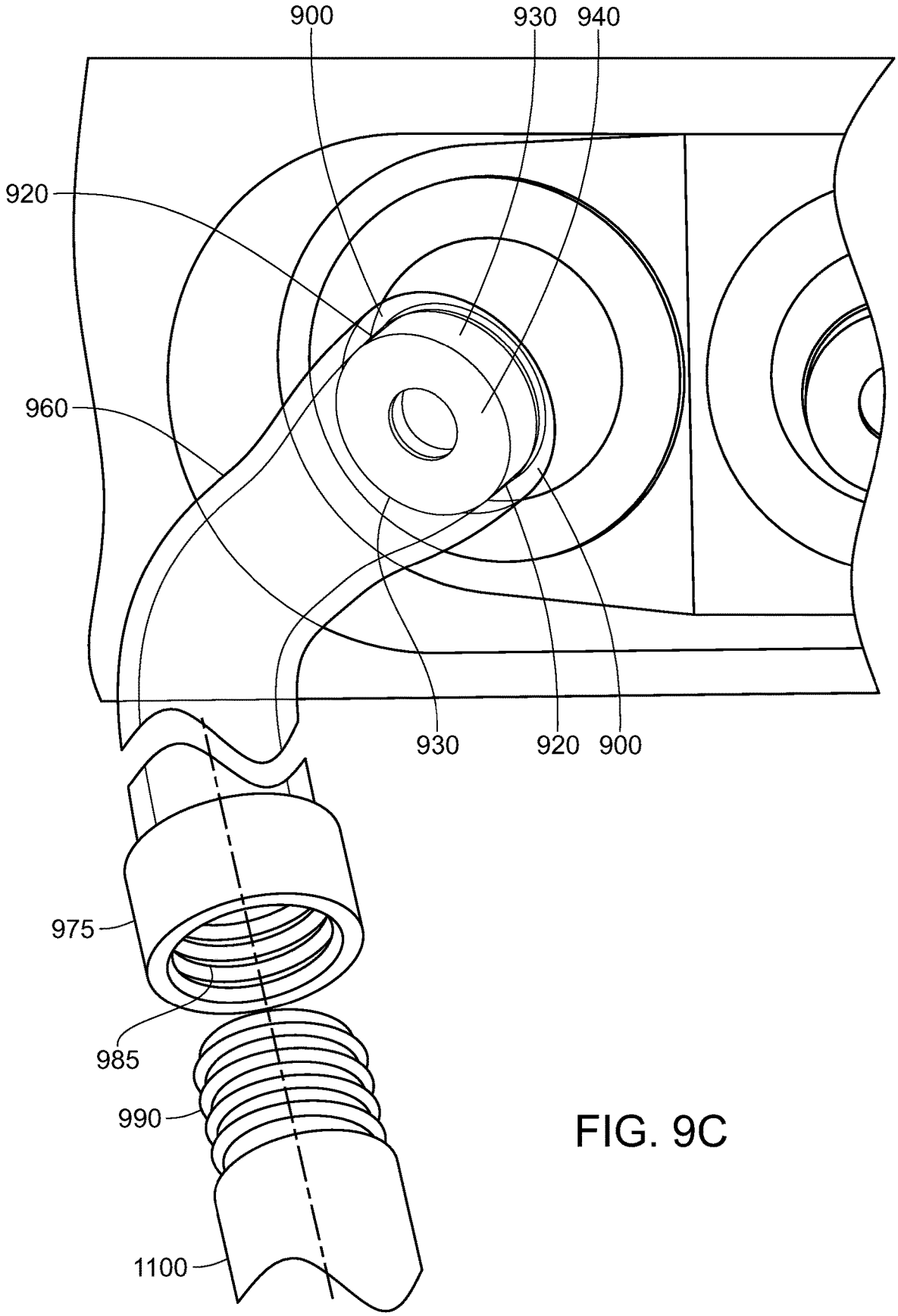
Figure 10:
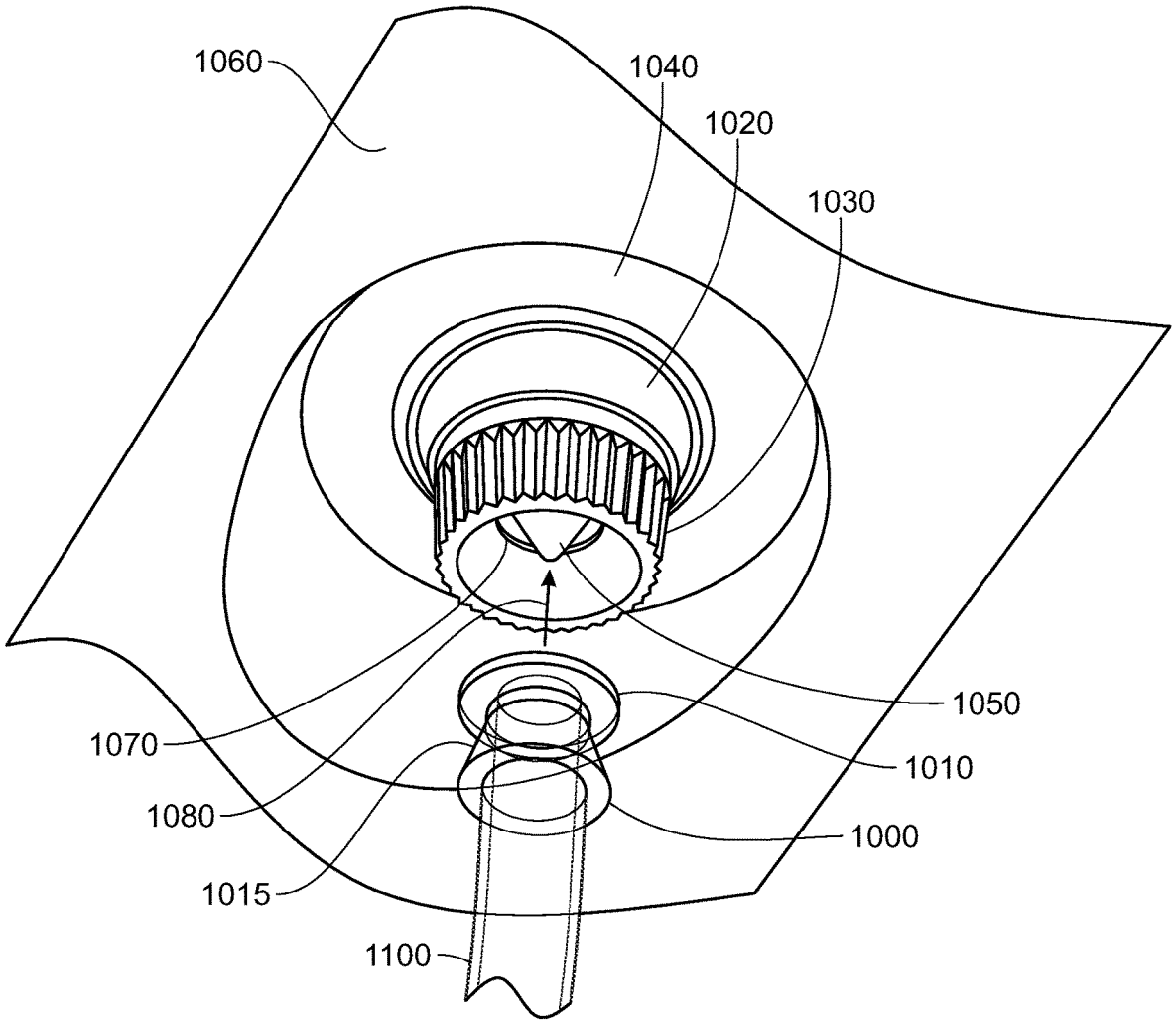
FIG. 10 is an illustrative, non-limiting example of a connector, connecting piece, connector portion, or connector mechanism attached or connected to a tube or an integral part of a tube, configured to fit into or inside an air vent, with the connector, connecting piece, connector portion, or connector mechanism not connected yet to the air vent, according to some embodiments.
Figure 11A:
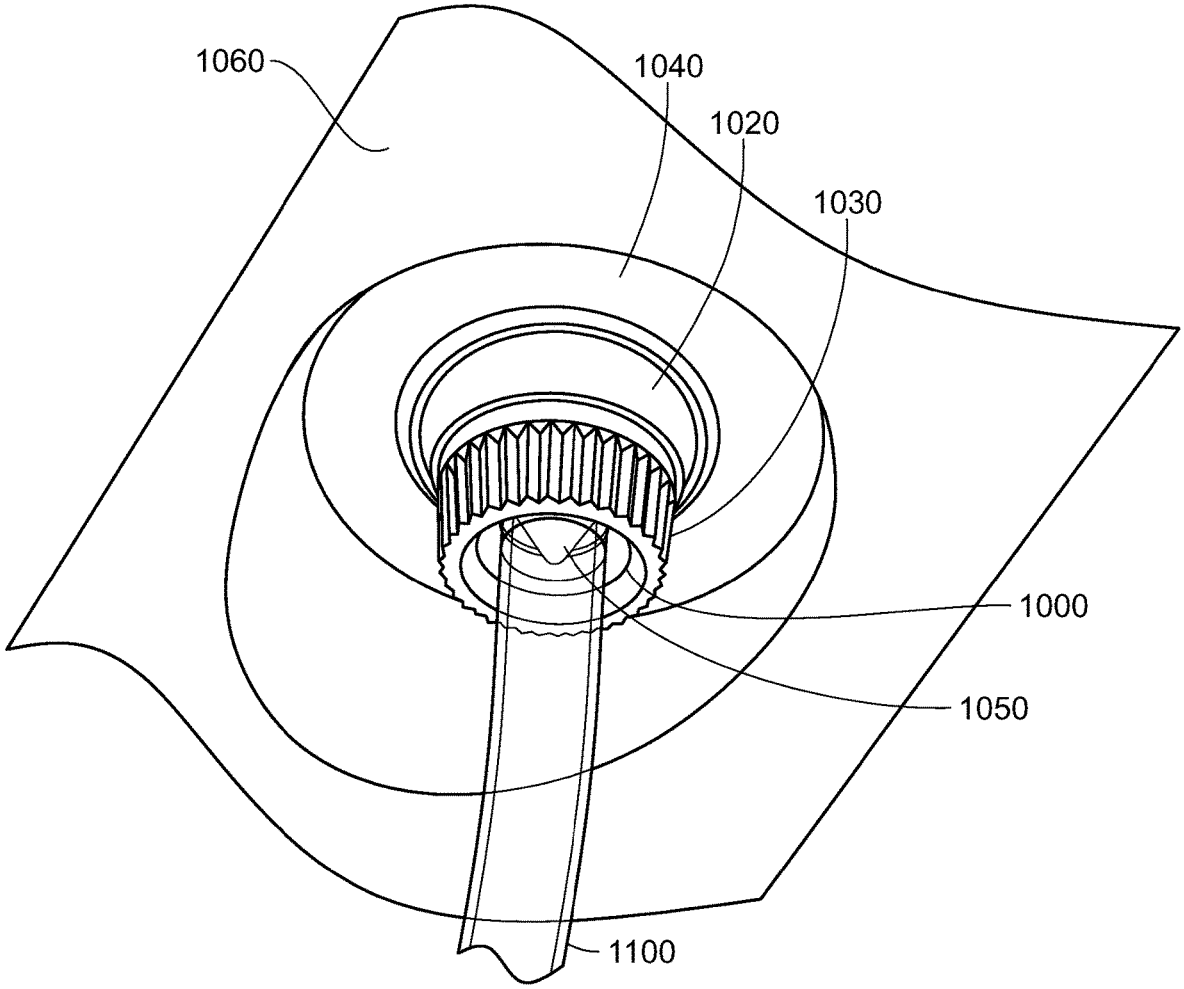
FIGS. 11A-11C are illustrative, non-limiting examples of one or more connectors, connecting pieces, connector portions, or connector mechanisms, attached or connected to a tube or an integral part of a tube, configured to fit into or inside an air vent, with the connector, connecting piece or connector portion connected to the air vent, as well as optional cone shape or threaded connectors, connecting pieces, connector portions, or connector mechanisms to a tube, according to some embodiments.
Figure 11B:
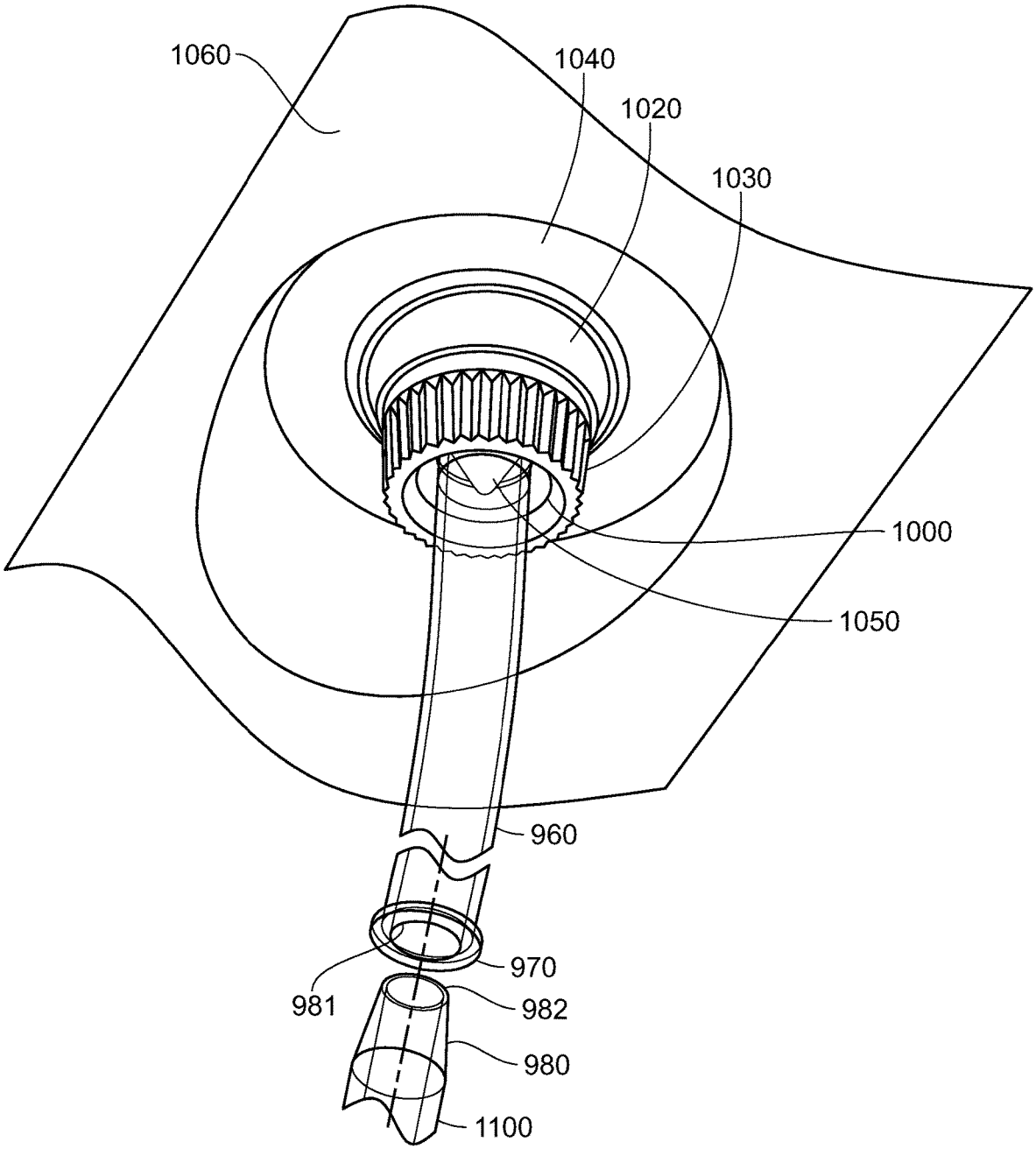
Figure 11C:
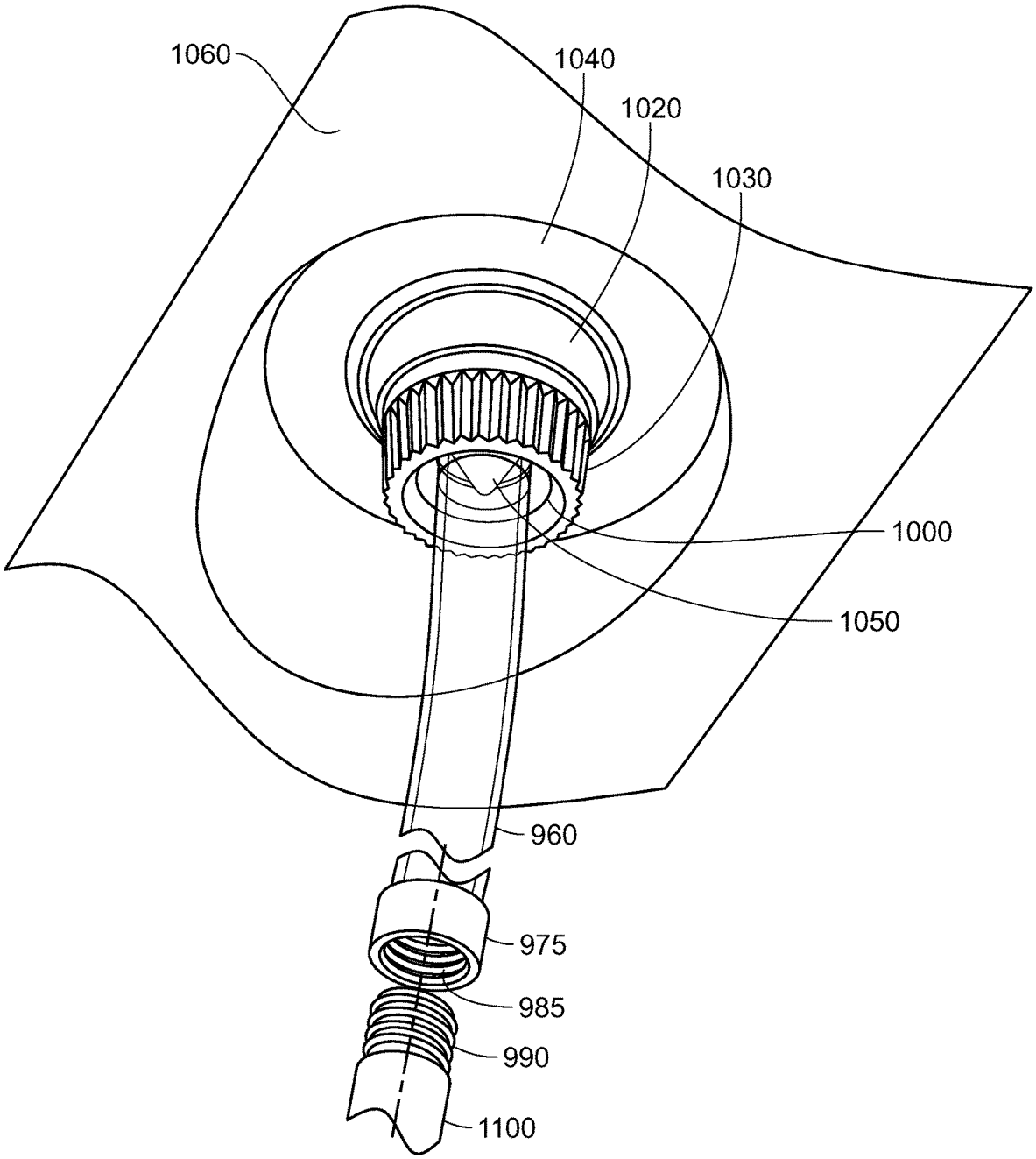
Figure 12A:
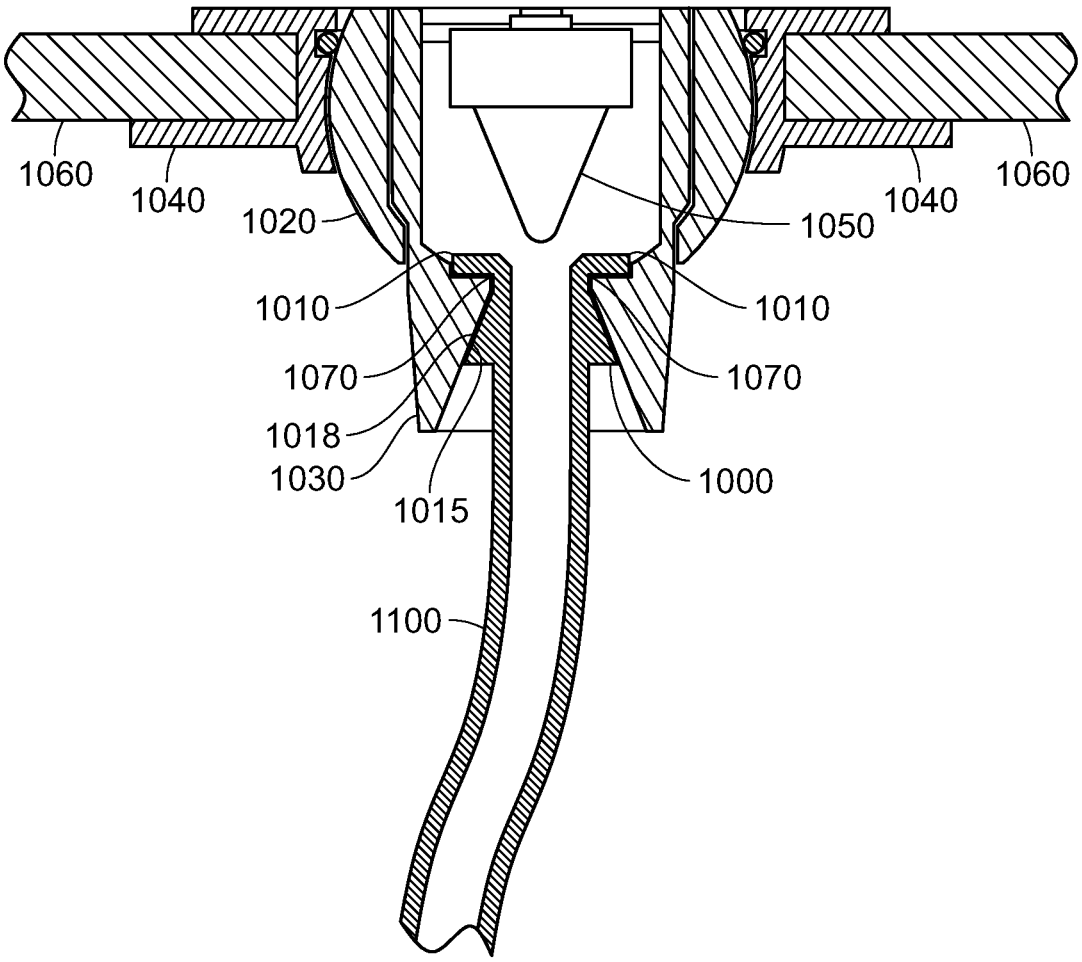
FIGS. 12A-12C are illustrative, non-limiting examples of a cross-sectional view of a connector, connecting piece, connector portion, or connecting mechanism attached or connected to a tube or an integral part of a tube, configured to fit into or inside an air vent, with the connector, connecting piece or connector portion connected to or inserted into the air vent, as well as optional cone shape or threaded connectors, connecting pieces, connector portions, or connector mechanisms to a tube, according to some embodiments.
Figure 12B:
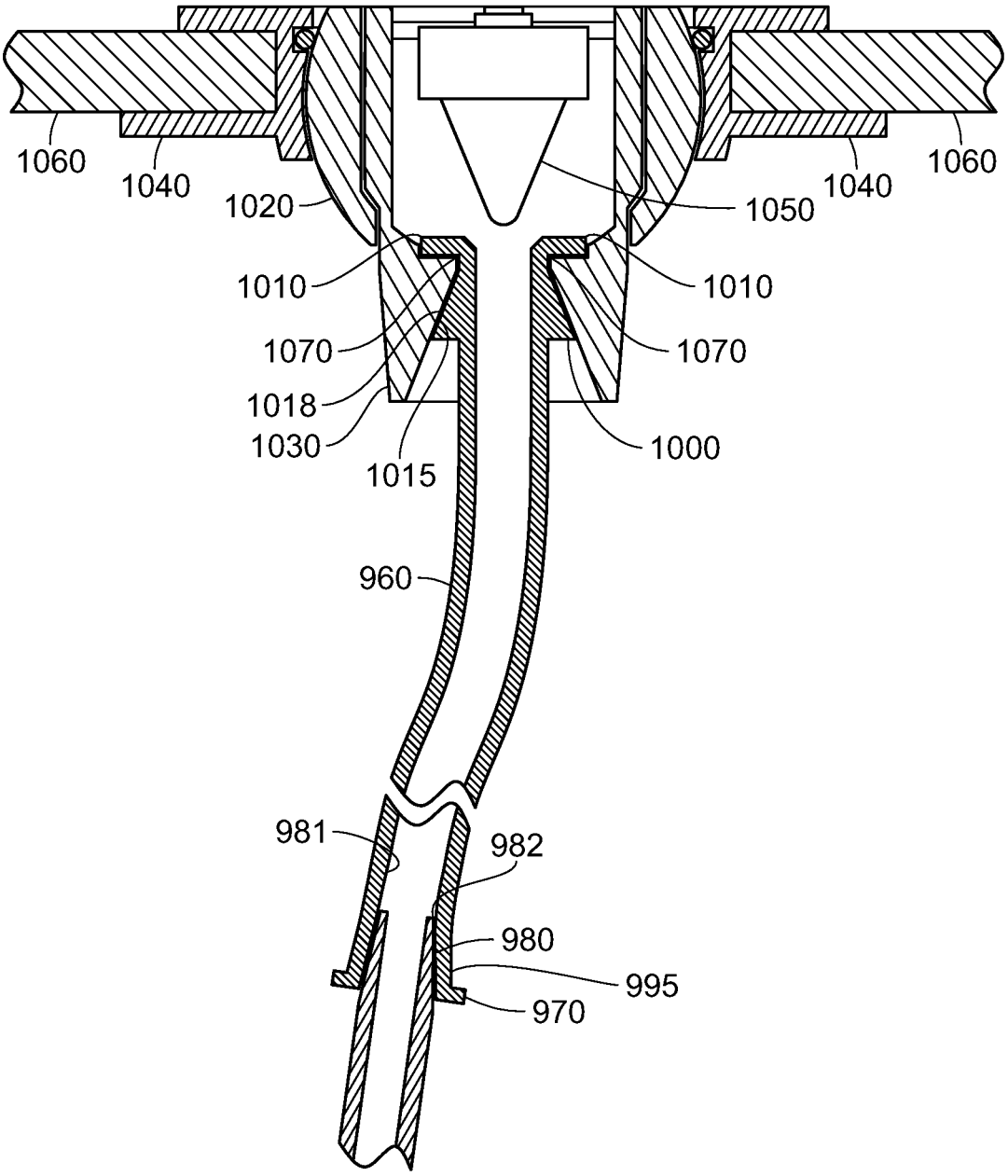
Figure 12C:
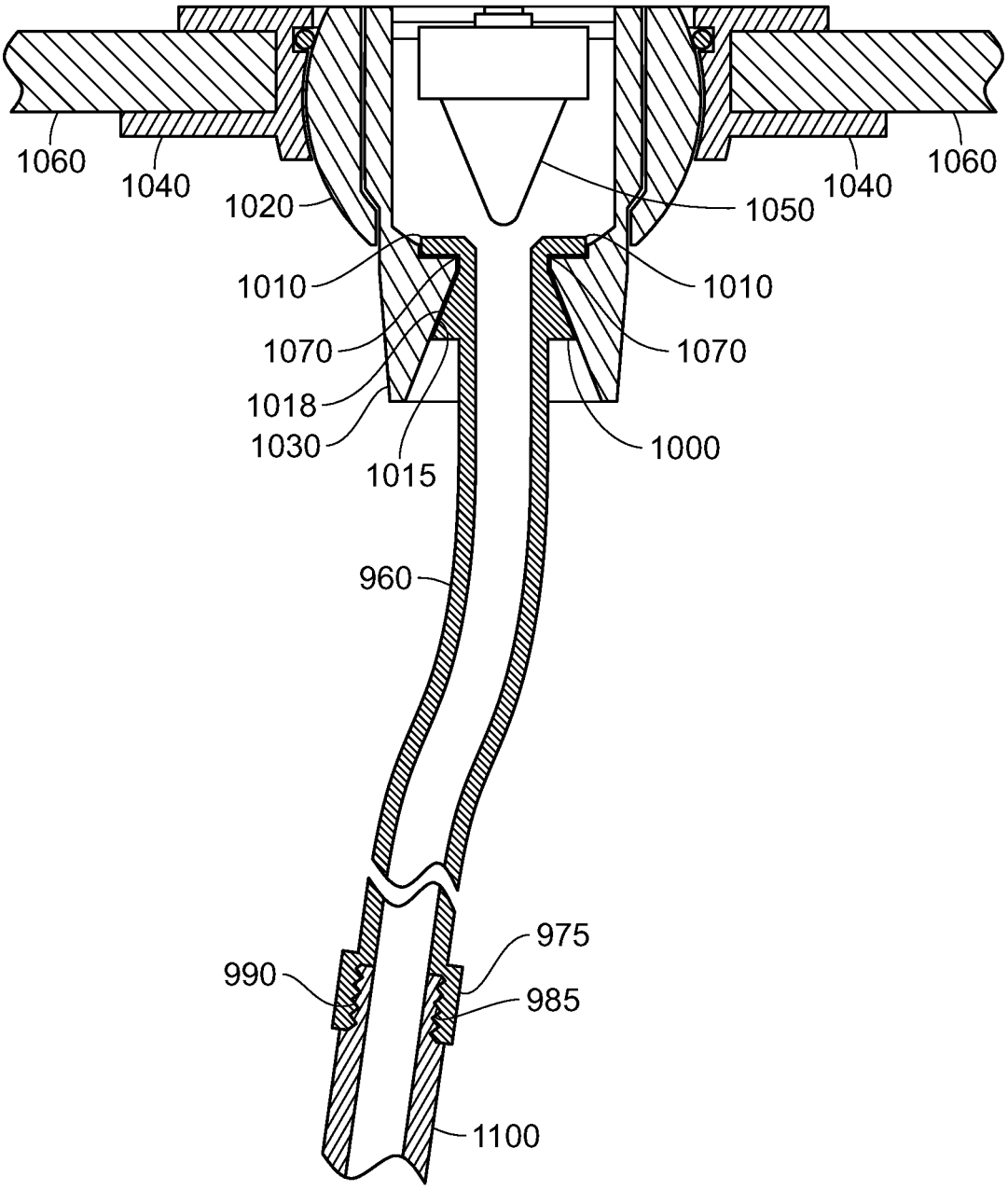

Connectors, Connecting Pieces or Connector Portions with Mirror Image or Negative Shape of Portion of Air Vent In some embodiments, at least a portion of a connector, connecting piece, connector portion or connector mechanism 1000, including an optional extension, member, feature or portion 1010, e.g. a ring-, lip-, or extender-like structure, and/or an optional cone shaped portion 1015 and/or at least a portion of a tube 1100 can have a shape that is at least in part a mirror image or a negative of the shape of at least a portion of an air vent; the at least a portion of the air vent can be on the external facing surface of the air vent, for example for a connector, connecting piece or connector portion 900 configured to fit over and/or to encase and/or to engulf an air vent 940, as shown in an illustrative, non-limiting manner in FIGS. 9A-9C; the at least a portion of the air vent can be on the internal facing surface of the air vent, for example an inner part of an air vent or an opening 1070 of an air vent, as shown in an illustrative, non-limiting manner in FIGS. 10-13D. For example, a cone shaped portion 1015 of a connector, connecting piece or connector portion 1000 or a tube 1100 can be a negative or a mirror image of at least a portion of an inner section of an air vent.

In any of the embodiments throughout the specification, the opening of the air vent can be an outer opening, e.g. at the external rim or perimeter of the air vent; the opening of the air vent can be an inner dimension or portion of the air vent; the opening of the air vent can be an opening that can be part of an opening or closing mechanism of an air vent.

In some embodiments, a second and/or third connector, connecting piece, connector portion or connector mechanism 970 or 975 can be used. A second connector, connector portion, connector piece, and/or connector mechanism (e.g. elements 970 or 975 in FIGS. 9A-9C, FIGS. 11A-11C or FIGS. 12A-12C) can be attached to or integrated into a tube portion 960 or tube like element 960 (e.g. connected to a connector, connector portion, connector piece, and/or connector mechanism at an air vent) and can be configured to be attached to, attachable to, or inserted or insertable into a tube 1100.

A third connector, connector portion, connector piece, and/or connector mechanism (e.g. elements 980 or 990 in FIGS. 9A-9C, FIGS. 11A-11C or FIGS. 12A-12C) can be attached to or integrated into a tube 1100 and can be configured to be attached to, attachable to, insertable or inserted into a tube portion 960 or tube like element 960 and its connector, connector portion, connector piece, and/or connector mechanism (e.g. elements 970 or 975).

In some embodiments, one or more of the connector, connector portion, connector piece, and/or connector mechanism can comprise cone shaped 980, threaded 985 990, male 980 or female, or any other interlocking or attachable mechanism known in the art, e.g. for connecting and/or attaching a first and a second or a second and a third connector, connector portion, connector piece, and/or connector mechanism, optionally with an air tight seal or connection.

The tip or a portion of the cone shaped portion 980 can have a circumference 982 or radius that is smaller than the inner circumference 981 or radius of the connector, connector portion, connector piece, and/or connector mechanism 970. Similar configurations can be applied to or used with a connector, connector portion, connector piece, and/or connector mechanism 1300 (e.g. FIG. 13A) between a tube 1100 and a connector, connector portion, connector piece, and/or connector mechanism 120 of a face mask 100.

Optionally, tubes 1100, tube portions 960 or tube like elements 960 can be deformable, elastic, and/or expandable or can include deformable, elastic, and/or expandable segments, portions or elements 995, for example so that their inner circumference 981 or radius can increase or expand, for example when a connector, connector portion, connector piece, and/or connector mechanism, e.g. cone shaped 970, for example with our circumference 982, is inserted inside (FIG. 12B) or attached to the tube portions 960 or tube like elements 960. Optionally, the male portion or cone shaped portion 970 can be configured not to be deformable or elastic, e.g. with the female portion configured to be deformable or elastic. Optionally, the male portion or cone shaped portion 970 can be configured to be deformable or elastic, e.g. with the female portion configured not to be deformable or elastic.

In some embodiments, the inner circumference 983 (FIG. 9B), diameter or radius of a tube 1100 can be selected, predetermined, and/or configured to determine, adjust, and/or modify an airflow and/or an airflow resistance, e.g. from an air vent. For example, the inner circumference 983 (FIG. 9B), diameter or radius of a tube 1100 can be selected, predetermined, and/or configured so that a contained air flow from an air vent can deliver a tidal volume or an inspiratory capacity volume (FIG. 3) of contained, optionally filtered air from the air vent to the area/volume inside a face mask 100 worn by a passenger.

Tubes, Tube Portions, Tube Like Elements, Connectors, Connecting Pieces or Connector Portions A connector, connecting piece, connector portion, or connector mechanism 1000, including an optional extension, member, feature or portion 1010, e.g. a ring-, lip-, or extender-like structure, and/or an optional cone shaped portion 1015, e.g. for connecting to an air vent, can be part of a tube 1100 or integral to a tube 1100 directing the air supply in a contained manner to a face mask. A connector, connecting piece, connector portion, or connector mechanism 1000, including an optional extension, member, feature or portion 1010, e.g. a ring-, lip-, or extender-like structure, and/or an optional cone shaped portion 1015 and a tube 1100 can be deformable and/or elastic. The connector, connecting piece, connector portion, or connector mechanism 1000, including an optional extension, member, feature or portion 1010, e.g. a ring-, lip-, or extender-like structure, and/or an optional cone shaped portion 1015 can be separate from a tube 1100 directing the air supply in a contained manner to a face mask and can be attached to the tube using an attachment mechanism, e.g. a Luer lock or conical shaped attachment mechanism, for example, with optional male and female parts, and/or a screw type or dovetail like locking mechanism.

A connector, connecting piece, connector portion, or connector mechanism 1000, including an optional extension, member, feature or portion 1010, e.g. a ring-, lip-, or extender-like structure, and/or an optional cone shaped portion 1015 and a tube 1100 can be made of, comprise, or consist of the same material, e.g. plastic, silicon, rubber, metal, cardboard, paper based materials or any other material known in the art. connector, connecting piece, connector portion, or connector mechanism 1000, including an optional extension, member, feature or portion 1010, e.g. a ring-, lip-, or extender-like structure, and/or an optional cone shaped portion 1015 and a tube 1100 can be made of, comprise, or consist of a different material, for example by changing or varying the composition of chemical constituents over the length of the connector, connecting piece, connector portion, or connector mechanism 1000, including an optional extension, member, feature or portion 1010, e.g. a ring-, lip-, or extender-like structure, and/or an optional cone shaped portion 1015 and the tube 1100, or by selectively processing or treating different portions of the connector, connecting piece, connector portion, or connector mechanism 1000, including an optional extension, member, feature or portion 1010, e.g. a ring-, lip-, or extender-like structure, and/or an optional cone shaped portion 1015 and the tube 1100 to alter the material properties, e.g. using heat treatment, pressure treatment, or radiation exposure. The material can be transparent or non-transparent, e.g. opaque. The material can be a plastic. The material can be a polyethylene (PE), polyvinylchloride (PVC), polycarbonate (PC), a silicon or silicon based material, or any other material.

In any of the embodiments throughout the specification, the connection between a connector, connecting piece or connector portion 1000 (e.g. to an air vent or a face mask) and a tube 1100 can be air tight, i.e. can be configured to prevent air from exiting between the connector, connecting piece or connector portion 1000 and the tube 1100.

The connector, connecting piece, connector portion, or connector mechanism can be part of a tube 1100, or tube portion or tube like element 960 or the tube 1100, or tube portion or tube like element 960 can, for example, be attached to the connector, connecting piece, connector portion, or connector mechanism. Locking mechanisms and/or attachment mechanisms, e.g. screw type 985 990, Luer lock style, interlocking type, adhesive based, can be used to connect and/or attach the connector to the air vent and/or to attach and/or connect the tube 1100, or tube portion or tube like element 960 to the connector, connecting piece, connector portion, or connector mechanism, e.g. for the 1100, or tube portion or tube like element 960 or a connector, connecting piece, connector portion, or connector mechanism 120 of a face mask 100. Any locking mechanism or attachment mechanism known in the art for attaching the connector to the air vent and/or for connecting the tube to the connector. The connector can be part of the tube, e.g. in a single piece or in form of two or more assembled (and pre-installed or already connected) pieces.

Face Mask Connector Mechanism, Connector Portion or Connector Piece

In some embodiments, the face mask can comprise a connector, connector mechanism, connector portion or connector piece 120 (FIGS. 1, 2, 13-17), for example for connecting, attaching, or accepting a tube 1100 connected or attached to an air vent 140, supplying filtered air supply from the air vent 140. The connector, connector mechanism, connector portion or connector piece 120 can, for example, be comprised of a plastic or silicon or metal or other suitable material. The connector, connector mechanism, connector portion or connector piece 120 can be integrated or attached to the face mask 100. The connector, connector mechanism, connector portion or connector piece 120 can be integrated or attached to a particulate filtering portion, particulate filtering facepiece, particulate filtering facepiece respirator, mechanical filter respirator or mechanical filter respirator portion 110 of a face mask 100. The connector, connector mechanism, connector portion of connector piece 120 can be configured to fit into and fill and/or extend over an opening 130 of the face mask (FIG. 13), e.g. in the center portion of the face mask. For example, the connector, connector mechanism, connector portion or connector piece 120 can have at least one or more rims, extenders, or members 135 137 with dimensions, a radius or diameter larger than the opening 130 of the face mask and at least one portion 139 with dimensions, a radius or diameter smaller than the opening 130 of the face mask; in this manner, the edge of the opening 130 of the face mask can be placed facing the at least one portion 139 with dimensions, a radius or diameter smaller than the opening 130 of the face mask, with the one or more rims 135 137 extending over the opening 130 of the face mask, e.g. on an external facing and a face facing side of the face mask 100.

In another embodiment, the connector, connector mechanism, connector portion or connector piece 120 can be embedded or inserted within or inside one or more layers of the face mask 100, for example a portion (e.g. woven or non-woven) of a particulate filtering portion, particulate filtering facepiece, particulate filtering facepiece respirator, mechanical filter respirator or mechanical filter respirator portion 110.

The connector, connector mechanism, connector portion or connector piece 120 can be attached to or integrated into the face mask using an adhesive or a glue. The connector, connector mechanism, connector portion or connector piece 120 can be integrated or attached into the face mask by placing at least a portion of the connector, connector mechanism, connector portion or connector piece between layers of the face mask, e.g. layers of a mechanical respirator portion of the face mask.

The connector, connector portion or connector piece 120 can be configured to accept, accommodate, include or comprise a mechanical connector mechanism or attachment mechanism 1200, e.g. for a tube 1100. The mechanical connector mechanism or attachment mechanism 1200 can be configured to connect to a tube 1100, e.g. connected to an air vent and transporting or carrying contained, optionally filtered air flow or air supply from the aircraft ventilation system. The connector mechanism or attachment mechanism 1200 can be connected to the tube 1100 using a locking mechanism and/or attachment mechanism, e.g. screw type, Luer lock style, interlocking type, adhesive based. Any locking mechanism and/or attachment mechanism known in the art can be used to connect the tube 1100 (extending from the air vent) to the connector, connector mechanism, connector portion or connector piece 120 of the face mask 100.

In any of the embodiments throughout the specification, the connection between a connector, connector portion or connector piece 120 and a face mask 100 and/or its particulate filtering portion, particulate filtering facepiece, particulate filtering facepiece respirator, mechanical filter respirator or mechanical filter respirator portion 110 can be air tight, i.e. can be configured to prevent air from exiting.

Figure 14A:
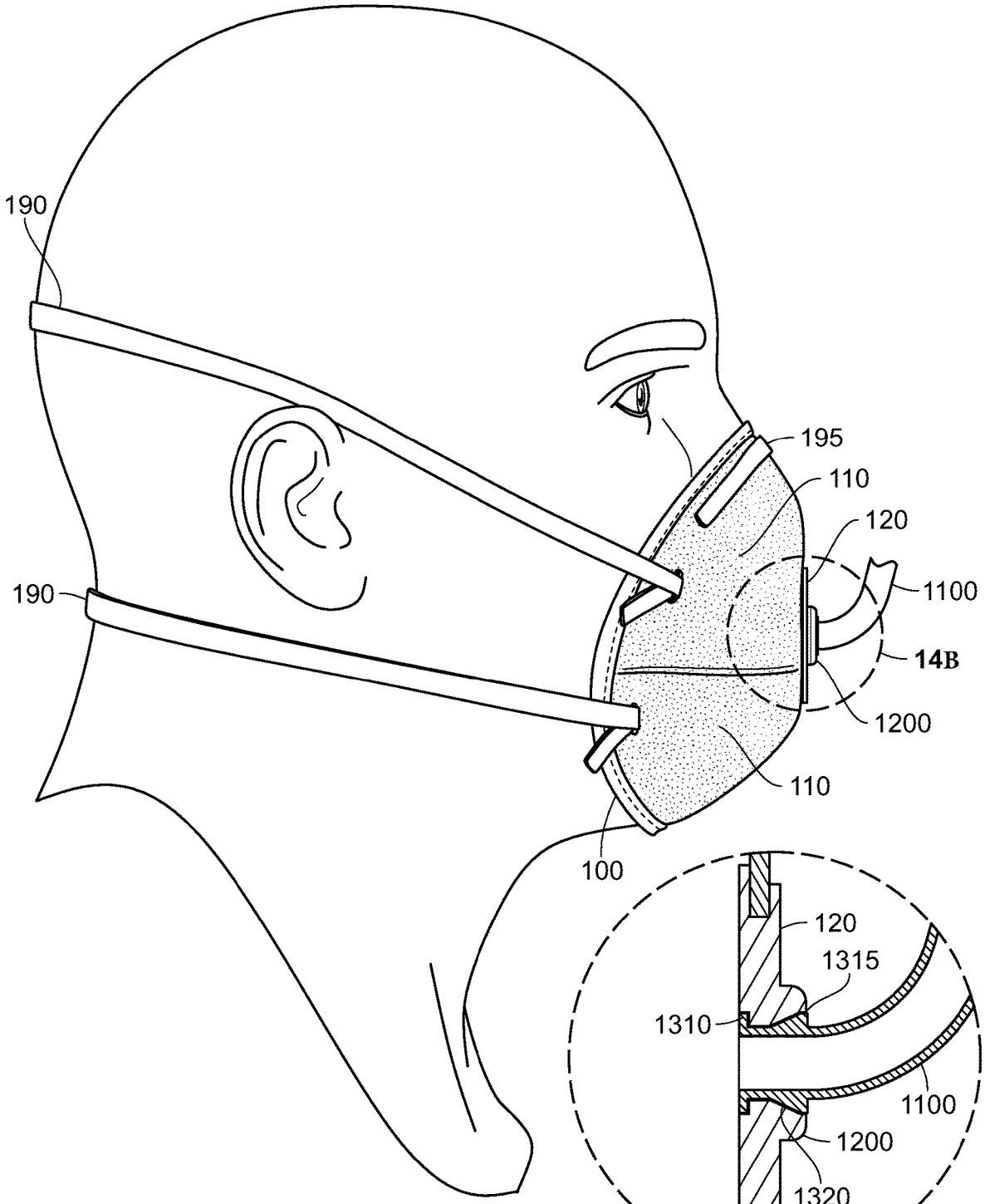
FIGS. 14A-14B are illustrative, non-limiting examples of components of a face mask with one or more connectors, connecting pieces, connector portions, or connector mechanisms for connecting, attaching, inserting or accepting a tube, optionally connected or attached to an air vent, supplying filtered air supply from the air vent according to some embodiments. Various illustrative, non-limiting embodiments or examples of connecting a tube, e.g. providing contained, optionally filtered air supply from an air vent, to a face mask are shown.
Figure 14B:
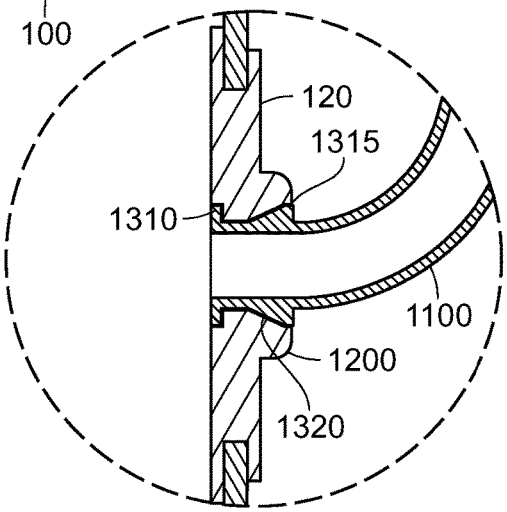
Figure 15:
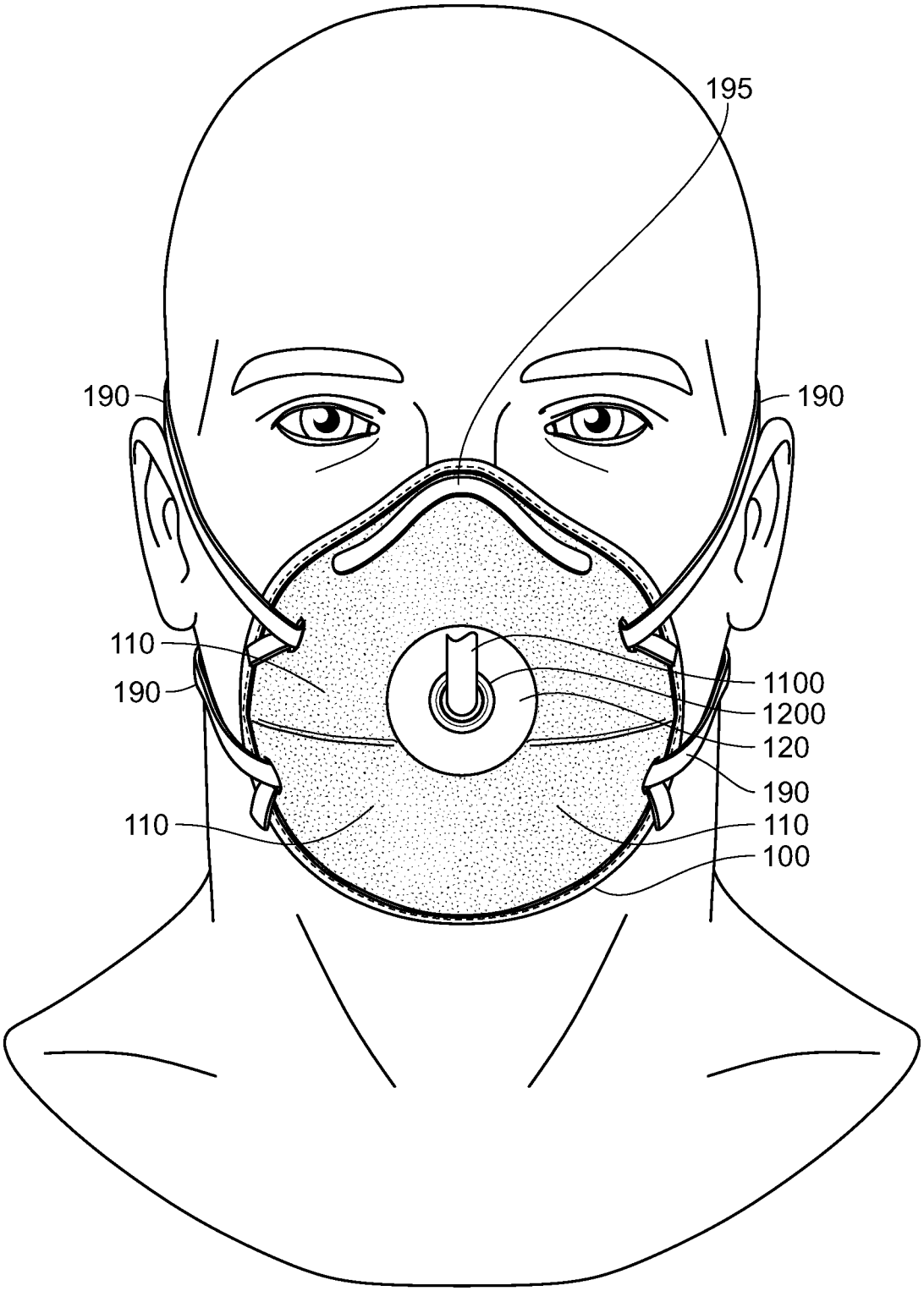
FIG. 15 is an illustrative, non-limiting example of a face mask with a connector, connector mechanism, connector portion or connector piece for connecting, attaching, inserting or accepting a tube, optionally connected or attached to an air vent, supplying filtered air supply from the air vent according to some embodiments.
Figure 16:
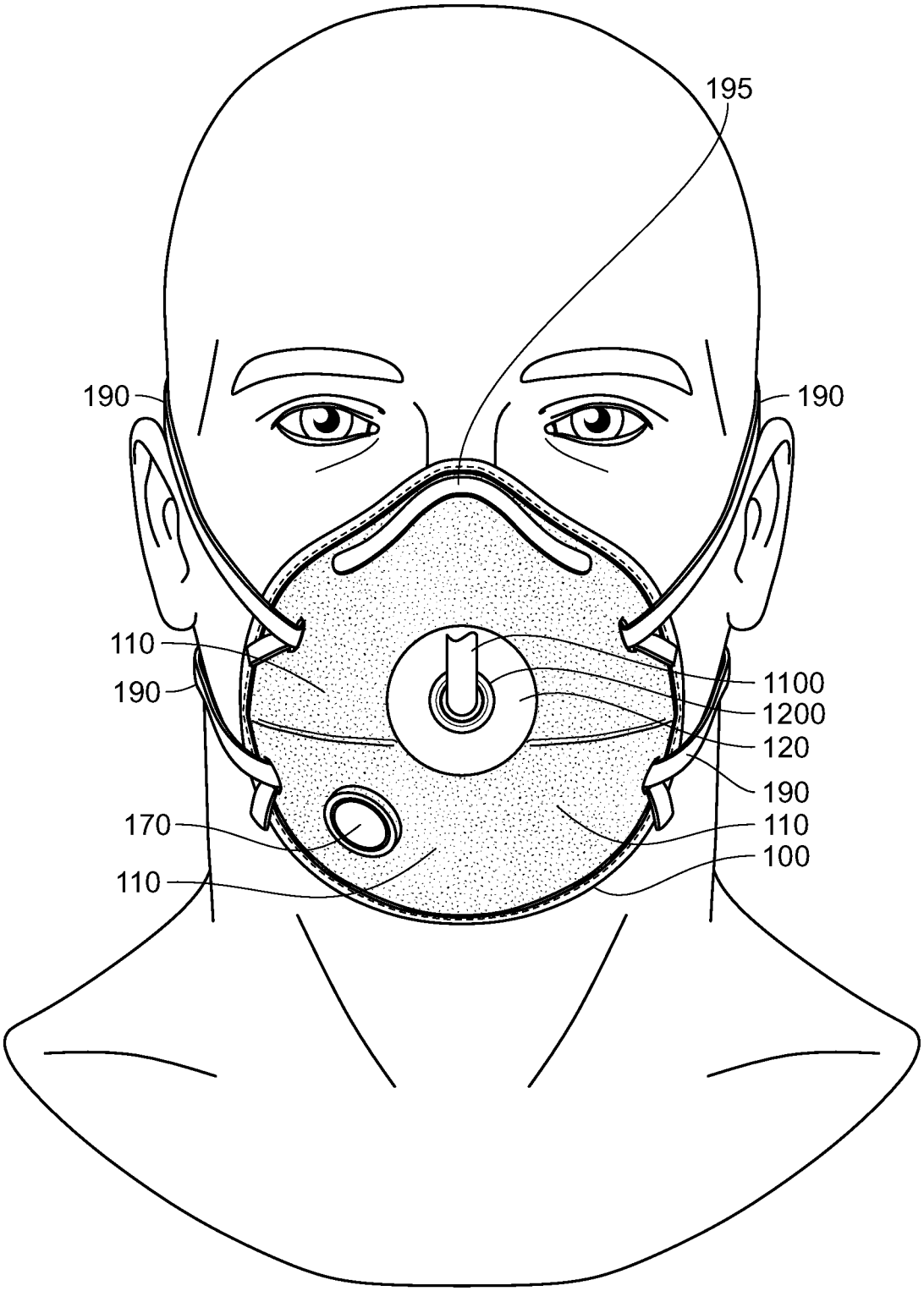
FIG. 16 is an illustrative, non-limiting example of a face mask with a connector, connector mechanism, connector portion or connector piece for connecting, attaching, inserting or accepting a tube, optionally connected or attached to an air vent, supplying filtered air supply from the air vent, and an optional valve integrated into the face mask, for example to facilitate expiration, according to some embodiments.
Figure 17:
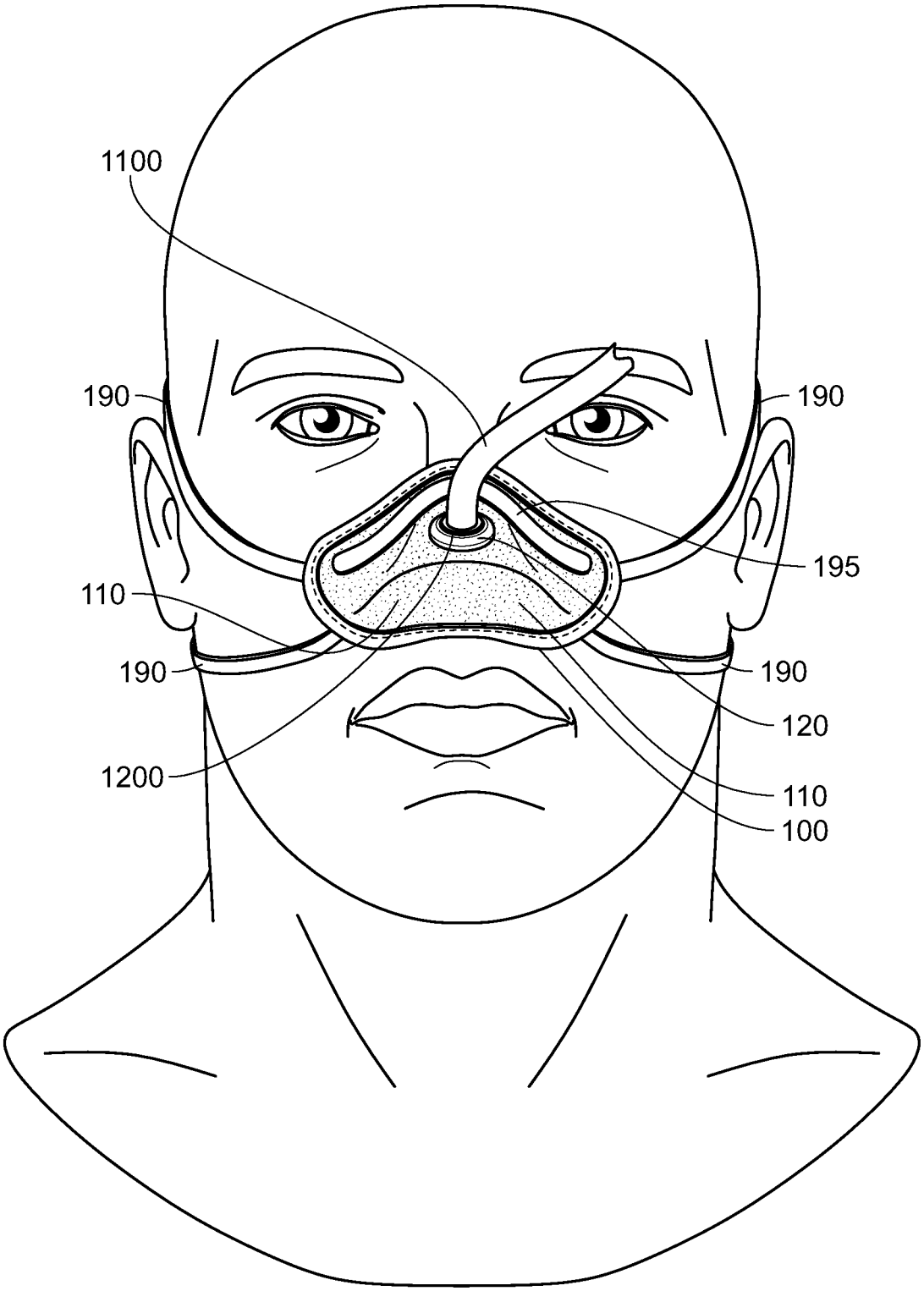
FIG. 17 is an illustrative, non-limiting example of a face mask with a connector, connector mechanism, connector portion or connector piece for connecting, attaching, inserting or accepting a tube, optionally connected or attached to an air vent, supplying filtered air supply from the air vent, according to some embodiments. The face mask is configured to cover the nasal area and nostrils, but not the mouth, thereby facilitating use during eating or drinking.

The tube 1100 can comprise a connector, connecting piece or connector portion 1300 (FIG. 13), including one or more optional extensions, members, features or portions 1310 1315, e.g. ring-, lip-, or extender-like structures, and/or an optional cone shaped portion 1320 for connecting to a face mask 100, e.g. the connector, connector portion or connector piece 120 of the face mask 100 (FIGS. 13, 14A, and 14B).

The connector, connecting piece, connector portion, or connecting mechanism 1300 of the tube 1100, including one or more optional extensions, members, features or portions 1310 1315, e.g. ring-, lip-, or extender-like structures, and/or an optional cone shaped portion 1320, e.g. for connecting to the face mask 100 and/or its connector, connector portion or connector piece 120 can be part of the tube 1100 or integral to the tube 1100 directing the air supply in a contained manner to the face mask 100.

The connector, connecting piece or connector portion 1300 of the tube 1100, including one or more optional extensions, members, features or portions 1310 1315, e.g. ring-, lip-, or extender-like structures, and/or an optional cone shaped portion 1320, e.g. for connecting to the face mask 100 and/or its connector, connector portion or connector piece 120 can be deformable and/or elastic. The connector, connecting piece or connector portion 1300 of the tube 1100, including one or more optional extensions, members, features or portions 1310 1315, e.g. ring-, lip-, or extender-like structures, and/or an optional cone shaped portion 1320, e.g. for connecting to the face mask 100 and/or its connector, connector portion or connector piece 120 can be separate from the tube 1100 directing the air supply in a contained manner to a face mask and can be attached to the tube using an attachment mechanism, e.g. a Luer lock or conical shaped attachment mechanism, for example, with optional male and female parts, and/or a screw type, cone shaped or dovetail like locking mechanism.

The connector, connecting piece or connector portion 1300 of the tube 1100, including one or more optional extensions, members, features or portions 1310 1315, e.g. ring-, lip-, or extender-like structures, and/or an optional cone shaped portion 1320, e.g. for connecting to the face mask 100 and/or its connector, connector portion or connector piece 120 can be integral or be part of the tube 1100 directing the air supply in a contained manner to a face mask, as shown, for example, in an illustrative fashion, not limiting the invention in FIG. 13B.

A connector, connecting piece or connector portion 1300 of a tube 1100, including one or more optional extensions, members, features or portions 1310 1315, e.g. ring-, lip-, or extender-like structures, and/or an optional cone shaped portion 1320, e.g. for connecting to a face mask 100 and/or its connector, connector portion or connector piece 120 can be made of, comprise, or consist of the same material, e.g. plastic, silicone, rubber, paper or fiber based materials, metal, or any other material known in the art. A connector, connecting piece or connector portion 1300 of a tube 1100, including one or more optional extensions, members, features or portions 1310 1315, e.g. ring-, lip-, or extender-like structures, and/or an optional cone shaped portion 1320, e.g. for connecting to a face mask 100 and/or its connector, connector portion or connector piece 120 can be made of, comprise, or consist of a different material, for example by changing or varying the composition of chemical constituents over the length of the connector, connecting piece or connector portion 1300, including one or more optional extensions, members, features or portions 1310 1315, e.g. ring-, lip-, or extender-like structures, and/or an optional cone shaped portion 1320 and the tube 1100, or by selectively processing or treating different portions of the connector, connecting piece or connector portion 1300, including one or more optional extensions, members, features or portions 1310 1315, e.g. ring-, lip-, or extender-like structures, and/or an optional cone shaped portion 1320 and the tube 1100 to alter the material properties, e.g. using heat treatment, pressure treatment, or radiation exposure. The material can be transparent or non-transparent, e.g. opaque. The material can be a plastic. The material can be a polyethylene (PE), polyvinylchloride (PVC), polycarbonate (PC), a silicon or silicon based material, or any other material.

In any of the embodiments throughout the specification, the connection between a connector, connecting piece or connector portion 1300 of the tube 1100 to a face mask 100 and/or its connector, connector portion or connector piece 120 and/or its connector mechanism or attachment mechanism 1200 can be air tight, i.e. can be configured to prevent air from exiting.

The connector, connecting piece or connector portion 1300 of a tube 1100 can be part of the tube 1100, or the tube 1100 can, for example, be attached to the connector, connecting piece, connector portion, or connecting mechanism 1300, e.g. using a second or other connector, connecting piece, connector portion, or connecting mechanism. Locking mechanisms and/or attachment mechanisms, e.g. screw type, cone shaped, Luer lock style, interlocking type, adhesive based, can be used to connect and/or attach the connector, connecting piece or connector portion 1300 to the tube 1100 and/or to attach and/or connect the tube to the connector. Any locking mechanism or attachment mechanism known in the art for attaching the connector, connecting piece or connector portion 1300 to the tube 1100 can be used. The connector, connecting piece or connector portion 1300 can be part of the tube 1100, e.g. in a single piece or in form of two or more assembled (and pre-installed or already connected) pieces.

The connector, connecting piece or connector portion 1300 of a tube 1100 can comprise one or more optional extensions, members, features or portions 1310 1315, e.g. ring-, lip-, or extender-like structures, and/or an optional cone shaped portion 1320, which can, optionally, be deformable, e.g. for insertion into a connector mechanism or attachment mechanism 1200 and/or a connector, connector portion or connector piece 120 of a face mask 100. The tube 1100 can, optionally, be deformable, e.g. for insertion into a connector mechanism or attachment mechanism 1200 and/or a connector, connector portion or connector piece 120 of a face mask 100.

The connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 can have an outer diameter, radius and/or dimension that can be greater than, the same, or smaller than the opening 130 of the face mask 100. The connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 can be deformable and can be deformed, e.g. squeezed, to allow passing it into or for insertion into a connector mechanism or attachment mechanism 1200 and/or a connector, connector portion or connector piece 120 of the face mask 100. Once passed through the opening 130 of the face mask 100, the connector, connecting piece, connector portion, or connecting mechanism 1300 of the tube 1100, optionally including one or more extensions, members, features or portions 1310 1315, e.g. ring-, lip-, or extender-like structures, and/or an optional cone shaped portion 1320, and/or the tube 1100 can expand and, by re-taking its natural form, can be self-seating, self-securing, and/or secured inside and/or against a wall portion of the connector mechanism or attachment mechanism 1200 and/or the connector, connector portion or connector piece 120 of the face mask 100.

For example, the deformable or elastic portion of the connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 can be squeezed inside or advanced into the opening 130 of the face mask 100 and/or the connector mechanism or attachment mechanism 1200 and/or the connector, connecting piece, connector portion, or connecting mechanism 120 of the face mask 100 and can expand into its normal, expanded dimensions and/or diameter once it has been passed through the opening 130.

At least a portion of the elastic portion of the connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 configured to be fitted inside and/or into the opening 130 of the face mask 100 and/or the connector mechanism or attachment mechanism 1200 and/or the connector, connector portion or connector piece 120 of the face mask 100 can have an outer diameter, radius, circumference and/or dimension that is the same or smaller than the inner diameter, radius, circumference and/or dimension and/or shape of at least a portion of the opening 130 of the face mask 100 and/or the connector mechanism or attachment mechanism 1200 and/or the connector, connector portion or connector piece 120 of the face mask 100 into which it is to be fitted or to which it is to be attached or connected.

In another embodiment, at least a portion of the connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 configured to be fitted inside and/or into the opening 130 of the face mask 100 and/or the connector mechanism or attachment mechanism 1200 and/or the connector, connector portion or connector piece 120 of the face mask 100 can have an outer diameter, radius, circumference, dimension, and/or shape that is the same or greater than the inner diameter, radius, circumference, dimension, and/or shape of at least a portion of the opening 130 of the face mask 100 and/or the connector mechanism or attachment mechanism 1200 and/or the connector, connector portion or connector piece 120 of the face mask 100 which it is to be fitted or attached.

In another embodiment, at least a portion of the connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 configured to be attached to the face mask 100 and/or the connector mechanism or attachment mechanism 1200 and/or the connector, connector portion or connector piece 120 of the face mask 100 can have an outer diameter, radius, circumference, dimension, and/or shape that is the same, smaller, or greater than the inner diameter, radius, circumference, dimension, and/or shape of at least a portion of the opening 130 of the face mask 100 and/or the connector mechanism or attachment mechanism 1200 and/or the connector, connector portion or connector piece 120 of the face mask 100 which it is to be fitted or attached.

At least a portion of a connector, connecting piece, connector portion, or connecting mechanism 1300 of a tube 1100, optionally including one or more extensions, members, features or portions 1310 1315, e.g. ring-, lip-, or extender-like structures, and/or an optional cone shaped portion 1320, and/or the tube 1100 and/or at least a portion of a tube 1100 can be deformable and/or elastic and can be configured so that the at least a portion of the connector, connecting piece or connector portion 1300 of a tube 1100, optionally including one or more extensions, members, features or portions 1310 1315, e.g. ring-, lip-, or extender-like structures, and/or an optional cone shaped portion 1320, and/or the tube 1100 and/or at least a portion of a tube 1100 can be squeezed or advanced to allow for fitting inside or insertion into at least a portion of an opening 130 of a face mask 100 and/or the connector mechanism or attachment mechanism 1200 and/or the connector, connector portion or connector piece 120 of the face mask 100 and/or can be configured to allow for returning to its/their original shape and/or dimensions once an external force (e.g. a squeeze or pinch between two or more fingers or a forward, backward, downward or upward force and/or movement) is released, e.g. after passing through an opening 130 in the face mask 100 and/or the connector mechanism or attachment mechanism 1200 and/or the connector, connector portion or connector piece 120 of the face mask 100.

In this exemplary manner, the at least a portion of the connector, connecting piece, connector portion, or connecting mechanism n 1300 of a tube 1100, optionally including one or more extensions, members, features or portions 1310 1315, e.g. ring-, lip-, or extender-like structures, and/or an optional cone shaped portion 1320, and/or the tube 1100 and/or at least a portion of a tube 1100 can re-expand and return to their original shape once attached to or seated inside at least a portion of an opening 130 of a face mask 100 and/or the connector mechanism or attachment mechanism 1200 and/or the connector, connector portion or connector piece 120 of the face mask 100.

In any of the foregoing embodiments, a connector, connecting piece, connector portion, or connecting mechanism 1300 to the face mask can be a part of a tube 1100, e.g. an integral part of a tube, which can optionally be fitted inside an opening of the air vent or inside the air vent. In any of the foregoing embodiments, the connector, connecting piece or connector portion 1300 to the face mask can be separate from the tube 1100, e.g. connected to the tube using a second (or third, fourth, fifth, or sixth) tube facing connector, connecting piece, connector portion, or connecting mechanism.

Once the tube 1100 is connected to the connector, connector mechanism, connector portion or connector piece 1200 of the face mask 100, contained airflow can be delivered from the aircraft ventilation system via the air vent 140 and the opening in the air vent 1070 and the tube 1100 connected to the air vent to the connector, connector mechanism, connector portion or connector piece 1200 and the face mask 100 for inhalation or inspiration by the user (see, for example, FIG. 1).

Optionally, a connector, connecting piece, connector portion, or connecting mechanism 1000 (e.g. to air vent), 1200 (e.g. part of face mask 100), 1300 (e.g. for connecting to a face mask) can comprise a valve. For example, the valve can be configured to allow for inhalation or inspiration. The valve can be configured to allow for exhalation or expiration. The valve can be configured to block inhalation or inspiration. The valve can be configured to block exhalation or expiration. For example, the valve(s) can be configured to block exhalation into a connector, connecting piece, connector portion, or connecting mechanism 1000 (e.g. to air vent), 1200 (e.g. part of face mask 100), 1300 (e.g. for connecting to a face mask) and/or tube and/or reservoir.

In some embodiments, as shown, in a non-limiting, illustrative example, in FIGS. 13C-13D, a valve or valve mechanism 1380 can optionally be spring loaded 1385, with optional gaskets 1375 to maintain an air seal when a tube 1100 with (for example, a first) connector portion or connecting piece 1370, optionally tapered or with smaller outer diameter than the tube 1100, is not inserted into (a second) connector or connecting piece 120 in the face mask. When the tube 1100 with (for example, a first) connector portion or connecting piece 1370 is inserted into the connector or connecting piece 120 of the face mask, the tube 1100 and/or the (for example, first) connector portion or connecting piece 1370 can mechanically move, adjust or activate the valve or valve mechanism 1380, e.g. by depressing the spring loaded mechanism 1385, and, for example, align airflow openings or vents 1365 in the tube and (for example, second) connector or connecting piece 120 to facilitate airflow from the tube 1100 inside the mask (e.g. the volume between the inner surface or layer 1350 of the mask and the face of the passenger). In some embodiments, optional gaskets 1375 can assist in holding the tube 1100 and/or (first) connector or connecting piece 1370 in place by expanding, for example, into recesses 1390 in the tube 1100 and/or (first) connector or connecting piece 1370. The gasket(s) can also be configured to achieve an air tight seal, e.g. with the connector, connecting piece, connecting portion or connecting mechanism 1370 inserted or not inserted into the connector, connecting piece, connecting portion or connecting mechanism 120. Alternatively, the gasket(s) can be mounted onto or integrated into the (first) connector or connecting piece 1370 or the tube 1100, with the recess(es) for example integrated into the (second) connector or connecting piece 120 of the face mask.

Figure 18:
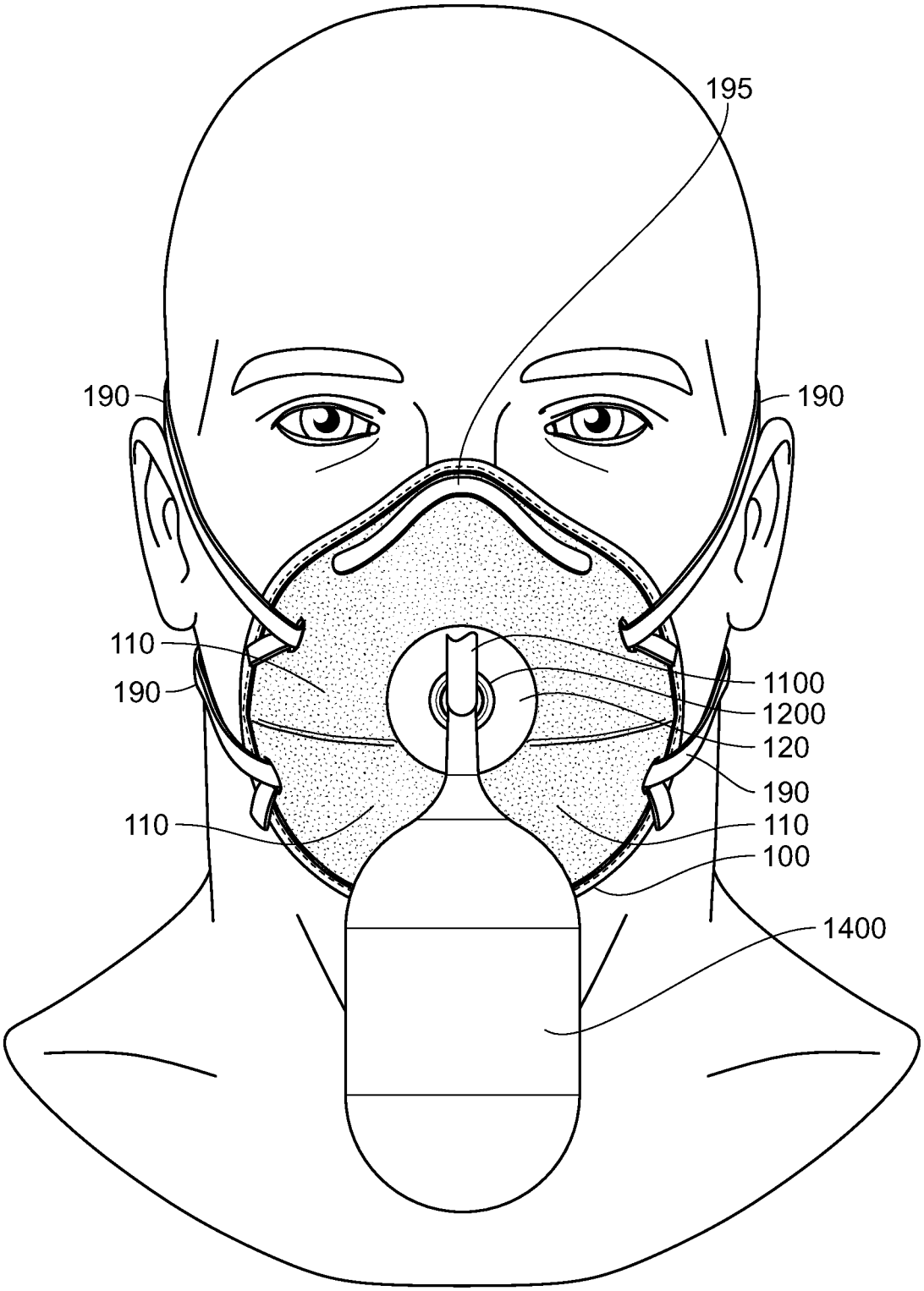
FIG. 18 is an illustrative, non-limiting example of a frontal view of a face mask with a connector, connector mechanism, connector portion or connector piece for connecting, attaching, inserting or accepting a tube, optionally connected or attached to an air vent, supplying filtered air supply from the air vent, with an optional air reservoir, according to some embodiments.
Figure 19:
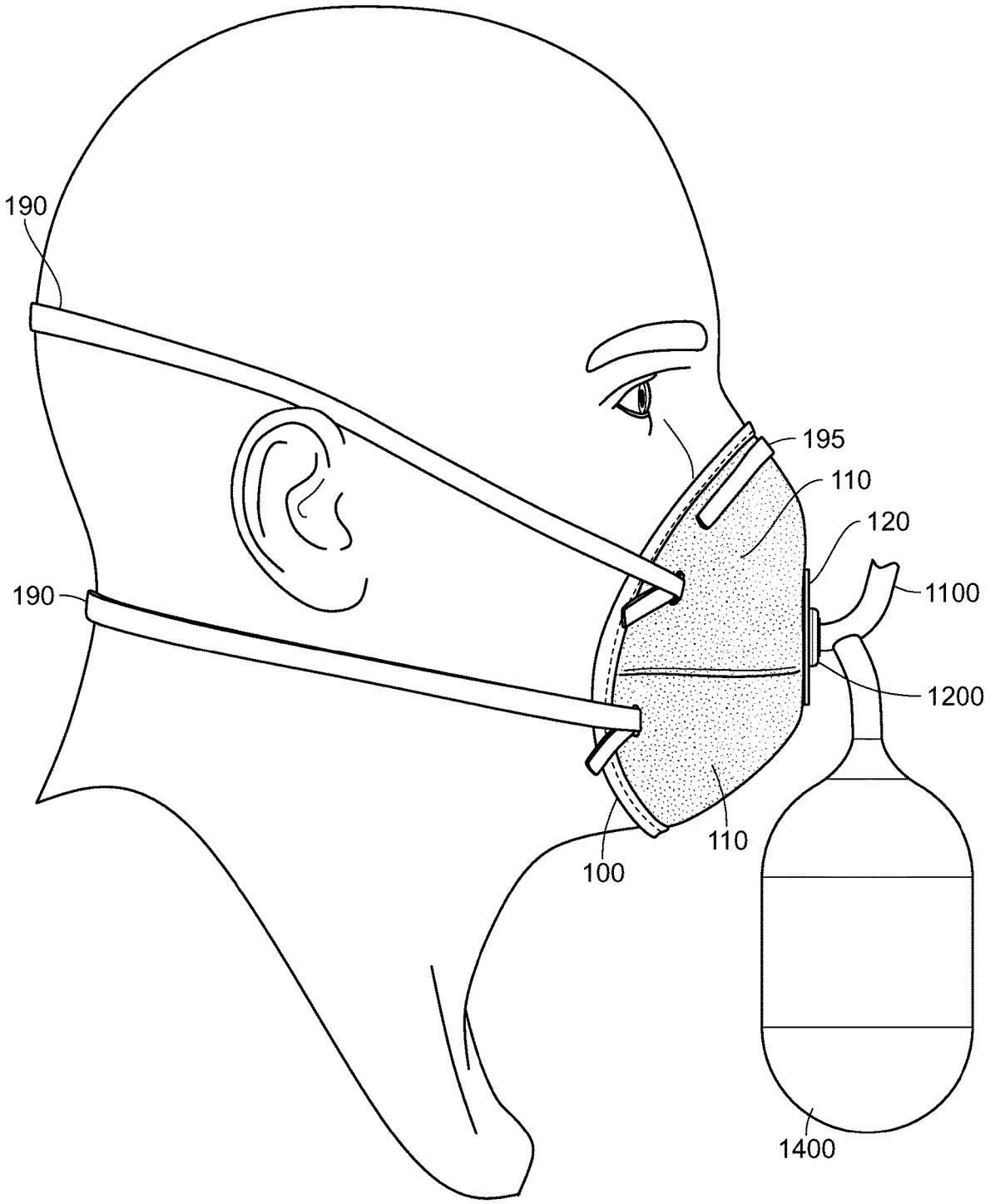
FIG. 19 is an illustrative, non-limiting example of a side view of a face mask with a connector, connector mechanism, connector portion or connector piece for connecting, attaching, inserting or accepting a tube, optionally connected or attached to an air vent, supplying filtered air supply from the air vent, with an optional air reservoir, according to some embodiments.
Figure 20:
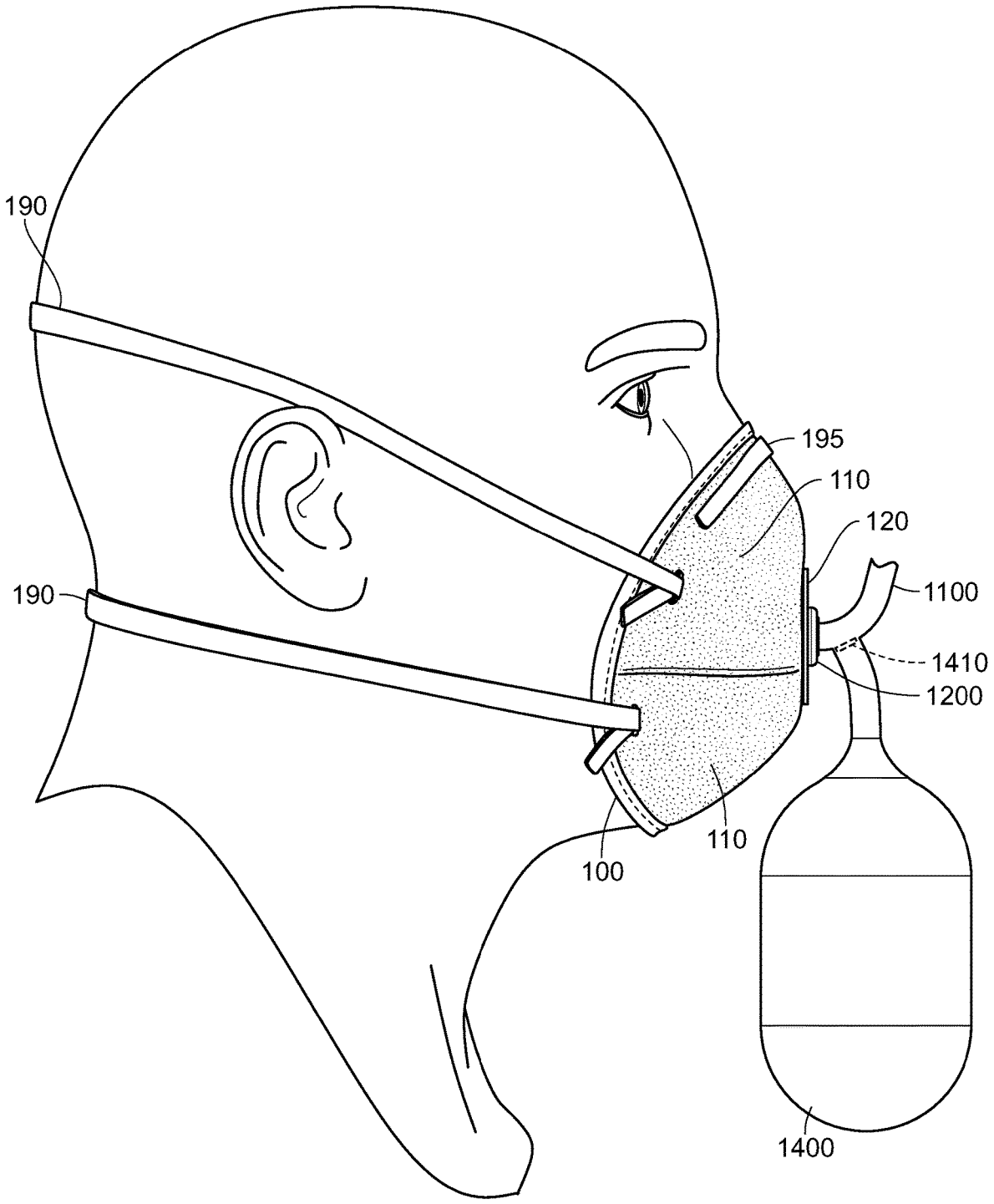
FIG. 20 is an illustrative, non-limiting example of a side view of a face mask with a connector, connector mechanism, connector portion or connector piece for connecting, attaching, inserting or accepting a tube, optionally connected or attached to an air vent, supplying filtered air supply from the air vent, with an optional air reservoir, including one or more valves, according to some embodiments.

In some embodiments, the connector, connector portion and/or connector piece 1000 (e.g. to air vent), 1200 (e.g. part of face mask 100), 1300 (e.g. for connecting to a face mask) can comprise a reservoir 1400 (FIGS. 18-20). The reservoir can be configured to accept and hold some of the air and airflow delivered by the air vent 140 and/or the opening in the air vent 1070. The reservoir can be configured to have a volume that is equal to, less than, or greater than a representative or typical tidal volume or inspiratory capacity volume, e.g. for a large size, medium size, or small size male or female user. The volume can be 300%, 250%, 200%, 175%, 150%, 125%, 100%, 75%, 50%, 25% or any other percentage of a representative or typical tidal volume or inspiratory capacity volume.

Figure 21:
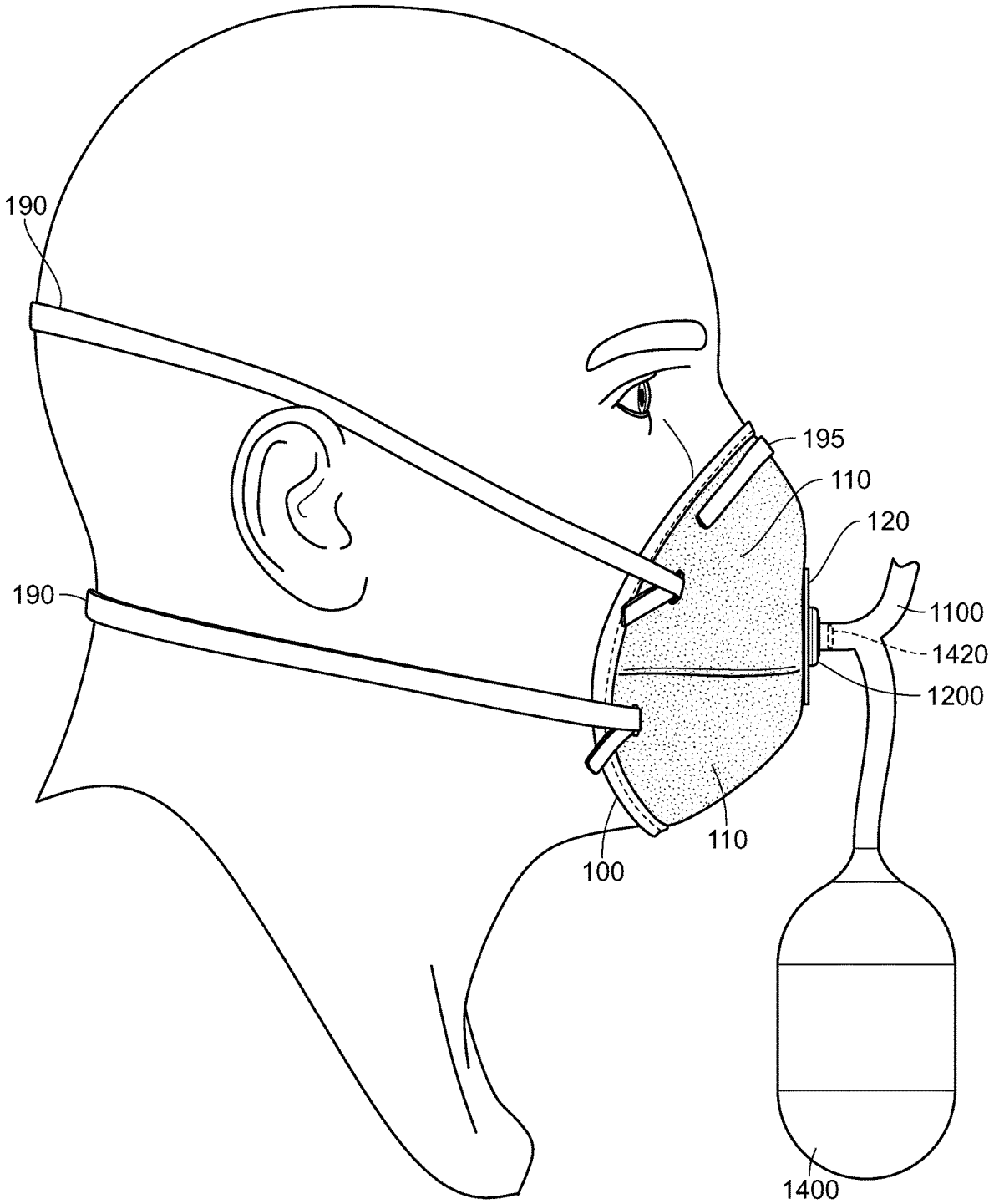
FIG. 21 is an illustrative, non-limiting example of a side view of a face mask with a connector, connector mechanism, connector portion or connector piece for connecting, attaching, inserting or accepting a tube, optionally connected or attached to an air vent, supplying filtered air supply from the air vent, with an optional air reservoir, including one or more valves, according to some embodiments.

One or more valves 1420 can be interposed or placed between the connector mechanism or attachment mechanism 1200 and/or the connector, connector portion or connector piece 120 of the face mask 100 and the tube 1100 and/or the reservoir 1400 (FIG. 21). For example, the valve can be configured to allow for inhalation or inspiration from the tube 1100 and/or reservoir 1400; the valve can be configured to block exhalation into the tube 1100 and/or reservoir 1400.

Figure 22:
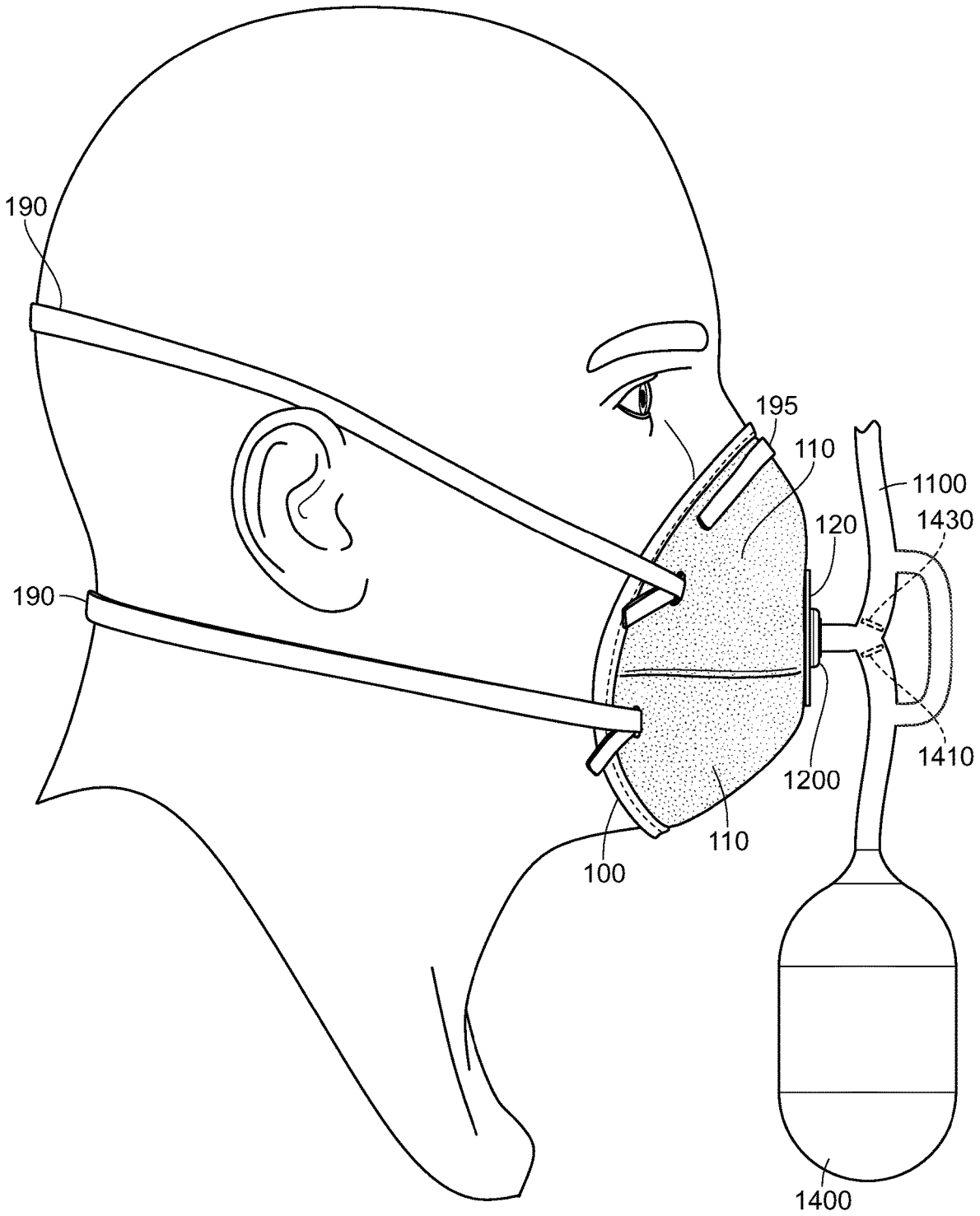
FIG. 22 is an illustrative, non-limiting example of a side view of a face mask with a connector, connector mechanism, connector portion or connector piece for connecting, attaching, inserting or accepting a tube, optionally connected or attached to an air vent, supplying filtered air supply from the air vent, with an optional air reservoir, including one or more valves, according to some embodiments.

A valve 1410 can be interposed between the tube and the reservoir. For example, the valve can be configured to allow for inhalation or inspiration; a valve 1410 or 1420 can be configured to block exhalation into the tube 1100 and/or reservoir 1400. Multiple valves, e.g. 1410, 1420, 1430, can be used, for example in any of the locations described in the specification including in air vents, connectors, connector portions and/or connector pieces 1000 (e.g. to air vent), 1200 (e.g. part of face mask 100), 1300 (e.g. for connecting to a face mask), and/or tubes 1100 (e.g. valve 1430) (FIG. 22); one or more valves can be used to block and/or prevent exhalation or expiration into a connector, connector portion or connector piece, a tube, and/or a reservoir.

Other valves 170 (FIGS. 4, 16), for example integrated into a face mask 100, can be used to facilitate expiration.

In some embodiments, the system can be configured so that during inspiration the entire tidal volume or inspiratory capacity volume is obtained from the contained airflow provided by the air vent, tube and connector (e.g. in the absence of a reservoir or with a reservoir).

In some embodiments, the system can be configured so that during inspiration a portion of the tidal volume or inspiratory capacity volume is obtained from the contained airflow provided by the air vent, tube and one or more (e.g. first, second third) connectors (e.g. in the absence of a reservoir or with a reservoir), e.g. 99%, 98%, 95%, 90%, 80%, 70%, 60%, 50%, 40% or any other percentage; for example, the remainder of the tidal volume or inspiratory capacity volume can be obtained from the mechanical filter respirator of the face mask or the air filter of the face mask. For example, the air supply can be mixed, e.g. part of the air supply during inspiration can be from the filtering portion, the particulate filtering portion, the particulate filtering facepiece, the particulate filtering facepiece respirator, or the mechanical filter respirator and its/their different components, filtering layers and/or filtering barriers and/or laminates of the face mask and part of the air supply during inspiration can be from the contained airflow provided by the air vent, tube and one or more (e.g. first, second, third, fourth, etc. . . . ) connectors. In some embodiments, e.g. when a tube is connected or inserted to or into a connector or connecting piece integrated or attached into a face mask, the majority or all of the air supply during inspiration can be from the contained airflow provided by the air vent, tube and one or more (e.g. first, second, third, fourth, etc. . . . ) connectors (including any optional reservoir(s)). In some embodiments, e.g. when a tube is not connected or inserted to or into a connector or connecting piece integrated or attached into a face mask, the majority or all of the air supply during inspiration can be from or through the filtering portion, the particulate filtering portion, the particulate filtering facepiece, the particulate filtering facepiece respirator, or the mechanical filter respirator and its/their different components, filtering layers and/or filtering barriers and/or laminates of the face mask.

In some embodiments, the system can be configured so that during inspiration, the tidal volume or inspiratory capacity volume is obtained from the airflow provided by the air vent, tube and connector and, optionally, in addition, air already present or accumulated in the reservoir. The air already present or accumulated in the reservoir can be air accumulated in the reservoir during expiration. In this embodiment, for example, expiratory air can be exhaled and removed from the face mask, e.g. via an expiratory valve. A valve interposed between the reservoir and the connector or connector piece or connector portion can block expiration or exhalation into the reservoir, so that clean, new air can accumulate in the reservoir during exhalation. The portion of the tidal volume or inspiratory capacity volume provided by the air vent, tube and connector vs. the portion of the tidal volume or inspiratory capacity volume already present in and provided by the reservoir can be, for example, 80% vs. 20%, or 70% vs. 30%, or 60% vs. 40%, or 55% vs. 45%, or 50% vs. 50%, or 45% vs. 55%, or 40% vs. 60%, or 30% vs. 70%, or 20% vs. 80%, or any other percentage or ratio of percentages.

In any of the embodiments throughout the specification, a first, second, third, and/or fourth connector, connector portion and/or connector piece 1000 (e.g. to air vent), 1200 (e.g. part of a face mask 100), 1300 (e.g. for connecting to a face mask) can be used. In any of the embodiments throughout the specification, a first, second, third, and/or fourth tube 1100 or portion of a tube 1100 can be used.

A first connector, connector portion, connector piece, and/or connector mechanism (e.g. element 900 in FIGS. 9A-C or 1000 in FIGS. 11A-C) can be attached to or integrated into a tube 1100 or tube portion 960 or tube element 960 and can be configured to be attached to or inserted into an air vent, e.g. 930.

A second connector, connector portion, connector piece, and/or connector mechanism (e.g. elements 970 or 975 in FIGS. 9A-C, FIGS. 11A-C or FIGS. 12A-C) can be attached to or integrated into a tube portion 960 or tube like element 960 and can be configured to be attached to, attachable to, or inserted or insertable into a tube 1100.

A third connector, connector portion, connector piece, and/or connector mechanism (e.g. elements 980 or 990 in FIGS. 9A-C, FIGS. 11A-C or FIGS. 12A-C) can be attached to or integrated into a tube 1100 and can be configured to be attached to, attachable to, insertable or inserted into a tube portion 960 or tube like element 960 and its connector, connector portion, connector piece, and/or connector mechanism (e.g. elements 970 or 975).

A fourth connector, connector portion, connector piece, and/or connector mechanism (e.g. elements 1300 or 1370 in FIGS. 13A-D) can be attached to or integrated into a tube 1100 and can be configured to be attached to, attachable to, insertable or inserted into a face mask, e.g. into a fifth connector, connector portion, connector piece, and/or connector mechanism (e.g. element 120 in FIGS. 13A-D).

In some embodiments, one or more of the connector, connector portion, connector piece, and/or connector mechanism can comprise cone shaped 980, threaded 985 990 or any other interlocking or attachable mechanism known in the art. Optionally, adhesives can also be used, for example in conjunction with one or more other attachment means or mechanisms.

The foregoing descriptions are only exemplary in nature and not meant to be limiting the invention. The numbers first, second, third, fourth, fifth or sixth connector, connector portion, connector piece, and/or connector mechanism can be designated to any of the connector, connector portion, connector piece, and/or connector mechanism in the specification. For example, a first connector, connector portion, connector piece, and/or connector mechanism can be a connector, connector portion, connector piece, and/or connector mechanism 120 integrated into and/or attached to a face mask, and/or a second connector, connector portion, connector piece, and/or connector mechanism can be the connector, connector portion, connector piece, and/or connector mechanism 900 or 1000 configured to be attachable to or insertable into an air vent.

Alternating and/or Mixed Air Supply Through Mechanical Filter Respirator or Air Filter and/or Contained Airflow The face mask and/or face mask system can be configured so that the air supply to the wearer can alternate between (or be mixed between) being provided through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or an air filter and being provided by the contained airflow supplied through the air vent, tube, and one or more connectors, with optional reservoir. The system, including components of the aircraft ventilation system, can be configured to maintain and/or adjust and/or regulate at least one of an airflow through one or more air vents, air pressure in one or more air vents, and/or cabin air pressure. The system can be configured so that the cabin air pressure is greater than the alveolar pressure of the passenger(s), e.g. for different phases of inspiration or expiration (FIG. 3B), with optional adjustment to maintain a pressure gradient between the cabin air pressure and the alveolar pressure of the passenger(s), e.g. for different phases of inspiration or expiration (FIG. 3B) and/or for different altitudes. The system can be configured so that the air pressure in an air vent, a tube, and/or one or more connectors is/are greater than the alveolar pressure of the passenger(s), with optional adjustment to maintain a pressure gradient between the air pressure in the air vent, tube, and/or one or more connectors and the alveolar pressure of the passenger (s), e.g. for different phases of inspiration and/or expiration (FIG. 3B) and/or for different altitudes. One or more computer processors can be configured to make the adjustment (s) to the cabin air pressure and/or the air pressure in an air vent, a tube, and/or one or more connectors, e.g. for different altitudes, for example by measuring the cabin air pressure and/or the air pressure in an air vent, a tube, and/or one or more connectors using one or more sensors and/or by regulating and/or adjusting pressure (cabin pressure and/or pressure in an air vent, tube, one or more connectors, and/or an aircraft ventilation system) and/or airflow using, for example, one or more air pumps and/or compressors.

The pressure difference between an air pressure in an air vent, a tube, and/or one or more connectors and an alveolar pressure of a passenger(s) (FIG. 3B) can be configured to be sufficient to overcome resistance to airflow by or through the air vent, the tube, and/or one or more connectors. The airflow through an air vent, a tube, and/or one or more connectors can be configured to be equal to or greater than a tidal volume or an inspiratory capacity of a passenger, e.g. during different phases of inspiration and/or expiration (FIG. 3B).

The airflow resistance of a filtering portion, a particulate filtering portion, a particulate filtering facepiece, a particulate filtering facepiece respirator, or a mechanical filter respirator and its/their different components, filtering layers and/or filtering barriers and/or laminates of a face mask can, for example, be described as, e.g. based on Ohm's law:

$$R_{MFR} = \frac{\Delta PMFR}{VA}$$

Where:

$$\Delta PMFR = P_{AC} - P_A$$

So:

$$R_{MFR} = \frac{PAC - PA}{VA}$$

Where:

$R_{MFR}$=Airflow resistance of filtering portion, particulate filtering portion, particulate filtering facepiece, particulate filtering facepiece respirator, or mechanical filter respirator and its/their different components, filtering layers and/or filtering barriers and/or laminates of a face mask ΔPMFR=Pressure difference or gradient driving airflow through filtering portion, particulate filtering portion, particulate filtering facepiece, particulate filtering facepiece respirator, or mechanical filter respirator and/or its/their different components, filtering layers and/or filtering barriers and/or laminates of a face mask into alveoli $P_{AC}$=Pressure in aircraft cabin $P_A$=Alveolar pressure $V_A$=Volumetric airflow, e.g. in liters/second The airflow resistance of an air filter, e.g. integrated into a face mask, can, for example, be described as, e.g. based on Ohm's law:

$$R_{AF} = \frac{\Delta PAF}{VA}$$

Where:

$$\Delta PAF = P_{AC} - P_A$$

-continued

So:

$$R_{AF} = \frac{PAC - PA}{VA}$$

Where:

$R_{AF}$=Airflow resistance of air filter

ΔPAF=Pressure difference or gradient driving airflow through air filter of face mask $P_{AC}$=Pressure in aircraft cabin $P_A$=Alveolar pressure $V_A$=Volumetric airflow, e.g. in liters/second The airflow resistance of contained air flow, e.g. supplied by an air vent using one or more connectors, a tube, and a connector or connecting piece or portion integrated into a face mask, can, for example, be described as, e.g. based on Ohm's law:

$$R_{CAF} = \frac{\Delta PCAF}{VA}$$

Where:

$$\Delta PCAF = P_{AVS} - P_A$$

So:

$$R_{CAF} = \frac{PAVS - PA}{VA}$$

Where:

$R_{CAF}$=Airflow resistance of contained air flow, e.g. airflow resistance of air vent, tube and/or connector(s)

ΔPCAF=Pressure difference or gradient between air vent, tube, connector(s) and/or face mask and alveoli, driving airflow through air vent, tube, connector(s) and/or face mask and conducting airways, e.g. trachea, bronchi, and bronchiole, to alveoli $P_{AC}$=Pressure in aircraft cabin $P_{AVS}$=Pressure delivered to or through air vent, tube, connector(s) and/or face mask by aircraft ventilation system $P_A$=Alveolar pressure $V_A$=Volumetric airflow The alveoli cannot expand by themselves. The alveoli expand passively in response to an increased distending pressure across the alveolar wall generated by the muscles of inspiration and the resultant inspiratory force. The muscles of inspiration and inspiratory force increase the transmural pressure difference and opens the distensible alveoli, thus lowering the alveolar pressure $P_A$. For a detailed description of pulmonary physiology and the mechanics of breathing, see, for example, Levitzky, Michael G. Pulmonary Physiology, Ninth Edition (p. 13). McGraw-Hill Education, which is hereby incorporated by reference in its entirety.

In any of the embodiments, $P_{AC}$ can, for example, change with altitude, temperature, weather conditions and, in select circumstances or system settings, with atmospheric pressure, and can, for example, be determined or modified by the aircraft ventilation system. $P_A$ and $V_A$ can, for example, change during the respiratory cycle, e.g. during different phases (e.g. early, mid, late) of inspiration or expiration; $P_A$ and $V_A$ can, for example, change with altitude and can, in select circumstances, for example, also be influenced or modified by the aircraft ventilation system and related $P_{AC}$.

In some embodiments, ΔP=Pressure difference driving airflow can, for example, be selected, influenced, controlled, modified or regulated by air flow speed; air flow strength/force; air flow pressure; air pressure $P_{AVS}$ in air vent, tube, connector(s), face mask; tube diameter; tube resistance; connector(s) diameter, e.g. at air vent to tube, or tube to reservoir, or tube to face mask; system air flow resistance; air flow volume delivered/sec; $P_{AC}$=pressure in aircraft cabin; $V_A$=volumetric airflow; $R_{MFR}$=airflow resistance of mechanical filter respirator; $R_{AF}$=airflow resistance of air filter; $R_{CAF}$=airflow resistance of contained air flow; aircraft cabin temperature. In some embodiments, $P_{AVS}$=Pressure delivered to/in air vent, tube, connector(s) and/or face mask by aircraft ventilation system can, for example, by influenced, controlled, modified or regulated by air flow speed; air pressure in aircraft ventilation system; air flow strength/force; tube diameter; tube resistance; connector(s) diameter, e.g. at air vent to tube, or tube to reservoir, or tube to face mask; system air flow resistance, air flow volume delivered/sec; $V_A$=volumetric airflow, temperature in ventilation system/tube or aircraft cabin.

The system can be configured to that the airflow resistance of contained air flow $R_{CAF}$ delivered to or through air vent, tube, connector(s) and/or face mask, e.g. the airflow resistance of air vent, tube and/or connector(s), is equal or less than the airflow resistance $R_{MFR}$ of a filtering portion, a particulate filtering portion, a particulate filtering facepiece, a particulate filtering facepiece respirator, or a mechanical filter respirator and/or its/their different components, filtering layers and/or filtering barriers and/or laminates of a face mask.

The system can be configured to that the airflow resistance of contained air flow $R_{CAF}$ delivered to or through air vent, tube, connector(s) and/or face mask, e.g. the airflow resistance of air vent, tube and/or connector(s), is equal or less than the airflow resistance $R_{AF}$ of an air filter of a face mask.

The system can be configured to that the airflow resistance of contained air flow $R_{CAF}$ delivered to or through air vent, tube, connector(s) and/or face mask, e.g. the airflow resistance of air vent, tube and/or connector(s), is equal or less than the airflow resistance $R_{MFR}$ of a filtering portion, a particulate filtering portion, a particulate filtering facepiece, a particulate filtering facepiece respirator, or a mechanical filter respirator and/or its/their different components, filtering layers and/or filtering barriers and/or laminates of a face mask and equal or less than the airflow resistance $R_{AF}$ of an air filter of the face mask and/or equal or less than the combined airflow resistance of a filtering portion, a particulate filtering portion, a particulate filtering facepiece, a particulate filtering facepiece respirator, or a mechanical filter respirator and/or its/their different components, filtering layers and/or filtering barriers and/or laminates of a face mask and an air filter of the face mask. In any of the foregoing embodiments, the difference in $R_{CAF}$, $R_{MFR}$, and/or $R_{AF}$ can be 5%, 10%, 20%, 30%, 50%, 60%, 70%, 80%, 90%, 95%, 100%, 110%, 120%, 130%, 150%, 200%, 300% or any other value, e.g. with $R_{CAF}$, being lesser or greater than $R_{MFR}$ and/or $R_{AF}$ by any of the foregoing percentages or any other value percentage.

The system can be configured to that the pressure difference or gradient of contained airflow driving airflow through air vent, tube, connector(s) and/or face mask and conducting airways, e.g. trachea, bronchi, and bronchioli, to alveoli (FIG. 3B) ΔPCAF is greater than or equal to the pressure difference or gradient driving airflow through a filtering portion, a particulate filtering portion, a particulate filtering facepiece, a particulate filtering facepiece respirator, or a mechanical filter respirator and/or its/their different components, filtering layers and/or filtering barriers and/or laminates of a face mask to alveoli ΔPMFR.

The system can be configured to that the pressure difference or gradient of contained airflow driving airflow through air vent, tube, connector(s) and/or face mask and conducting airways, e.g. trachea, bronchi, and bronchiole, to alveoli (FIG. 3B) ΔPCAF is greater than or equal to the pressure difference or gradient driving airflow through an air filter of a face mask to alveoli ΔPAF. The system can be configured to that the pressure difference or gradient of contained airflow driving airflow through air vent, tube, connector(s) and/or face mask and conducting airways, e.g. trachea, bronchi, and bronchiole, to alveoli (FIG. 3B) ΔPCAF is greater than or equal to the pressure difference or gradient driving airflow through a filtering portion, a particulate filtering portion, a particulate filtering facepiece, a particulate filtering facepiece respirator, or a mechanical filter respirator and/or its/their different components, filtering layers and/or filtering barriers and/or laminates of the face mask to alveoli ΔPMFR and greater or equal the pressure difference or gradient driving airflow through an air filter of a face mask to alveoli ΔPAF or greater than or equal to the combined pressure difference or gradient driving airflow through a filtering portion, a particulate filtering portion, a particulate filtering facepiece, a particulate filtering facepiece respirator, or a mechanical filter respirator and/or its/their different components, filtering layers and/or filtering barriers and/or laminates of a face mask and an air filter of the face mask.

In any of the foregoing embodiments, the difference in ΔPCAF, ΔPMFR, and/or ΔPAF can be 5%, 10%, 20%, 30%, 50%, 60%, 70%, 80%, 90%, 95%, 100%, 110%, 120%, 130%, 150%, 200%, 300% or any other value, e.g. with ΔPCAF, being lesser or greater than ΔPMFR and/or ΔPAF by any of the foregoing percentages or any other value percentage.

In some embodiments, the Hagen-Poiseuille equation or law can be used to estimate the airflow resistance, for example, when air is supplied via an air filter, e.g. a tubular shaped air filter, or as contained air flow, e.g. supplied by an air vent using one or more connectors, a tube, and a connector or connecting piece or portion integrated into a face mask. An exemplary equation, which can, for example, assume predominantly laminar air flow, can be provided as follows:

$$\Delta P = 8nlV/\pi r^4$$

Where:

ΔP=Pressure difference between ends of tube (or between an optional first and/or an optional second connector at the beginning and end of the tube)

n=dynamic viscosity l=length of the tube (optionally including connector(s))

V=volumetric flow rate or volumetric air flow r=radius of the tube

In any of the embodiments, the system can be configured so that the following one or more parameters, including combinations of these one or more parameters, can be selected, modified or adjusted for different temperatures and/or altitudes, e.g. during ascent or descent of the aircraft, in order to achieve consistent supply of 100% or any other desired percentage of tidal volume or inspiratory capacity volume by the contained airflow supplied through the air vent, tube, and connector(s), with optional reservoir, when the face mask is connected to the at least one of a connector, tube, air vent, or air ventilation or circulation system of the aircraft (or, optionally, the aircraft oxygen emergency system), with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow to alveoli $P_{AC}$=Pressure in aircraft cabin $P_{AVS}$=Pressure delivered to or through air vent, tube, connector(s) and/or face mask by aircraft ventilation system $V_A$=Volumetric airflow $T_{AC}$=Temperature in aircraft cabin $T_{AVS}$=Temperature in aircraft ventilation system and/or tube In any of the embodiments, the system can be configured so that the following one or more parameters, including combinations of these one or more parameters, can be selected, modified or adjusted for different passenger loads or numbers, e.g. 400, 300, 200, 150, 125, 100, 90, 80 70, 60, 50, 40, 30, 20, 10 passengers or any other number of passengers, in order to achieve consistent supply of 100% or any desired percentage (e.g. 90%, 80%, 70%, 60%, 50%, 40%, 30%, 20%, 10% or any other percentage) of tidal volume or inspiratory capacity volume by the contained airflow supplied through the air vent, tube, and/or connector (s), with optional reservoir, when the face mask is connected to the tube, air vent and air ventilation or circulation system of the aircraft (or, optionally, the aircraft oxygen emergency system) (e.g. 90%, 80%, 70%, 60%, 50%, 40%, 30%, 20%, 10% or any other percentage), with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube In any of the embodiments, the system can be configured so that the following one or more parameters, including combinations of these one or more parameters, can be selected, modified or adjusted for different passenger seat locations, including distribution of passengers across the plane/the seats of the plane (e.g. if only partially full), in order to achieve consistent supply of 100% or any desired percentage (e.g. 90%, 80%, 70%, 60%, 50%, 40%, 30%, 20%, 10% or any other percentage) of tidal volume or inspiratory capacity volume by the contained airflow supplied through the air vent, tube, and/or connector(s), with optional reservoir, when the face mask is connected to the tube, air vent and/or connector(s) and air ventilation or circulation system of the aircraft, with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube In any of the embodiments, the system can be configured so that the following one or more parameters, including combinations of these one or more parameters, can be selected, modified or adjusted for different cabin locations (e.g. first class, business class, economy class, e.g. reflecting differences in airflow or pressure(s) between cabins), in order to achieve consistent supply of 100% or any desired percentage (e.g. 90%, 80%, 70%, 60%, 50%, 40%, 30%, 20%, 10% or any other percentage) of tidal volume or inspiratory capacity volume by the contained airflow supplied through the air vent, tube, and connector, with optional reservoir, when the face mask is connected to the tube, air vent, and/or connector(s) and air ventilation or circulation system of the aircraft, with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube In any of the embodiments, the system can be configured so that the following one or more parameters, including combinations of these one or more parameters, can be selected, modified or adjusted for different passenger weights or height or gender or ethnicity to account for differences in tidal volume(s) and/or inspiratory capacity volume(s), in order to achieve consistent supply of 100% or any desired percentage (e.g. 90%, 80%, 70%, 60%, 50%, 40%, 30%, 20%, 10% or any other percentage) of tidal volume or inspiratory capacity volume (FIGS. 3A-3B) by the contained airflow supplied through the air vent, tube, and/or connector(s), with optional reservoir, when the face mask is connected to the tube, air vent and/or connector(s) and air ventilation or circulation system of the aircraft, with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube Such differences in passenger weights or height or gender or ethnicity can, optionally, be obtained on a voluntary basis, e.g. provided by the passenger(s) or, at least partially, based on identifying information provided during check-in or reservations.

In any of the embodiments, the system can be configured so that the following one or more parameters, including combinations of these one or more parameters, can be selected, modified or adjusted for different aircraft types, e.g. Boeing 787, 777, 767, 757, 747, 737, 727, 720, or Airbus A380, A350, A340, A330, 320, A310, A300 in order to achieve consistent supply of 100% or any desired percentage (e.g. 90%, 80%, 70%, 60%, 50%, 40%, 30%, 20%, 10% or any other percentage) of tidal volume or inspiratory capacity volume (FIGS. 3A-3B) by the contained airflow supplied through the air vent, tube, and/or connector(s), with optional reservoir, when the face mask is connected to the tube, air vent, and/or connector(s) and air ventilation or circulation system of the aircraft, with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube In any of the embodiments, the system can be configured so that the following one or more parameters, including combinations of these one or more parameters, can be selected, modified or adjusted for different for different configurations of the same aircraft, e.g. Boeing 747-800, 747-400, 747-100 in order to achieve consistent supply of 100% or any desired percentage (e.g. 90%, 80%, 70%, 60%, 50%, 40%, 30%, 20%, 10% or any other percentage) of tidal volume or inspiratory capacity volume by the contained airflow supplied through the air vent, tube, and/or connector(s), with optional reservoir, when the face mask is connected to the tube, air vent and/or connector(s) and air ventilation or circulation system of the aircraft, with the remaining percentage, if applicable, for example coming from the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube In any of the foregoing embodiments, the system can use one or more computer processors and/or sensors, for example to select, modify or adjust any of the following parameters:

$R_{CAF}$=Airflow resistance of contained air flow (e.g. option to open up or close, at least partially, connector, e.g. using iris-like mechanism, or option to open or close air vent, e.g. in a controlled manner)

ΔP Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube Sensors can, for example, comprise flow sensors (e.g. flap type, turbine type, mass flow meter type, air flow meter type, anemometer type [cup, vane, laser, hot-wire, ultrasonic], coriolis type meter, ultrasonic flow meter, orifice meter), pressure sensors (e.g. gauge, vacuum, differential, piezo type/based), spirometry based sensors, and other sensors known in the art. One or more computer processors can be used to control the one or more sensors. One or more computer processors can be used to obtain the data generated by the one or more sensors. One or more computer processors can be used to analyze the data generated by the one or more sensors. One or more computer processors can be used to select, control, modify, and or adjust one or more of the following parameters:

$R_{CAF}$=Airflow resistance of contained air flow (e.g. option to open up or close, at least partially, connector, e.g. using iris-like mechanism, or option to open or close air vent, e.g. in a controlled manner)

ΔP=Pressure difference or gradient driving airflow $P_{AC}$=Pressure in aircraft cabin $P_{AVS}$=Pressure delivered to tube or face mask by aircraft ventilation system $V_A$=Volumetric airflow $T_{AC}$=Temperature in aircraft cabin $T_{AVS}$=Temperature in aircraft ventilation system and/or tube The one or more computer processors can be the same or different computer processors, e.g. for the controlling the one or more sensors, the obtaining data generated by the one or more sensors, the analyzing data generated by the one or more sensors, the controlling, modifying, or adjusting the one or more parameters, including for operating any controls for the modifying or adjusting the one or more parameters.

The system, including the face mask and a filtering portion, a particulate filtering portion, a particulate filtering facepiece, a particulate filtering facepiece respirator, or a mechanical filter respirator and its/their different components, filtering layers and/or filtering barriers and/or laminates of the face mask and/or air filters, connector(s), and/or tube(s), the air vents, the air ducts, etc., can be configured so that the air, e.g. the tidal volume or the inspiratory capacity volume (FIGS. 3A-3B), is partially or completely provided to the user or passenger by the contained airflow supplied through the air vent, tube, and/or connector(s), with optional reservoir, when the face mask is connected to the connector(s), tube and/or air vent. For example, 100%, 99%, 98%, 95%, 90%, 85%, 80%, 70%, 60%, 50%, 40%, 30%, 20%, 10%, or any other percentage of the air, e.g. the tidal volume or the inspiratory capacity volume, can be provided by the contained airflow supplied through the air vent, tube, and/or connector(s), with optional reservoir, when the face mask is connected to the tube, air vent, and/or connector(s) and air ventilation or circulation system of the aircraft; any remaining percentage, if applicable, e.g. 1%, 2%, 5%, 10%, 15%, 20%, 30%, 40%, 50%, 60%, 70%, 80%, 90% or any other difference to 100% of tidal volume or inspiratory air capacity can be provided through the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask.

The face mask and/or system can be configured so that the air supply to the wearer, e.g. the tidal volume or the inspiratory capacity volume, can alternate between being provided through the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask and being provided by the contained airflow supplied through the air vent, tube, and/or connector(s), with optional reservoir. For example, when the user or passenger enters or exits the aircraft or leaves his or her chair, e.g. to go to the bathroom, kitchen, or other facilities of the aircraft, the user can breathe through the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask, thereby receiving a supply of filtered air meeting, for example, the tidal volume or the inspiratory capacity volume. The face mask and/or system can be configured so that when the tube is connected to the face mask and the air vent, e.g. using one or more connectors or connector pieces, e.g. integrated or attached to the face mask and/or the air vent, that at least a portion of the air supply, e.g. the tidal volume or the inspiratory capacity volume (FIGS. 3A-3B), is from the contained airflow supplied through the air vent, tube, and/or connector(s), with optional reservoir; for example, when the tube is connected to the face mask and the air vent, the following ratios of air supply, e.g. the tidal volume or the inspiratory capacity volume, can be from the contained airflow supplied through the air vent, tube, and/or connector(s), with optional reservoir versus the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask: 100%:0%, 99%:1%, 98%:2%, 97%:3%, 95%:5%, 90%:10%, 80%:20%, 70%:30%, 60%:40%, 50%:50%, 40%:60%, 30%:70%, 20%:80%, 10%:90%, 5%:95%, x %:(100−x) %, or any other ratio. At least one or more sensors and one or more computer processors can be used to control, modify, or regulate the system so that a pre-selected ratio between air supply, e.g. the tidal volume or the inspiratory capacity volume or a portion thereof, provided by the contained airflow supplied through the air vent, tube, and/or connector(s), with optional reservoir versus the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask can be maintained for 100%, 99%, 98%, 97%, 95%, 90%, 85%, 80%, 70%, 60%, 50%, or any other percentage of passengers. At least one or more sensors and one or more computer processors can be used to control, modify, or regulate the system so that a pre-selected ratio between air supply, e.g. the tidal volume or the inspiratory capacity volume, provided by the contained airflow supplied through the air vent, tube, and/or connector(s), with optional reservoir versus the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask will not be exceeded in upward or downward direction; one or more computer processors and related systems can be configured to sound or trigger an alarm if one or more predetermined or preselected target ratios or thresholds are broken (upward or downward).

In order to select, control, modify or adjust the ratio or predetermined range of acceptable ratios of air supply, e.g. the tidal volume or the inspiratory capacity volume, provided by the contained airflow supplied through the air vent, tube, and/or connector(s), with optional reservoir, versus air supply provided by the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask, one or more of the following parameters can be selected, controlled, adjusted or modified (Table 1):

TABLE 1

| Exemplary, non-limiting parameters that can be preselected, predetermined, selected, determined, controlled, adjusted or modified |
|---|
| $R_{MFR}$ = Airflow resistance of mechanical filter respirator |
| $R_{AF}$ = Airflow resistance of air filter |
| $R_{CAF}$ = Airflow resistance of contained air flow (e.g. option to open up or close, at least partially, connector, e.g. using iris-like mechanism, or option to open or close air vent, e.g. in a controlled manner) |
| $\Delta P$ = Pressure difference or gradient driving airflow |
| $P_{AC}$ = Pressure in aircraft cabin |
| $P_{AVS}$ = Pressure delivered to tube, connector(s), or face mask by aircraft ventilation system |
| $V_A$ = Volumetric airflow |
| $T_{AC}$ = Temperature in aircraft cabin |

TABLE 1-continued

| Exemplary, non-limiting parameters that can be preselected, predetermined, selected, determined, controlled, adjusted or modified |
|---|
| $T_{AVS}$ = Temperature in aircraft ventilation system and/or tube |
| ΔP = Pressure difference between ends of tube (or between a first and second connector at the beginning and end of the tube) |
| n = dynamic viscosity |
| l = length of the tube |
| V = volumetric flow rate or volumetric air flow |
| r = radius of the tube |
| Air flow speed |
| Air flow strength |
| Air flow pressure |
| Tube diameter |
| Tube airflow resistance |
| Connector(s) diameter, e.g. at air vent to tube, or tube to reservoir, or tube to face mask |
| Air vent diameter |
| System air flow resistance |
| Air vent airflow resistance |
| Connector air flow resistance |
| Combined airflow resistance of at least one of air vent, tube, connector(s) |
| Air flow volume delivered/sec |
| Reservoir volume |
| Thickness of face mask |
| Thickness of mechanical filter respirator |
| Thickness of air filter |
| Surface area of mechanical filter respirator |
| Surface area of air filter |

The foregoing parameters are only exemplary in nature and are not to be construed as limiting the invention.

The system can be configured so that the selecting, controlling, adjusting or modifying is performed centrally, e.g. by the aircraft personnel, for example for select sections of the aircraft cabin or select seats, or individually, e.g. by the user or passenger. One or more computer processors and, optionally, one or more sensors can be configured to assist with or perform the selecting, controlling, adjusting or modifying. A user interface, e.g. using a keyboard, track pad, mouse, LCD screen, touch screen or any other input means, can be provided and can be controlled by one or more computer processors; the user interface can also be used to control one or more computer processors. The selecting, controlling, adjusting or modifying of select parameters can also be performed using mechanical or electrical regulators, e.g. mechanical or electrical adjustors or mechanisms or devices to control the air flow through the air vent.

The face mask can also be configured to achieve a predetermined or desired ratio or range of ratios of air supply, e.g. the tidal volume or the inspiratory capacity volume, provided by the contained airflow supplied through the air vent, tube, and/or connector(s), with optional reservoir, versus air supply provided by the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask, when the face mask is connected to the tube and the air vent. For example, $R_{MFR}$=Airflow resistance of the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask can be predetermined, e.g. within a desirable or predetermined operating range or operating ranges, e.g. for different passengers, passenger demographics, users, user demographics, temperatures, altitude, $P_{AC}$, or other parameters (including any of the parameters listed above), by selecting a suitable thickness or surface area of the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask. $R_{AF}$=Airflow resistance of air filter can be predetermined, e.g. within a desirable or predetermined operating range for different passengers, users, temperatures, altitude, $P_{AC}$, or other parameters (including any of the parameters listed above) by selecting a suitable thickness, diameter or surface area of an air filter integrated or attached to the face mask.

The system can be configured, e.g. for a given or predetermined $R_{MFR}$=airflow resistance of a filtering portion, a particulate filtering portion, a particulate filtering facepiece, a particulate filtering facepiece respirator, or a mechanical filter respirator and its/their different components, filtering layers and/or filtering barriers and/or laminates of the face mask, thickness or surface area of a filtering portion, a particulate filtering portion, a particulate filtering facepiece, a particulate filtering facepiece respirator, or a mechanical filter respirator and its/their different components, filtering layers and/or filtering barriers and/or laminates of the face mask and/or a given or predetermined $R_{AF}$=airflow resistance of air filter, thickness, diameter or surface area of an air filter integrated or attached to the face mask, to achieve a predetermined or desired ratio or range or ratios of air supply, e.g. the tidal volume or the inspiratory capacity volume, provided by the contained airflow supplied through the air vent, tube, and/or connector(s), with optional reservoir, versus air supply provided by the filtering portion, the particulate filtering portion, the particulate filtering facepiece, the particulate filtering facepiece respirator, or the mechanical filter respirator and its/their different components, filtering layers and/or filtering barriers and/or laminates of the face mask and/or air filter of the face mask, when the face mask is connected to the tube, and/or connector(s) and the air vent, by selecting, preselecting, determining or predetermining acceptable operating ranges for any of the following exemplary ratios:

$R_{CAF}$:$R_{MFR}$ $R_{CAF}$:$R_{AF}$ $P_{AVS}$:$P_{AC}$ $V_A$ delivered through air vent, tube and connectors: $V_A$ delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask Volume per unit time (e.g. sec) delivered through air vent, tube and connector(s): Volume per unit time (e.g. sec) delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask $V_A$ delivered through air vent, tube and/or connector(s) for a given or predetermined inspiratory force/effort: $V_A$ delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask for a given or predetermined inspiratory force/effort Volume per unit time (e.g. sec) delivered through air vent, tube and/or connector(s) for a given or predetermined inspiratory force/effort: Volume per unit time (e.g. sec) delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask for a given or predetermined inspiratory force/effort $\Delta P_{CAF}=P_{AVS}-P_A$ (pressure difference or gradient driving contained airflow through air vent, tube and/or connector(s)): $\Delta P_{MFR\ and/or\ AF}=P_{AC}-P_A$ (pressure difference driving airflow through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask)

Inspiratory force or negative inspiratory force required to breathe contained airflow: inspiratory force or negative inspiratory force required to breathe through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask or both Inspiratory pressure required to breathe contained airflow: inspiratory pressure required to breathe through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask or both For example, the system (including the face mask) can be configured so that $R_{CAF}$ is 10×, 9×, 8×, 7×, 6×, 5×, 4×, 3×, 2×, 1.5×, 1.2×, 1.1×, 1.0×, 0.9×, 0.8×, 0.7×, or any other factor greater than $R_{MFR}$ and/or $R_{AF}$. In another example, $P_{AVS}$ can be greater than $P_{AC}$, or $V_A$ delivered through air vent, tube and/or connector(s) can be greater than $V_A$ delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, or Volume per unit time (e.g. sec) delivered through air vent, tube and/or connector(s) can be greater than Volume per unit time (e.g. sec) delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, or $V_A$ delivered through air vent, tube and/or connector(s) for a given or predetermined inspiratory force/effort can be greater than $V_A$ delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask for a given or predetermined inspiratory force/effort, or Volume per unit time (e.g. sec) delivered through air vent, tube and/or connector(s) for a given or predetermined inspiratory force/effort can be greater than Volume per unit time (e.g. sec) delivered through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask for a given or predetermined inspiratory force/effort, or $\Delta P_{CAF}=P_{AVS}-P_A$ (pressure difference or gradient driving contained airflow through air vent, tube and/or connector(s)) can be greater than $\Delta P_{MFR\ and/or\ AF}-P_{AC}-P_A$ (pressure difference driving airflow through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask), or inspiratory force or negative inspiratory force required to breathe contained airflow can be less than inspiratory force or negative inspiratory force required to breathe through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask or both, or inspiratory pressure required to breathe contained airflow can be less than inspiratory pressure required to breathe through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask or both by a factor of 10×, 9×, 8×, 7×, 6×, 5×, 4×, 3×, 2×, 1.5×, 1.2×, 1.1×, 1.0×, 0.9×, 0.8×, 0.7×, 0.6×, 0.5× or any other factor or by a percentage of 300%, 200%, 150%, 125%, 100%, 75%, 50%, 25%, 10%, 0%, −10%, −25%, −50%, −75%, −100%, −125%, −150%, −200%, −300% or any other percentage.

The selecting, determining, controlling, selecting, modifying and or adjusting of any of the foregoing parameters and/or ratios can, for example, also be achieved, at least in part, using the ventilation system of the aircraft, e.g. by selecting, controlling, modifying or adjusting temperatures, system air flow speed, system air flow volume, air flow speed, air flow volume, air flow volume per unit time, system air pressure, cabin air pressure, etc.

The selecting, determining, controlling, selecting, modifying and or adjusting of any of the foregoing parameters and/or ratios can, for example, also be achieved, at least in part, by selecting, controlling, modifying or adjusting the opening or inner diameter of an air vent, the inner diameter or radius of a tube, tube portion, tube like element, or the inner diameter or radius of one or more connector(s), connecting piece(s), connection portion(s), connecting mechanism(s) in any embodiments, e.g. connector(s), connecting piece(s), connection portion(s), connecting mechanism(s) to and/or integrated into or attached to a face mask, a tube, tube portion, tube like element and/or an air vent.

The selecting, determining, controlling, selecting, modifying and or adjusting of any of the foregoing parameters and/or ratios can, for example, also be achieved, at least in part, by controlling the airflow, e.g. regulating between laminar and/or turbulent airflow, in a tube, tube portion, tube like element, or in one or more connector(s), connecting piece(s), connection portion(s), connecting mechanism(s) in any embodiments, e.g. connector(s), connecting piece(s), connection portion(s), connecting mechanism(s) to and/or integrated into or attached to a face mask, a tube, tube portion, tube like element and/or an air vent.

The selecting, determining, controlling, selecting, modifying and or adjusting of any of the foregoing parameters and/or ratios can, for example, also be achieved, at least in part, by controlling the surface resistance or surface roughness in a tube, tube portion, tube like element, or in one or more connector(s), connecting piece(s), connection portion(s), connecting mechanism(s) in any embodiments, e.g. connector(s), connecting piece(s), connection portion(s), connecting mechanism(s) to and/or integrated into or attached to a face mask, a tube, tube portion, tube like element and/or an air vent.

The selecting, determining, controlling, selecting, modifying and or adjusting of any of the foregoing parameters and/or ratios can, for example, also be achieved, at least in part, by selecting, controlling, modifying or adjusting the porosity, thickness, surface area, resistance to airflow of a filtering portion, a particulate filtering portion, a particulate filtering facepiece, a particulate filtering facepiece respirator, or a mechanical filter respirator and its/their different components, filtering layers and/or filtering barriers and/or laminates of the face mask and/or air filter of the face mask.

Any combinations of the foregoing are possible, e.g. by predetermining, selecting, adjusting, and/or modifying radii, diameters, flow dynamics, flow speed, flow characteristics, surface resistance, surface roughness, and/or porosity, thickness, surface area, resistance to airflow, e.g. of of a filtering portion, a particulate filtering portion, a particulate filtering facepiece, a particulate filtering facepiece respirator, or a mechanical filter respirator and its/their different components, filtering layers and/or filtering barriers and/or laminates of the face mask and/or air filter of the face mask.

Other ratios of parameters listed, for example, in Table 1, can be selected, preselected, determined, predetermined, including within preselected or predetermined ranges, e.g. operating ranges in order to achieve a predetermined or desired ratio or range or ratios of air supply, e.g. tidal volume or inspiratory capacity volume, provided by the contained airflow supplied through the air vent, tube, and/or connector(s), with optional reservoir, versus air supply, e.g. tidal volume or inspiratory capacity volume, provided by a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, when the face mask is connected to the tube and the air vent. The system can be configured to achieve one or more of these predetermined ratios, range or ratios, or operating range of ratios, e.g. by selecting, determining, modifying, and/or adjusting any of the parameters listed in Table 1, including any combinations of parameters. Using one or more computer processors and/or one or more sensors, the system can be configured to modify or adjust one or more of the parameters listed in Table 1, including parameter ranges, in real-time, or at predefined or predetermined time intervals, e.g. every 15 sec, 60 sec, 2 min, 5 min, 10 min, 20 min, 30 min or any other time interval. The system can also be configured, e.g. using one or more computer processors and/or one or more sensors, to adjust or modify one or more parameters, e.g. listed in Table 1, when another parameter is altered, e.g. altitude or cabin temperature.

Any of the predetermined or target ratios or factors can be achieved by configuring the system including the face mask, including a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, and/or an aircraft ventilation system, air vent(s), connector(s), tube(s), valve(s) (e.g. in the face mask, tube, and/or connector system(s)) to preselect, predetermine, control, adjust, modify any of the parameters, including combinations of parameters, listed in Table 1 to fall within predetermined acceptable operating ranges or target values.

In some embodiments, the system can be configured to provide at all times or at predefined or predetermined times (e.g. during take off or landing) a predetermined ratio or range of ratios of air supply, e.g. tidal volume or inspiratory capacity volume, provided by the contained airflow supplied through the air vent, tube, and/or connector(s), with optional reservoir, versus air supply, e.g. tidal volume or inspiratory capacity volume, provided by a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, when the face mask is connected to the tube and the air vent.

In some embodiments, the system and/or the face mask can be configured so that the air supply is filtered by a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, when the face mask is not connected to the air vent and tube, e.g. contained air supply.

In some embodiments, a mechanical or electrical actuator can turn off the air supply through a filtering portion, a particulate filtering portion, a particulate filtering facepiece, a particulate filtering facepiece respirator, or a mechanical filter respirator and its/their different components, filtering layers and/or filtering barriers and/or laminates of a face mask and/or air filter of a face mask, for example when a tube is connected to the connector portion of the face mask. For example, upon inserting a tube into a Luer lock style connector in the connector portion of the face mask, the male portion of the tube can be configured to activate or push a lever that can close, at least partially, an air access valve to an air filter, effectively blocking, at least partially blocking, or controlling inspiration and/or expiration through the air filter and, for example, ensuring a minimum ratio of contained air flow to air flow through the air filter.

Any of the foregoing embodiments can be used and/or applied in any means for transportation that utilize, for example, a ventilation system (e.g. with filtered air and air vents) and/or an oxygen supply system. Aspects of the invention and embodiments can be used in planes, trains, and/or buses.

The invention claimed is:

1. A system for providing filtered air to a person, the system comprising a face mask;

a connector integrated or connected to the face mask;

a tube; and a valve;

wherein the face mask comprises a breathable mechanical filter respirator comprising two layers of non-woven polypropylene fabric configured to allow inhalation and exhalation through the face mask and configured for filtering air, wherein the breathable mechanical filter respirator comprises about 80% of the mask, wherein the connector is interposed between the two layers;

wherein the tube is configured to be connected to an air vent, wherein the tube is configured to be connected to the connector integrated or connected to the face mask, wherein the tube and the connector are configured to deliver air filtered by a high efficiency particulate air filter (HEPA) of an aircraft ventilation system, a train ventilation system, or a bus ventilation system, from the air vent to the face mask, and wherein the valve is configured to block air flow through the connector when the tube is not connected to the connector and to allow air to flow when the tube is connected to the connector.

2. The system of claim 1, wherein the mechanical filter respirator is configured to filter particles and droplets comprising COVID-19.

3. The system of claim 1, wherein the tube is configured to deliver contained airflow from the air vent to the face mask, and wherein the air vent is an air vent in a plane, a train, or a bus.

4. The system of claim 1, wherein the face mask comprises a peripheral portion configured to conform to the face of the person, the peripheral portion comprising a seal configured to provide a substantially airtight seal.

* * * * *